US010498019B2

(12) United States Patent
Ohtake et al.

(10) Patent No.: US 10,498,019 B2
(45) **Date of Patent: *Dec. 3, 2019**

(54) SCANNING ANTENNA

(71) Applicant: SHARP KABUSHIKI KAISHA, Sakai, Osaka (JP)

(72) Inventors: Tadashi Ohtake, Sakai (JP); Kiyoshi Minoura, Sakai (JP); Makoto Nakazawa, Sakai (JP); Takatoshi Orui, Sakai (JP); Wataru Nakamura, Sakai (JP); Fumiki Nakano, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/073,218

(22) PCT Filed: Oct. 17, 2016

(86) PCT No.: PCT/JP2016/080706

§ 371 (c)(1),
(2) Date: Jul. 26, 2018

(87) PCT Pub. No.: WO2017/130475

PCT Pub. Date: Aug. 3, 2017

(65) Prior Publication Data

US 2019/0006746 A1 Jan. 3, 2019

(30) Foreign Application Priority Data

Jan. 29, 2016 (JP) ..... 2016-015427

(51) Int. Cl.
*H01Q 1/38* (2006.01)
*H01Q 1/02* (2006.01)
(Continued)

(52) U.S. Cl.
CPC ..... *H01Q 1/38* (2013.01); *H01Q 1/02* (2013.01); *H01Q 21/064* (2013.01); *H01Q 3/34* (2013.01)

(58) Field of Classification Search
None
See application file for complete search history.

(56) References Cited

U.S. PATENT DOCUMENTS 7,466,269 B2 12/2008 Haziza
7,847,894 B2 12/2010 Rho
(Continued)

FOREIGN PATENT DOCUMENTS

JP 2002-217640 A 8/2002
JP 2007-116573 A 5/2007
(Continued)

OTHER PUBLICATIONS

R. A. Stevenson et al., "Rethinking Wireless Communications: Advanced Antenna Design using LCD Technology", SID 2015 Digest, pp. 827-830.
(Continued)

*Primary Examiner* — Trinh V Dinh
(74) *Attorney, Agent, or Firm* — ScienBiziP, P.C.

(57) ABSTRACT

A scanning antenna (1000) in which a plurality of antenna units (U) are arranged, the scanning antenna including: a TFT substrate (101) including a first dielectric substrate (1), TFTs, gate bus lines, source bus lines, and patch electrodes (15); a slot substrate (201) including a second dielectric substrate (51) and a slot electrode (55) formed on a first main surface of the second dielectric substrate; a liquid crystal layer (LC) provided between the TFT substrate and the slot substrate; and a reflective conductive plate (65) disposed opposing via a dielectric layer (54) a second main surface opposite to the first main surface of the second dielectric
(Continued)

substrate, (51) wherein the slot electrode includes slots disposed corresponding to the respective patch electrodes, and a heater part (68) is further provided on the outside of the TFT substrate (101) or on the outside of the slot substrate (201).

8 Claims, 20 Drawing Sheets

(51) Int. Cl.
*H01Q 21/06* (2006.01)
*H01Q 3/34* (2006.01)

(56) References Cited

U.S. PATENT DOCUMENTS

| | | | | |
|---|---|---|---|---|
| 10,153,550 | B2 * | 12/2018 | Orui | H01Q 3/34 |
| 10,170,826 | B2 * | 1/2019 | Nakazawa | H01L 29/786 |
| 10,177,444 | B2 * | 1/2019 | Nakazawa | H01L 27/1225 |
| 2007/0175393 | A1 * | 8/2007 | Nishimura | H01J 37/32192 118/715 |
| 2012/0092577 | A1 | 4/2012 | Shi et al. | |
| 2012/0138922 | A1 | 6/2012 | Yamazaki et al. | |
| 2012/0194399 | A1 | 8/2012 | Bily et al. | |
| 2013/0320334 | A1 | 12/2013 | Yamazaki et al. | |
| 2014/0286076 | A1 | 9/2014 | Aoki et al. | |
| 2018/0294542 | A1 * | 10/2018 | Minoura | H01Q 3/34 |
| 2018/0301806 | A1 * | 10/2018 | Orui | G02F 1/13 |
| 2019/0148838 | A1 * | 5/2019 | Ohtake | H01Q 21/064 343/720 |

FOREIGN PATENT DOCUMENTS

| | | | |
|---|---|---|---|
| JP | 2007-295044 | A | 11/2007 |
| JP | 2009-538565 | A | 11/2009 |
| JP | 2012-134475 | A | 7/2012 |
| JP | 2013-539949 | A | 10/2013 |
| JP | 2014-007399 | A | 1/2014 |
| JP | 2014-209727 | A | 11/2014 |
| WO | 2007/139736 | A2 | 12/2007 |
| WO | 2012/050614 | A1 | 4/2012 |
| WO | 2014/149341 | A1 | 9/2014 |
| WO | 2015/126550 | A1 | 8/2015 |
| WO | 2015/126578 | A1 | 8/2015 |
| WO | 2016/057539 | A1 | 4/2016 |
| WO | 2016/130383 | A1 | 8/2016 |
| WO | 2016/141340 | A1 | 9/2016 |
| WO | 2016/141342 | A1 | 9/2016 |

OTHER PUBLICATIONS

M. Ando et al., "A Radial Line Slot Antenna for 12GHz Satellite TV Reception", IEEE Transactions of Antennas and Propagation, vol. AP-33, No. 12, pp. 1347-1353 (1985).

M. Wittek et al., "Liquid Crystals for Smart Antennas and Other Microwave Applications", SID 2015 Digestpp. 824-826.

Kuki, "New Functional Element Using Liquid Crystal" Polymer, vol. 55, August issue, pp. 599-602 (2006) (A concise explanation of the relevance can be found in paragraph [0071] of the present Description of the subject application).

Co-pending letter regarding a related co-pending U.S. Appl. No. 15/542,488, filed Jul. 10, 2017.

* cited by examiner

1H
VgH
PS
VgL
G-L1

G-L2
Vg

G-L3

2H
Vs(LCD)

5H
Vda

Vidc

5H
Vlc

SCANNING ANTENNA

TECHNICAL FIELD

The present invention relates to a scanning antenna, and particularly relates to a scanning antenna (may be referred to as a "liquid crystal array antenna") in which an antenna unit (may be referred to as an "element antenna") includes liquid crystal capacitance.

BACKGROUND ART

An antenna for mobile communication and satellite broadcasting needs to function to change the beam direction (referred to as "beam scanning" or "beam steering"). As an example of the antenna (hereinafter referred to as a "scanning antenna") having such a function, a phased array antenna including antenna units is known. However, an existing phased array antenna is expensive, which is an obstacle for popularization as a consumer product. Particularly, as the number of antenna units increases, the cost rises considerably.

Therefore, a scanning antenna utilizing high dielectric anisotropy (birefringence index) of a liquid crystal material (including nematic liquid crystals and polymer dispersed liquid crystals) has been proposed (PTL 1 to PTL 4 and NPL 1). Since a dielectric constant of a liquid crystal material has frequency dispersion, a dielectric constant in a frequency band of microwaves (may be referred to as a "dielectric constant with respect to microwaves") is particularly referred to as a "dielectric constant $M_{(\varepsilon M)}$" herein.

PTL 3 and NPL 1 each describe an inexpensive scanning antenna that can be obtained by utilizing liquid crystal display (hereinafter referred to as "LCD") device technology.

CITATION LIST

Patent Literature

PTL 1: JP 2007-116573 A
PTL 2: JP 2007-295044 A
PTL 3: JP 2009-538565 T
PTL 4: JP 2013-539949 T

Non-Patent Literature

NPL 1: R. A. Stevenson et al., "Rethinking Wireless Communications: Advanced Antenna Design using LCD Technology," SID 2015 DIGEST, pp. 827-830.

NPL 2: M. ANDO et al., "A Radial Line Slot Antenna for 12 GHz Satellite TV Reception," IEEE Transactions of Antennas and Propagation, Vol. AP-33, No. 12, pp. 1347-1353 (1985).

SUMMARY OF INVENTION

Technical Problem

As described above, although the idea of realizing an inexpensive scanning antenna by applying LCD technology is known, there is no document that specifically describes a structure, a production method, and a driving method of a scanning antenna utilizing LCD technology.

Therefore, it is an object of the present invention to provide a scanning antenna which can be mass-produced by utilizing the existing LCD production technology.

Solution to Problem

A scanning antenna according to an embodiment of the present invention includes a scanning antenna in which a plurality of antenna units are arranged, the scanning antenna including a TFT substrate including: a first dielectric substrate, a plurality of TFTs supported by the first dielectric substrate, a plurality of gate bus lines, a plurality of source bus lines, and a plurality of patch electrodes; a slot substrate including: a second dielectric substrate, and a slot electrode formed on a first main surface of the second dielectric substrate; a liquid crystal layer provided between the TFT substrate and the slot substrate; and a reflective conductive plate disposed opposing via a dielectric layer a second main surface opposite to the first main surface of the second dielectric substrate, wherein the slot electrode includes a plurality of slots disposed corresponding to the plurality of patch electrodes, and a heater part is further disposed on an outside of the first dielectric substrate or on an outside of the second dielectric substrate.

According to an embodiment, the heater part includes a heater resistive film.

According to an embodiment, the scanning antenna further includes a protective layer configured to cover the heater resistive film.

According to an embodiment, the protective layer is formed of a curable resin layer, a high polymer film, or a glass plate.

According to an embodiment, the heater resistive film is directly formed on the first dielectric substrate.

According to an embodiment, the scanning antenna further includes an adhesive layer between the first dielectric substrate and the heater resistive film.

According to an embodiment, the heater resistive film includes a plurality of openings, and the plurality of openings include a plurality of openings corresponding to the plurality of slots and being greater in size than the plurality of slots.

According to an embodiment, the scanning antenna further includes a power source connected to the heater part, and a temperature control device configured to control a current supplied from the power source to the heater part.

A TFT substrate according to an embodiment of the present invention includes a TFT substrate including a dielectric substrate and a plurality of antenna unit regions arranged on the dielectric substrate. The TFT substrate includes a transmission and/or reception region including the plurality of antenna unit regions and a non-transmission and/or reception region located in a region other than the transmission and/or reception region. Each of the plurality of antenna unit regions includes a thin film transistor supported by the dielectric substrate and including a gate electrode, a semiconductor layer, a gate insulating layer located between the gate electrode and the semiconductor layer, and a source electrode and a drain electrode electrically connected to the semiconductor layer; a first insulating layer covering the thin film transistor and including a first opening exposing the drain electrode of the thin film transistor; and a patch electrode formed on the first insulating layer and within the first opening and electrically connected to the drain electrode of the thin film transistor. The patch electrode includes a metal layer, and the thickness of the metal layer is greater than the thickness of each of the source electrode and the drain electrode of the thin film transistor.

According to an embodiment, the TFT substrate may further include a second insulating layer covering the patch electrode. The thickness of the metal layer may be greater than or equal to 1 μm and less than or equal to 30 μm.

According to an embodiment, the TFT substrate further include a transfer terminal section disposed in the non-transmission and/or reception region. The transfer terminal section includes a patch connecting section formed of the same conductive film as a conductive film of the patch electrode, the second insulating layer extending on the patch connecting section and including a second opening exposing a portion of the patch connecting section, and an upper transparent electrode formed on the second insulating layer and within the second opening and electrically connected to the patch connecting section.

According to an embodiment, the TFT substrate further include a gate terminal section. The gate terminal section includes a gate bus line formed of the same conductive film as a conductive film of the gate electrode, the gate insulating layer extending on the gate bus line, the first insulating layer and the second insulating layer, and a gate terminal upper connection section formed of the same transparent conductive film as a transparent conductive film of the upper transparent electrode. A gate terminal contact hole exposing a portion of the gate bus line is formed in the gate insulating layer, the first insulating layer, and the second insulating layer, and the gate terminal upper connection section is disposed on the second insulating layer and within the gate terminal contact hole and is in contact with the gate bus line within the gate terminal contact hole.

According to an embodiment, the TFT substrate further include a transfer terminal section disposed in the non-transmission and/or reception region. The transfer terminal section includes a source connection wiring line formed of the same conductive film as a conductive film of the source electrode, the first insulating layer extending on the source connection wiring line and including a third opening exposing a portion of the source connection wiring line and a fourth opening exposing another portion of the source connection wiring line, a patch connecting section formed on the first insulating layer and within the third opening, and an upper transparent electrode formed on the first insulating layer and within the fourth opening. The patch connecting section is electrically connected to the upper transparent electrode via the source connection wiring line and is formed of the same conductive film as the conductive film of the patch electrode. The second insulating layer extends on the transfer terminal section, covers the patch connecting section, and includes an opening exposing at least a portion of the upper transparent electrode.

According to an embodiment, the TFT substrate further includes a transfer terminal section disposed in the non-transmission and/or reception region. The transfer terminal section includes, on the first insulating layer, a patch connecting section formed of the same conductive film as the conductive film of the patch electrode and a protective conductive layer covering the patch connecting section, and the second insulating layer extends on the protective conductive layer and includes an opening exposing a portion of the protective conductive layer.

According to an embodiment, the TFT substrate further includes a gate terminal section. The gate terminal section includes a gate bus line formed of the same conductive film as the conductive film of the gate electrode, the gate insulating layer and the first insulating layer extending on the gate bus line and a gate terminal upper connection section formed of a transparent conductive film. A gate terminal contact hole exposing the gate terminal upper connection section is formed in the gate insulating layer and the first insulating layer, the gate terminal upper connection section is disposed on the first insulating layer and within the gate terminal contact hole, and is in contact with the gate bus line within the gate terminal contact hole, and the second insulating layer extends on the gate terminal upper connection section and includes an opening exposing a portion of the gate terminal upper connection section.

A scanning antenna according to an embodiment of the present invention includes any one of the above-described TFT substrates, a slot substrate disposed opposing the TFT substrate, a liquid crystal layer provided between the TFT substrate and the slot substrate, and a reflective conductive plate disposed opposing via a dielectric layer a surface of the slot substrate opposite to the liquid crystal layer. The slot substrate includes another dielectric substrate and a slot electrode formed on a surface of the another dielectric substrate closer to the liquid crystal layer, the slot electrode includes a plurality of slots, and the plurality of slots are disposed corresponding to the patch electrodes in the plurality of antenna unit regions of the TFT substrate.

A scanning antenna according another embodiment of the present invention includes any one of the above-described TFT substrates, a slot substrate disposed opposing the TFT substrate, a liquid crystal layer provided between the TFT substrate and the slot substrate, and a reflective conductive plate disposed opposing via a dielectric layer a surface of the slot substrate opposite to the liquid crystal layer. The slot substrate includes another dielectric substrate and a slot electrode formed on a surface of the another dielectric substrate closer to the liquid crystal layer, the slot electrode includes a plurality of slots, the plurality of slots are disposed corresponding to the patch electrodes in the plurality of antenna unit regions of the TFT substrate, and the slot electrode is connected to the transfer terminal section of the TFT substrate.

A method for producing a TFT substrate according to an embodiment of the present invention includes a method for producing a TFT substrate including a transmission and/or reception region including a plurality of antenna unit regions and a non-transmission and/or reception region other than the transmission and/or reception region and including a thin film transistor and a patch electrode in each of the plurality of antenna unit regions. The method includes steps of: (a) forming a thin film transistor on a dielectric substrate, (b) forming a first insulating layer to cover the thin film transistor and forming, in the first insulating layer, a first opening exposing a portion of a drain electrode of the thin film transistor, (c) forming a patch electrode conductive film on the first insulating layer and within the first opening, and forming, by patterning the patch electrode conductive film, a patch electrode being in contact with the drain electrode within the first opening, and (d) forming a second insulating layer covering the patch electrode. The patch electrode includes a metal layer, and a thickness of the metal layer is greater than a thickness of each of the source electrode and the drain electrode of the thin film transistor.

According to an embodiment, the step (a) includes steps of: (a1) forming a gate conductive film on a dielectric substrate and forming, by patterning the gate conductive film, a plurality of gate bus lines and a gate electrode of the thin film transistor, (a2) forming a gate insulating layer covering the plurality of gate bus lines and the gate electrode, (a3) forming, on the gate insulating layer, a semiconductor layer of the thin film transistor, and (a4) forming a source conductive film on the semiconductor layer and on the gate insulating layer, and forming, by pattering the source conductive film, a plurality of source bus lines, and a source electrode and a drain electrode being in contact with the semiconductor layer to obtain a thin film transistor.

According to an embodiment, the TFT substrate further includes a gate terminal section and a transfer terminal section in the non-transmission and/or reception region, and the step (c) includes a step of forming, by patterning the patch electrode conductive film, a patch connecting section in the non-transmission and/or reception region. The method further includes steps of, after the step (d), collectively etching the gate insulating layer, the first insulating layer, and the second insulating layer to form a second opening exposing the patch connecting section in the second insulating layer and to form a gate terminal contact hole exposing a portion of the gate bus line in the gate insulating layer, the first insulating layer, and the second insulating layer; and forming a transparent conductive film on the second insulating layer and within the second opening and the gate terminal contact hole, and, by patterning the transparent conductive film, forming an upper transparent electrode being in contact with the patch connecting section within the second opening to obtain a transfer terminal section and forming a gate terminal upper connection section being in contact with the gate bus line within the gate terminal contact hole to obtain a gate terminal section.

According to an embodiment, the TFT substrate further includes a gate terminal section and a transfer terminal section in the non-transmission and/or reception region, and the step (a4) includes a step of forming, by patterning the source conductive film, a source connection wiring line in the non-transmission and/or reception region. The step (b) includes forming the first opening in the first insulating layer and forming a third opening exposing a portion of the source connection wiring line, a fourth opening exposing another portion of the source connection wiring line, and a gate terminal contact hole exposing a portion of the gate bus line. The method further include, between the step (b) and the step (c), a step of forming a transparent conductive film, and forming, by patterning the transparent conductive film, an upper transparent electrode being in contact with the source connection wiring line within the third opening, and forming a gate terminal upper connection section being in contact with the gate bus line within the gate terminal contact hole to obtain a gate terminal section. The step (c) further includes a step of forming, by patterning the patch electrode conductive film, a patch connecting section being in contact with the source connection wiring line within the fourth opening to obtain a transfer terminal section. In the transfer terminal section, the patch connecting section is electrically connected to the upper transparent electrode via the source connection wiring line. The method further includes, after the step (d), a step of forming, in the second insulating layer, an opening exposing a portion of the upper transparent electrode and a portion of the gate terminal upper connection section.

According to an embodiment, the TFT substrate further include a gate terminal section and a transfer terminal section in the non-transmission and/or reception region, and the step (b) includes a step of forming the first opening in the first insulating layer and forming a gate terminal contact hole exposing a portion of the gate bus line. The method further includes, between the step (b) and the step (c), a step of forming a transparent conductive film and forming, by patterning the transparent conductive film, a gate terminal upper connection section being in contact with the gate bus line within the gate terminal contact hole to obtain a gate terminal section. The step (c) includes a step of forming, by patterning the patch electrode conductive film, a patch connecting section in the non-transmission and/or reception region. The method further includes, between the step (c) and the step (d), a step of forming a protective conductive layer covering the patch connecting section. The method further includes, after the step (d), a step of forming, in the second insulating layer, an opening exposing a portion of the protective conductive layer and a portion of the gate terminal upper connection section.

A scanning antenna according to an embodiment of the present invention includes a scanning antenna in which a plurality of antenna units are arranged, the scanning antenna including a TFT substrate including a first dielectric substrate, a plurality of TFTs supported by the first dielectric substrate, a plurality of gate bus lines, a plurality of source bus lines, and a plurality of patch electrodes; a slot substrate including a second dielectric substrate, and a slot electrode formed on a first main surface of the second dielectric substrate; a liquid crystal layer provided between the TFT substrate and the slot substrate; a reflective conductive plate disposed opposing via a dielectric layer a second main surface opposite to the first main surface of the second dielectric substrate, wherein the slot electrode includes a plurality of slots disposed corresponding to the plurality of patch electrodes, each of the plurality of patch electrodes is connected to a drain of a corresponding TFT and is supplied with a data signal from a corresponding source bus line during a period in which the corresponding TFT is selected by a scanning signal supplied from the gate bus line of the corresponding TFT, and a frequency at which a polarity of voltage applied to each of the plurality of patch electrodes is inverted is greater than or equal to 300 Hz.

According to an embodiment, in any frame, polarities of voltage applied to the plurality of patch electrodes are all the same.

According to an embodiment, in any frame, among the polarities of voltage applied to the plurality of patch electrodes, polarities of voltage applied to the patch electrodes connected to the gate bus lines adjacent to each other are reversed to each other.

According to an embodiment, a frequency at which the polarity of voltage applied to each of the plurality of patch electrodes is inverted is less than or equal to 5 Hz.

According to an embodiment, a voltage applied to the slot electrode is an oscillating voltage having a phase shifted by 180° from the voltage applied to the plurality of patch electrodes.

A driving method of a scanning antenna according to an embodiment of the present invention includes a driving method of a scanning antenna in which a plurality of antenna units are arranged, the scanning antenna including a TFT substrate including a first dielectric substrate, a plurality of TFTs supported by the first dielectric substrate, a plurality of gate bus lines, a plurality of source bus lines, and a plurality of patch electrodes; a slot substrate including a second dielectric substrate, and a slot electrode formed on a first main surface of the second dielectric substrate; a liquid crystal layer provided between the TFT substrate and the slot substrate; and a reflective conductive plate disposed opposing via a dielectric layer a second main surface opposite to the first main surface of the second dielectric substrate; wherein the slot electrode includes a plurality of slots disposed corresponding to the plurality of patch electrodes; the driving method including inverting a polarity of voltage applied to each of the plurality of patch electrodes at a frequency of 300 Hz or greater.

According to an embodiment, a polarity of voltage applied to the slot electrode is inverted by a 180° phase shift from the polarity of voltage applied to each of the plurality of patch electrodes.

Advantageous Effects of Invention

According to an embodiment of the present invention, a scanning antenna which can be mass-produced by utilizing the existing LCD production technology, and a driving method of a scanning antenna are provided.

DESCRIPTION OF EMBODIMENTS

Hereinafter, a scanning antenna and a production method of a scanning antenna according to embodiments of the present invention will be described with reference to the drawings. In the following description, first, a structure and a production method of a known TFT-type LCD (hereinafter referred to as a "TFT-LCD") will be described. However, description of matters well-known within the technical field of LCDs may be omitted. As for basic TFT-LCD technology, refer to, for example, Liquid Crystals, Applications and Uses, Vol. 1-3 (Editor: Birenda Bahadur, Publisher: World Scientific Pub Co Inc), or the like. The contents disclosed in the above-described documents are incorporated herein by reference as their entirety.

A structure and actions of a typical transmissive TFT-LCD (hereinafter simply referred to as an "LCD") 900 will be described with reference to FIGS. 21A and 21B. Here, the LCD 900 with a vertical electrical field mode (for example, a TN mode or an orthogonal alignment mode) in which a voltage is applied in the thickness direction of a liquid crystal layer is exemplified. A frame frequency (typically, twice a polarity inversion frequency) of a voltage applied to liquid crystal capacitance of the LCD is, for example, 240 Hz even at quad speed driving, and a dielectric constant ε of the liquid crystal layer serving as a dielectric layer of the liquid crystal capacitance of the LCD is different from a dielectric constant $M_{(\varepsilon M)}$ with respect to microwaves (for example, satellite broadcasting, a Ku band (from 12 to 18 GHz), a K band (from 18 to 26 GHz), and a Ka band (from 26 to 40 GHz)).

Figure 21A:
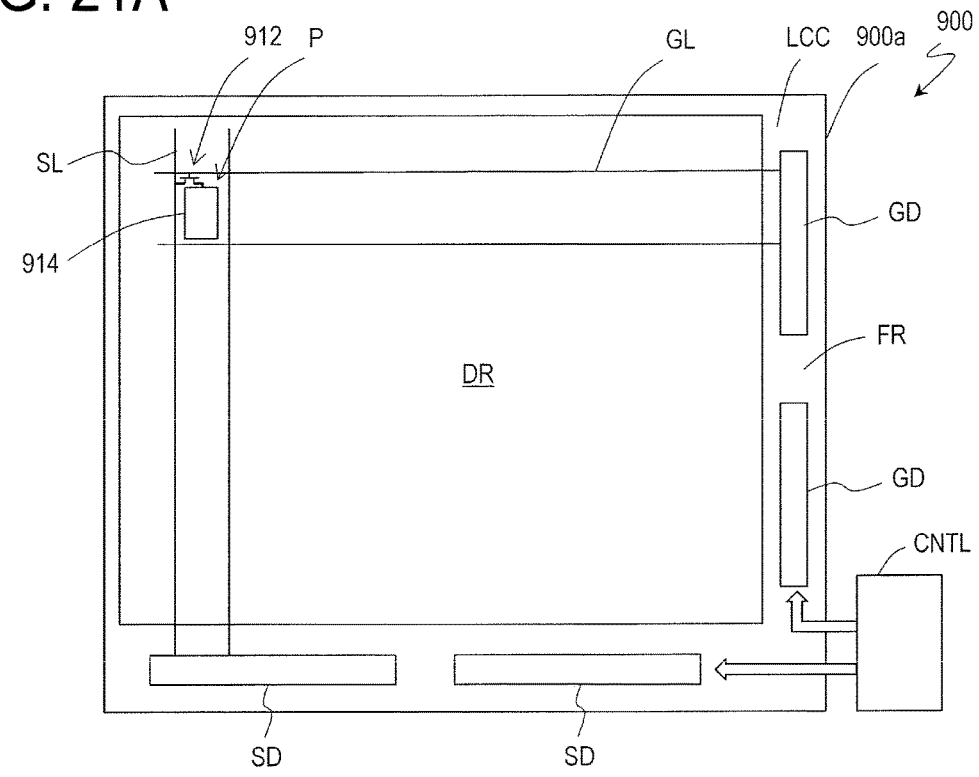
FIG. 21A is a schematic view illustrating a structure of an existing LCD 900.
Figure 21B:
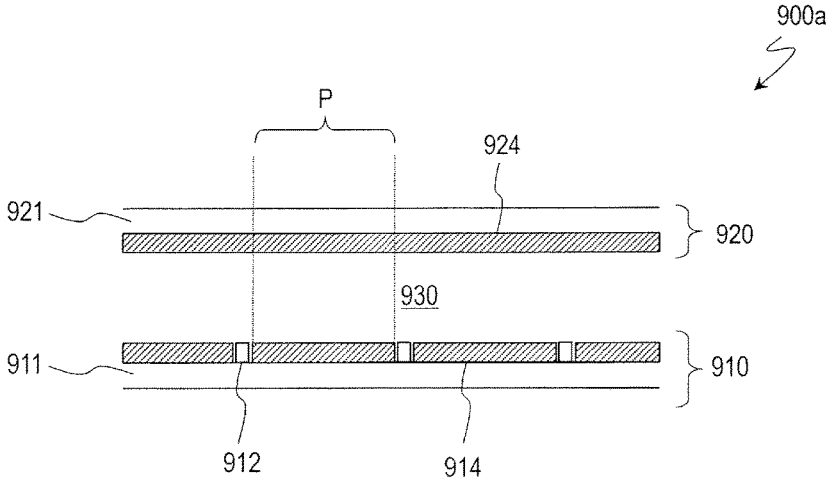
FIG. 21B is a schematic cross-sectional view of an LCD panel 900*a*.

As is schematically illustrated in FIG. 21A, the transmissive LCD 900 includes a liquid crystal display panel 900*a*, a control circuit CNTL, a backlight (not illustrated), a power source circuit (not illustrated), and the like. The liquid crystal display panel 900*a* includes a liquid crystal display cell LCC and a drive circuit including a gate driver GD and a source driver SD. The drive circuit may be mounted on, for example, a TFT substrate 910 of the liquid crystal display cell LCC, or all or a portion of the drive circuit may be integrated (monolithic integration) with the TFT substrate 910, FIG. 21B is a schematic cross-sectional view of a liquid crystal display panel (hereinafter referred to as an "LCD panel") 900*a* incorporated in the LCD 900. The LCD panel 900*a* includes the TFT substrate 910, a counter substrate 920, and a liquid crystal layer 930 provided between the TFT substrate 910 and the counter substrate 920. The TFT substrate 910 and the counter substrate 920 includes transparent substrates 911 and 921 such as glass substrates, respectively. In addition to glass substrates, plastic substrates may also be used as the transparent substrates 911 and 921. The plastic substrates are formed of, for example, a transparent resin (for example, polyester) and glass fiber (for example, nonwoven fabric).

A display region DR of the LCD panel 900*a* includes pixels P arranged in a matrix. A frame region FR that does not contribute to display is formed around the display region DR. A liquid crystal material is sealed in the display region DR by a sealing portion (not illustrated) formed surrounding the display region DR. The sealing portion is formed by curing a sealing material including, for example, an ultraviolet curable resin and a spacer (for example resin heads). The sealing portion causes the TFT substrate 910 and the counter substrate 920 to adhere to each other and fixes TFT substrate 910 and the counter substrate 920 to each other. The spacer in the sealing material controls a gap between the TFT substrate 910 and the counter substrate 920, that is, the thickness of the liquid crystal layer 930, to be constant. To suppress in-plane variation in the thickness of the liquid crystal layer 930, a columnar spacer is formed on a light blocking portion (for example, on a wiring line) in the display region DR by using an ultraviolet curable resin. In recent years, as seen in an LCD panel for a liquid crystal television or a smart phone, the width of the frame region FR that does not contribute to display is significantly reduced.

In the TFT substrate 910, a TFT 912, a gate bus line (scanning line) GL, a source bus line (display signal line) SL, a pixel electrode 914, an auxiliary capacitance electrode (not illustrated), and a CS bus line (auxiliary capacitance line) (not illustrated) are formed on the transparent substrate 911. The CS bus line is provided parallel to the gate bus line. Alternatively, the gate bus line in the next stage may be used as the CS bus line (CS on-gate structure).

The pixel electrode 914 is covered with an alignment film (for example, a polyimide film) configured to control alignment of liquid crystals. The alignment film is provided to come into contact with the liquid crystal layer 930. The TFT substrate 910 is often disposed on the backlight side (side opposite to a viewer).

The counter substrate 920 is often disposed on the viewer side of the liquid crystal layer 930. The counter substrate 920 includes a color filter layer (not illustrated), a counter electrode 924, and an alignment film (not illustrated) on the transparent substrate 921. Since the counter electrode 924 is provided in common to the plurality of pixels P constituting the display region DR, the counter electrode 924 is also referred to as a common electrode. The color filter layer includes a color filter (for example, a red filter, a green filter, and a blue filter) provided for each pixel P, and a black matrix (light shielding layer) for blocking light unnecessary for display. The black matrix is disposed, for example, to block light between the pixels P in the display region DR and at the frame region FR.

The pixel electrode 914 of the TFT substrate 910, the counter electrode 924 of the counter substrate 920, and the liquid crystal layer 930 between the pixel electrode 914 and the counter electrode 924 constitute liquid crystal capacitance Clc. Individual liquid crystal capacitance corresponds to a pixel. To retain a voltage applied to the liquid crystal capacitance Clc (to increase a so-called voltage retention rate), auxiliary capacitance CS electrically connected in parallel to the liquid crystal capacitance Clc is formed. The auxiliary capacitance CS typically includes an electrode having the same potential as a potential of the pixel electrode 914, an inorganic insulating layer (for example, a gate insulating layer ($SiO_2$ layer)), and an auxiliary capacitance electrode connected to the CS bus line. Typically, the same common voltage as a voltage of the counter electrode 924 is supplied from the CS bus line.

Factors responsible for decreasing a voltage (effective voltage) applied to the liquid crystal capacitance Clc are (1) those based on a CR time constant which is a product of a capacitance value $C_{Clc}$ of the liquid crystal capacitance Clc and a resistance value R, and (2) interfacial polarization due to ionic impurities contained in a liquid crystal material and/or orientation polarization of liquid crystal molecules. Among these, the contribution by the CR time constant of the liquid crystal capacitance Clc is large, and the CR time constant can be increased by providing the auxiliary capacitance CS electrically connected in parallel to the liquid crystal capacitance Clc. Note that volume resistivity of the liquid crystal layer 930 serving as a dielectric layer of the liquid crystal capacitance Clc exceeds the order of $10^{12}$ Ω·cm in the case of a nematic liquid crystal material used widely.

A display signal supplied to the pixel electrode 914 is a display signal supplied to the source bus line SL connected to the TFT 912 when the TFT 912 selected by a scanning signal supplied from the gate driver GD to the gate bus line GL is turned on. Accordingly, TFTs 912 connected to certain gate bus lines GL are simultaneously turned on, and at that time, corresponding display signals are supplied from source bus lines SL connected to the respective TFTs 912 of the pixels P in that row. This action is sequentially performed from the first row (for example, an uppermost row on a display surface) to the mth row (for example, a lowermost row on a display surface). As a result, one image (frame) is written in the display region DR including m rows of the pixels and the image is displayed. Assuming that the pixels P are arranged in a matrix of m rows and n columns, at least n source bus lines SL are provided in total such that at least one source bus line SL is provided corresponding to each pixel column.

Such scanning is referred to as line-sequential scanning. Time after one pixel row is selected until the next pixel row is selected is referred to as a horizontal scanning period, (1H), and time after a certain row is selected until the row is again selected is referred to as a vertical scanning period, (1V), or a frame. Note that, in general, 1V (or 1 frame) is obtained by adding a blanking period to a period m·H during which all m pixel rows are selected.

For example, when an input video signal is an NTSC signal, 1V (=1 frame) of an existing LCD panel is 1/60 of a second (16.7 milliseconds). The NTSC signal is an interlaced signal and has a frame frequency of 30 Hz and a field frequency of 60 However, in an LCD panel, since it is necessary to supply a display signal to all the pixels in each field, the LCD panel is driven at 1V=(1/60) seconds (driven at 60 Hz). Note that, in recent years, to improve video display characteristics, there are also an LCD panel driven at double speed drive (120 Hz drive, 1V=(1/120) seconds), and an LCD panel driven at quad speed (240 Hz drive, 1V=(1/240) seconds) for 3D display.

When a DC voltage is applied to the liquid crystal layer 930, the effective voltage decreases and luminance of the pixel P decreases. Since the interface polarization and/or the orientation polarization described above contribute to the decrease in the effective voltage, it is difficult to completely prevent the decrease in the effective voltage even when the auxiliary capacitance CS is provided. For example, when a display signal corresponding to a certain intermediate gray scale is written into all the pixels for each frame, luminance fluctuates for each frame and is observed as flicker. Furthermore, when a DC voltage is applied to the liquid crystal layer 930 for an extended period of time, electrolysis of the liquid crystal material may occur. Furthermore, impurity ions segregate in the electrode located at one side, and the effective voltage may not be applied to the liquid crystal layer and the liquid crystal molecules may not move. To prevent these, the LCD panel 900*a* is subjected to so-called AC driving. Typically, frame-reversal driving is performed such that a polarity of a display signal is inverted for each frame (for each vertical scanning period). For example, in an existing LCD panel, polarity inversion is performed every 1/60 seconds (a polarity inversion period is 30 Hz).

Furthermore, dot inversion driving, line reversal driving, or the like is performed to uniformly distribute the pixels having different polarities of applied voltage even within one frame. This is because it is difficult to completely match a positive polarity and a negative polarity in a magnitude of the effective voltage applied to the liquid crystal layer. For example, in a case where volume resistivity of the liquid crystal material exceeds the order of $10^{12}$ Ω·cm, flicker is hardly viewed by performing dot inversion or line reversal driving every 1/60 seconds.

The gate driver GD and the source driver SD supply the scanning signal and the display signal in the LCD panel 900*a* to the gate bus line GL and the source bus line SL, respectively, on the basis of signals supplied from a control circuit CNTL to the gate driver GD and the source driver SD. For example, the gate driver GD and the source driver SD are each connected to corresponding terminals provided on the TFT substrate 910. The gate driver GD and the source driver SD may be mounted on the frame region FR of the TFT substrate 910 as a driver IC, for example, or may be formed monolithically in the frame region FR of the TFT substrate 910.

The counter electrode 924 of the counter substrate 920 is electrically connected to a terminal (not illustrated) of the TFT substrate 910 via a conductive portion (not illustrated) referred to as a transfer. The transfer is formed, for example, to overlap with the sealing portion, or to impart conductivity to a portion of the sealing portion. This is done to narrow the frame region FR. A common voltage is directly or indirectly supplied from the control circuit CNTL to the counter electrode 924. Typically, the common voltage is also supplied to the CS bus line as described above.

Basic Structure of Scanning Antenna

A scanning antenna using an antenna unit utilizing anisotropy (birefringence index) of a large dielectric constant $M_{(\varepsilon M)}$ of a liquid crystal material controls a voltage applied to each liquid crystal layer of an antenna unit corresponding to a pixel of an LCD panel and changes the effective dielectric constant $M_{(\varepsilon M)}$ of the liquid crystal layer of each antenna unit. As a result, the scanning antenna forms a two-dimensional pattern by antenna units having different electrostatic capacitance (corresponding to displaying of an image by an LCD). An electromagnetic wave (for example, a microwave) emitted from an antenna or received by an antenna is given a phase difference depending on the electrostatic capacitance of each antenna unit and gains strong directivity in a particular direction depending on the two-dimensional pattern formed by the antenna units having different electrostatic capacitance (beam scanning). For example, an electromagnetic wave emitted from an antenna is obtained by integrating, in consideration of the phase difference given by each antenna unit, a spherical wave obtained as a result of an input electromagnetic wave entering each antenna unit and being scattered by each antenna unit. Each antenna unit can also be considered to function as a "phase shifter." As for a basic structure and action principles of a scanning antenna using a liquid crystal material, refer to PTL 1 to PTL 4 and NPL 1 and NPL 2. NPL 2 discloses a basic structure of a scanning antenna in which spiral slots are arranged. All the contents disclosed in PTL 1 to PTL 4 and NPL 1 and NPL 2 are incorporated herein by reference as their entirety.

Figure 1:
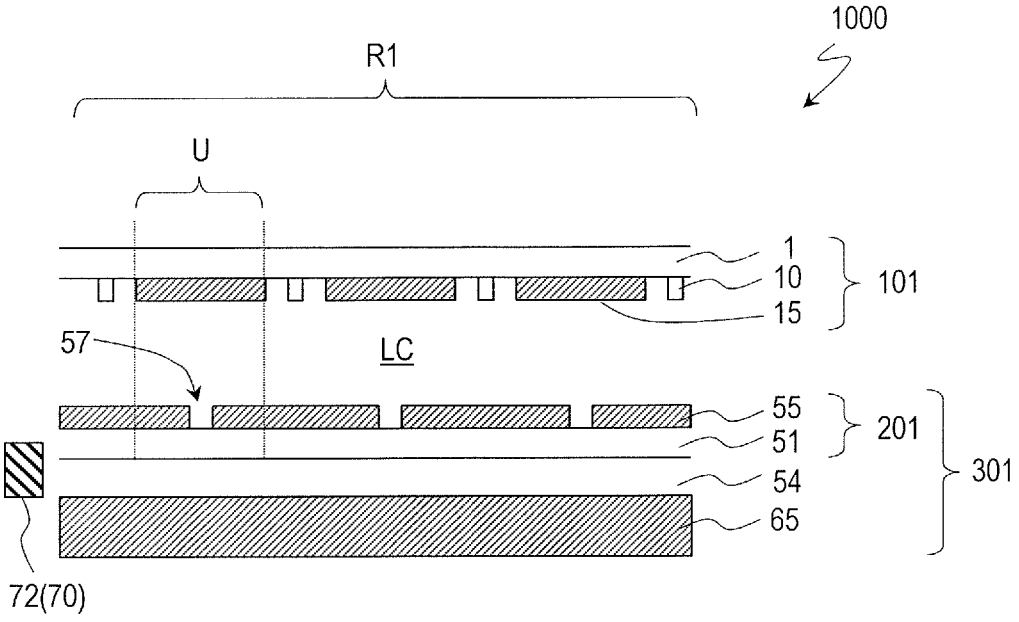
FIG. 1 is a cross-sectional view schematically illustrating a portion of a scanning antenna 1000 according to a first embodiment.

Note that although antenna units in a scanning antenna according to an embodiment of the present invention are similar to the pixels of the LCD panel, the antenna units are different from the pixels of the LCD panel in a structure, and arrangement of the plurality of antenna units is also different from the arrangement of the pixels in the LCD panel. A basic structure of the scanning antenna according to an embodiment of the present invention will be described with reference to FIG. 1 illustrating a scanning antenna 1000 of a first embodiment described in detail below. Although the scanning antenna 1000 is a radial in-line slot antenna in which slots are concentrically arranged, the scanning antenna according to an embodiment of the present invention is not limited to the radial in-line slot antenna. For example, various kinds of known arrangement of slots may be used for the arrangement of the slots.

FIG. 1 is a cross-sectional view schematically illustrating a portion of the scanning antenna 1000 of the present embodiment, and schematically illustrates a portion of a cross-section along the radial direction from a power supply pin 72 (see FIG. 2B) provided near the center of the slots arranged concentrically.

The scanning antenna 1000 includes a TFT substrate 101, a slot substrate 201, a liquid crystal layer LC provided between the TFT substrate 101 and the slot substrate 201, and a reflective conductive plate 65 disposed opposing the slot substrate 201 via an air layer 54. The scanning antenna 1000 transmits and/or receives microwaves from the TFT substrate 101 side.

The TFT substrate 101 includes a dielectric substrate 1 such as a glass substrate, and a plurality of patch electrodes 15 and a plurality of TFTs 10 formed on the dielectric substrate 1. Each patch electrode 15 is connected to a corresponding TFT 10. Each TFT 10 is connected to a gate bus line and a source bus line.

The slot substrate 201 includes a dielectric substrate 51 such as a glass substrate and a slot electrode 55 formed on the liquid crystal layer LC side of the dielectric substrate 51. The slot electrode 55 includes a plurality of slots 57.

The reflective conductive plate 65 is disposed opposing the slot substrate 201 via the air layer 54. In place of the air layer 54, a layer formed of a dielectric (for example, a fluorine resin such as PTFE) having a small dielectric constant M with respect to microwaves can be used. The slot electrode 55, the reflective conductive plate 65, and the dielectric substrate 51 and the air layer 54 between the slot electrode 55 and the reflective conductive plate 65 function as a waveguide 301.

Figure 17:
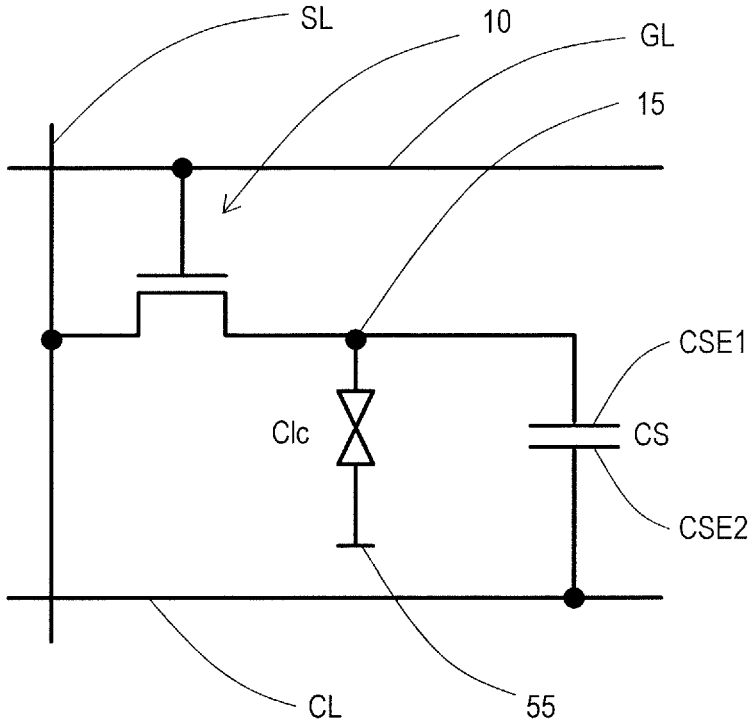
FIG. 17 is a diagram illustrating an equivalent circuit of one antenna unit of a scanning antenna according to an embodiment of the present invention.

The patch electrode 15, a portion including the slot 57 of the slot electrode 55, and the liquid crystal layer LC between the patch electrode 15 and the portion including the slot 57 constitute an antenna unit U. In each antenna unit U, one patch electrode 15 opposes via the liquid crystal layer LC a portion including one slot 57 of the slot electrode 55 and constitutes liquid crystal capacitance. The structure in which the patch electrode 15 and the slot electrode 55 oppose each other via the liquid crystal layer LC is similar to the structure illustrated in FIGS. 21A and 21B in which the pixel electrode 914 and the counter electrode 924 of the LCD panel 900*a* oppose each other via the liquid crystal layer 930. That is, the antenna unit U of the scanning antenna 1000 and the pixel P of the LCD panel 900*a* are similar in a configuration. Furthermore, the antenna unit includes a configuration similar to the configuration of the pixel P in the LCD panel 900*a* in that the antenna unit includes auxiliary capacitance electrically connected in parallel to the liquid crystal capacitance (see FIGS. 14A and 17). However, the scanning antenna 1000 has many differences from the LCD panel 900*a*.

First, performance required of the dielectric substrates 1 and 51 of the scanning antenna 1000 is different from performance required of the substrate of the LCD panel.

Generally, a substrate transparent to visible light is used for an LCD panel. For example, a glass substrate or a plastic substrate is used. In a reflective LCD panel, since the substrate on the back side does not need transparency, a semiconductor substrate may be used. In contrast to this, the dielectric substrates 1 and 51 used for an antenna preferably each have a small dielectric loss with respect to microwaves (where a dielectric tangent with respect to microwaves is denoted with tan $\delta_M$). The tan $\delta_M$ of each of the dielectric substrates 1 and 51 is preferably approximately less than or equal to 0.03, and more preferably less than or equal to 0.01. Specifically, a glass substrate or a plastic substrate can be used. A glass substrate is more excellent than a plastic substrate in dimensional stability and heat resistance and is suitable for forming a circuit element such as a TFT, a wiring line and an electrode by using LCD technology. For example, in a case where materials forming the waveguide are air and glass, from the viewpoint that the dielectric loss of glass is greater and for this reason thinner glass can reduce a waveguide loss, the glass preferably has a thickness of less than or equal to 400 μm, and more preferably less than or equal to 300 μm. There is no particular lower limit, as long as the glass can be handled without breaking in a production process.

A conductive material used for the electrode is also different. In many cases, an ITO film is used as a transparent conductive film for a pixel electrode and a counter electrode of an LCD panel. However, ITO has a large tan $\delta_M$ with respect to microwaves and cannot be used as a conductive layer in an antenna. The slot electrode 55 functions as a wall of the waveguide 301 together with the reflective conductive plate 65. Accordingly, to suppress transmission of microwaves in the wall of the waveguide 301, the wall of the waveguide 301, that is, a metal layer (Cu layer or Al layer) preferably has a large thickness. It is known that in a case where the metal layer has the thickness three times the skin depth, electromagnetic waves are attenuated to 1/20 (−26 dB), and in a case where the metal layer has the thickness five times the skin depth, electromagnetic waves are attenuated to about 1/150 (−43 dB). Accordingly, in a case where the metal layer has the thickness five times the skin depth, electromagnetic wave transmittance can reduce to 1%. For example, as for a microwave of 10 GHz, in a case where a Cu layer having a thickness of greater than or equal to 3.3 μm and an Al layer having a thickness of greater than or equal to 4.0 μm are used, microwaves can reduce to 1/150. Furthermore, as for a microwave of 30 GHz, in a case where a Cu layer having a thickness of greater than or equal to 1.9 μm and an Al layer having a thickness of greater than or equal to 2.3 μm are used, microwaves can reduce to 1/150. Thus, the slot electrode 55 is preferably formed of a Cu layer or an Al layer having a thickness relatively large. There is no particular upper limit for the thickness of a Cu layer or an Al layer, and the thicknesses can be set appropriately in consideration of the tune and cost of film formation. In the case of using a Cu layer, there is such an advantage that a Cu layer having a thickness smaller than the thickness of an Al layer can be used. A Cu layer or an Al layer having a thickness relatively large can be formed not only by a thin film deposition method used in an LCD production process, but also by other methods such as bonding Cu foil or Au foil to a substrate. The thickness of the metal layer is, for example, greater than or equal to 2 μm and less than or equal to 30 μm. When the thin film deposition method is used to form the metal layer, the thickness of the metal layer is preferably less than or equal to 5 μm. Note that an aluminum plate, a copper plate or the like having a thickness of several mm can be used as the reflective conductive plate 65, for example.

Since the patch electrode 15 does not constitute the waveguide 301 unlike the slot electrode 55, a Cu layer or an Al layer having a thickness smaller than the thickness of the slot electrode 55 can be used. However, the patch electrode 15 preferably has low resistance to avoid a loss converted into heat when oscillation of free electrons near the slot 57 of the slot electrode 55 induces oscillation of free electrons in the patch electrode 15. From the viewpoint of mass production, an Al layer rather than a Cu layer is preferably used, and the thickness of an Al layer preferably ranges from 0.5 μm to 2 μm, for example.

Furthermore, an arrangement pitch of the antenna units U is considerably different from the pixel pitch. For example, as for an antenna for microwaves of 12 GHz (Ku band), a wavelength λ is 25 mm, for example. Then, as described in PTL 4, since the pitch of the antenna unit U is less than or equal to λ/4 and/or less than or equal to λ/5, the arrangement pitch becomes less than or equal to 6.25 mm and/or less than or equal to 5 mm. This arrangement pitch is ten times greater than the pixel pitch of the LCD panel. Accordingly, the length and the width of the antenna unit U are also roughly ten times greater than the pixel length and width of the LCD panel.

Of course, the arrangement of the antenna units U may be different from the arrangement of the pixels in the LCD panel. Although the example in which the antenna units U are arranged in concentric circles (for example, refer to JP 2002-217640 A) is described here, the arrangement of the antenna units U is not limited to this example, and the antenna units may be arranged in a spiral shape as described in NPL 2, for example. Further, the antenna units may be arranged in a matrix as described in PTL 4.

Characteristics required of the liquid crystal material of the liquid crystal layer LC of the scanning antenna 1000 are different from characteristics required of the liquid crystal material of the LCD panel. In the LCD panel, a change in a refractive index of the liquid crystal layer of the pixels gives a phase difference to polarized visible light (wavelength of 380 nm to 830 nm), and as a result, changes a polarization state (for example, a change in a refractive index rotates the polarization axis direction of linearly polarized light, or changes a degree of circular polarization of circularly polarized light). As a result, the LCD panel performs display. In contrast, in the scanning antenna 1000 according to the embodiment, a phase of microwaves excited (re-radiated) from each patch electrode is changed by changing an electrostatic capacitance value of the liquid crystal capacitance of the antenna unit U. Accordingly, the liquid crystal layer preferably has large anisotropy ($\Delta_{\varepsilon M}$) of the dielectric constant $M_{(\varepsilon M)}$ with respect to microwaves, and the tan $\delta_M$ is preferably small. For example, the $\Delta_{\varepsilon M}$ of greater than or equal to 4 and the tan $\delta_M$ of less than or equal to 0.02 (values of 19 GHz in both cases) described in M. Witteck et al., SID 2015 DIGEST pp. 824-826 can be used suitably. In addition, a liquid crystal material having the $\Delta_{\varepsilon M}$ of greater than or equal to 0.4 and the tan $\delta_M$ of less than or equal to 0.04 as described in Kuki, POLYMERS 55 vol. August issue pp. 599-602 (2006) can be used.

In general, a dielectric constant of a liquid crystal material has frequency dispersion, but the dielectric anisotropy $\Delta_{\varepsilon M}$ with respect to microwaves has a positive correlation with refractive index anisotropy Δn with respect to visible light. Accordingly, it can be said that a material having a large refractive index anisotropy Δn with respect to visible light is preferable as a liquid crystal material for an antenna unit with respect to microwaves. The refractive index anisotropy Δn of the liquid crystal material for an LCD is evaluated by refractive index anisotropy with respect to light having a wavelength of 550 nm. Here again, when the Δn (birefringence index) with respect to light having a wavelength of 550 nm is used as an index, a nematic liquid crystal having the Δn of greater than or equal to 0.3, preferably greater than or equal to 0.4 can be used for an antenna unit with respect to microwaves. The Δn has no particular upper limit. However, since a liquid crystal material having a large Δn tends to have a strong polarity, there is a possibility that reliability decrease. From the viewpoint of reliability, the Δn is preferably less than or equal to 0.4. The thickness of the liquid crystal layer may, for example, range from 1 μm to 500 μm.

Hereinafter, structures and production methods of scanning antennas according to embodiments of the present invention will be described in more detail.

First Embodiment

First, a first embodiment will be described with reference to FIG. 1 and FIGS. 2A and 2B. FIG. 1 is a schematic partial cross-sectional view of a portion at or near the center of the scanning antenna 1000 as described above, and FIG. 2A and FIG. 2B are schematic plan views illustrating the TFT substrate 101 and the slot substrate 201 in the scanning antenna 1000, respectively.

The scanning antenna 1000 includes a plurality of the antenna units U arranged two-dimensionally. In the scanning antenna 1000 exemplified here, the plurality of antenna units are arranged concentrically. In the following description, a region of the TFT substrate 101 and a region of the slot substrate 201 corresponding to the antenna units U will be referred to as "antenna unit regions," and will be denoted with the same reference sign U as the reference sign of the antenna units. Furthermore, as illustrated in FIG. 2A and FIG. 2B, in the TFT substrate 101 and the slot substrate 201, a region defined by the plurality of antenna unit regions two-dimensionally arranged is referred to as a "transmission and/or reception region R1," and a region other than the transmission and/or reception region R1 is referred to as a "non-transmission and/or reception region R2." A terminal unit, a drive circuit, and the like are provided in the non-transmission and/or reception region R2.

Figure 2A:
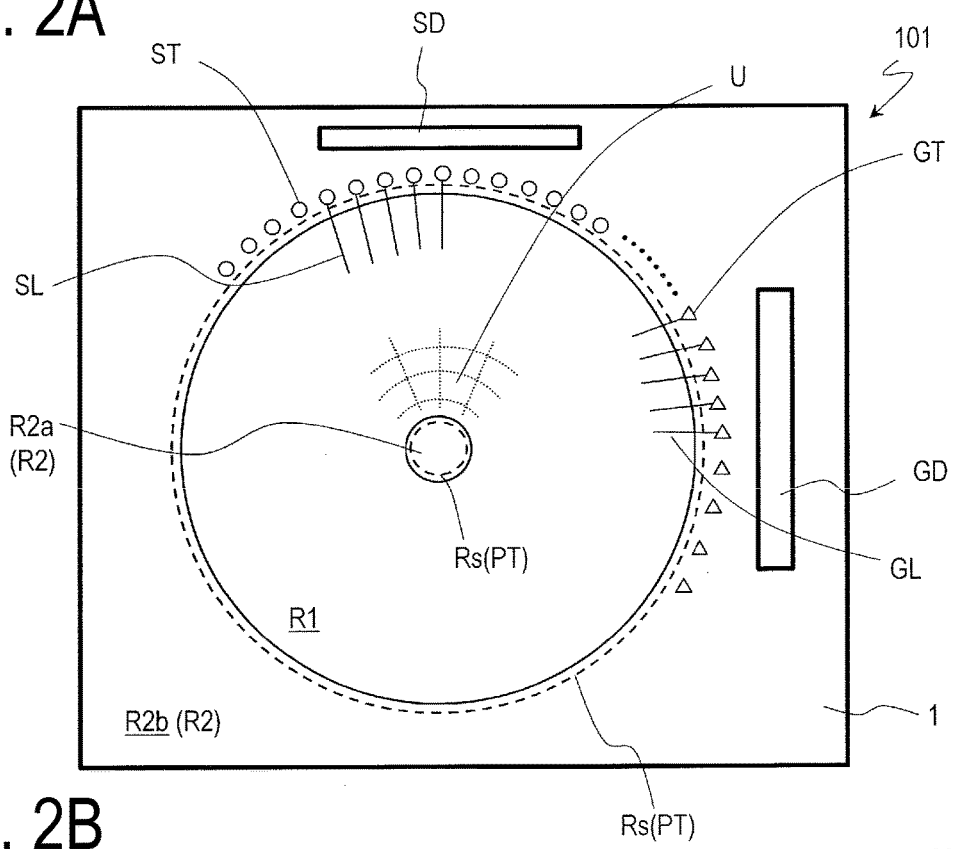
FIG. 2A and FIG. 2B are schematic plan views illustrating a TFT substrate 101 and a slot substrate 201 in the scanning antenna 1000, respectively.

FIG. 2A is a schematic plan view illustrating the TFT substrate 101 in the scanning antenna 1000.

In the example illustrated in the drawings, the transmission and/or reception region R1 has a donut-shape as viewed from the normal direction of the TFT substrate 101. The non-transmission and/or reception region R2 includes a first non-transmission and/or reception region R2*a* located at a central portion of the transmission and/or reception region R1 and a second non-transmission and/or reception region R2*b* located at a peripheral portion of the transmission and/or reception region R1. An outer diameter of the transmission and/or reception region R1 ranges, for example, from 200 mm to 1500 mm, and is set according to a data traffic volume or the like.

A plurality of the gate bus lines GL and a plurality of the source bus lines SL, supported by the dielectric substrate 1 are provided in the transmission and/or reception region R1 of the TFT substrate 101, and the antenna unit region U is defined by these wiring lines. The antenna unit regions U is, for example, arranged concentrically in the transmission and/or reception region R1 Each of the antenna unit regions U includes a TFT and a patch electrode electrically connected to the TFT. A source electrode of the TFT is electrically connected to the source bus line SL, and a gate electrode is electrically connected to the gate bus line GL. Furthermore, the drain electrode is electrically connected to the patch electrode.

In the non-transmission and/or reception region R2 (R2*a*, R2*b*), a seal region Rs is disposed surrounding the transmission and/or reception region R1. A sealing material (not illustrated) is applied to the seal region Rs. The sealing material causes the TFT substrate 101 and the slot substrate 201 to adhere to each other, and also encloses liquid crystals between these substrates 101, 201.

A gate terminal section GT, a gate driver GD, a source terminal section ST, and a source driver SD are provided outside the seal region Rs in the non-transmission and/or reception region R2. Each of the gate bus lines GL is connected to the gate driver GD via the gate terminal GT. Each of the source bus lines SL is connected to the source driver SD via the source terminal section ST. Note that, in this example, although the source driver SD and the gate driver GD are formed on the dielectric substrate 1, one or both of these drivers may be provided on another dielectric substrate.

Furthermore, a plurality of transfer terminal sections PT are provided in the non-transmission and/or reception region R2. Each of the plurality of transfer terminal sections PT is electrically connected to the slot electrode 55 (FIG. 2B) of the slot substrate 201. Herein, a connection section between the transfer terminal section PT and the slot electrode 55 is referred to as a "transfer section." As illustrated in the drawings, the transfer terminal section PT (transfer section) may be disposed in the seal region Rs. In this case, a resin containing conductive particles may be used as the sealing material. As a result, liquid crystals are enclosed between the TFT substrate 101 and the slot substrate 201, and electrical connection between the transfer terminal section PT and the slot electrode 55 of the slot substrate 201 can be secured. In this example, although the transfer terminal section PT is disposed in each of the first non-transmission and/or reception region R2*a* and the second non-transmission and/or reception region R2*b*, the transfer terminal section PT may be disposed in only any one of the first non-transmission and/or reception region R2*a* and the second non-transmission and/or reception region.

Note that the transfer terminal section PT (transfer section) may not be disposed in the seal region Rs. For example, the transfer terminal section PT may be disposed outside the seal region Rs in the non-transmission and/or reception region R2.

Figure 2B:
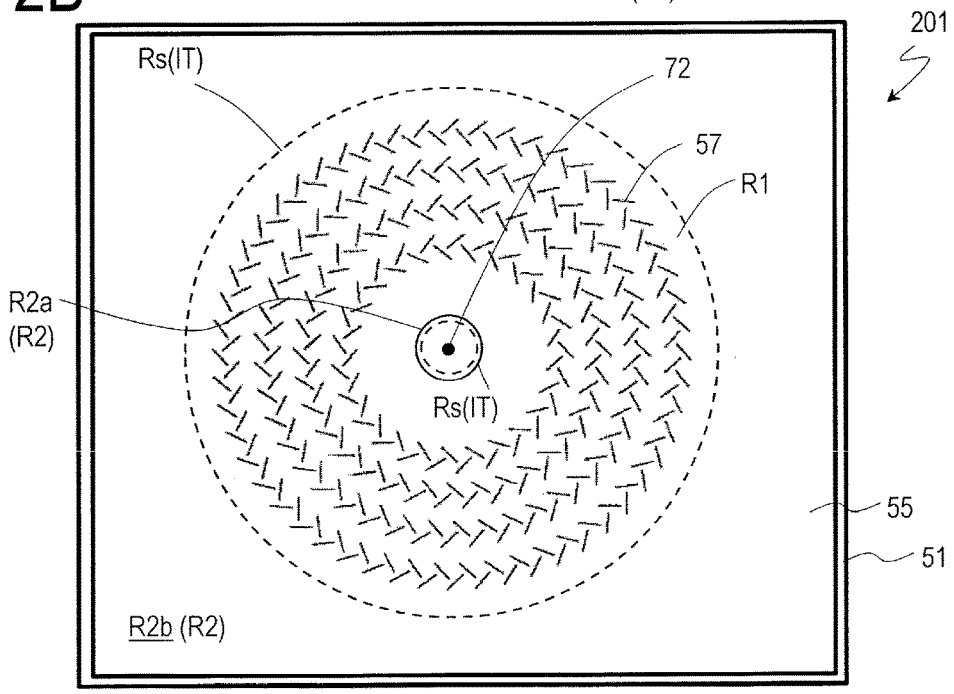

FIG. 2B is a schematic plan view illustrating the slot substrate 201 in the scanning antenna 1000 and illustrates a surface of the slot substrate 201 closer to the liquid crystal layer LC.

In the slot substrate 201, the slot electrode 55 is formed on the dielectric substrate 51 and is formed across the transmission and/or reception region R1 and the non-transmission and/or reception region R2.

In the transmission and/or reception region R1 of the slot substrate 201, the plurality of slots 57 are disposed in the slot electrode 55. The slots 57 are disposed corresponding to the antenna unit regions U on the TFT substrate 101. In the example illustrated in the drawings, the plurality of slots 57 are arranged such that a pair of the slots 57 extending in the directions substantially orthogonal to each other are concentrically disposed to constitute a radial inline slot antenna. Since the slots are disposed substantially orthogonal to each other, the scanning antenna 1000 can transmit and receive circularly polarized waves.

A plurality of terminal sections IT of the slot electrode 55 are provided in the non-transmission and/or reception region R2. The terminal sections IT are electrically connected to the transfer terminal sections PT (FIG. 2A) of the TFT substrate 101. In this example, the terminal sections IT are disposed within the seal region Rs and are electrically connected to the corresponding transfer terminal sections PT by a sealing material containing conductive particles.

Furthermore, the power supply pin 72 is disposed on the rear surface side of the slot substrate 201 in the first non-transmission and/or reception region R2*a*. Microwaves are inserted by the power supply pin 72 into the waveguide 301 including the slot electrode 55, the reflective conductive plate 65, and the dielectric substrate 51. The power supply pin 72 is connected to a power supply device 70. Power supply is performed from the center of a concentric circle in which the slots 57 are arranged. A power supply method may be any of a direct coupling power supply method and an electromagnetic coupling method, and a known power supply structure can be adopted.

Each component of the scanning antenna 1000 will be described in detail below with reference to the drawings.

Structure of TFT Substrate 101

Antenna Unit Region U

Figure 3A:
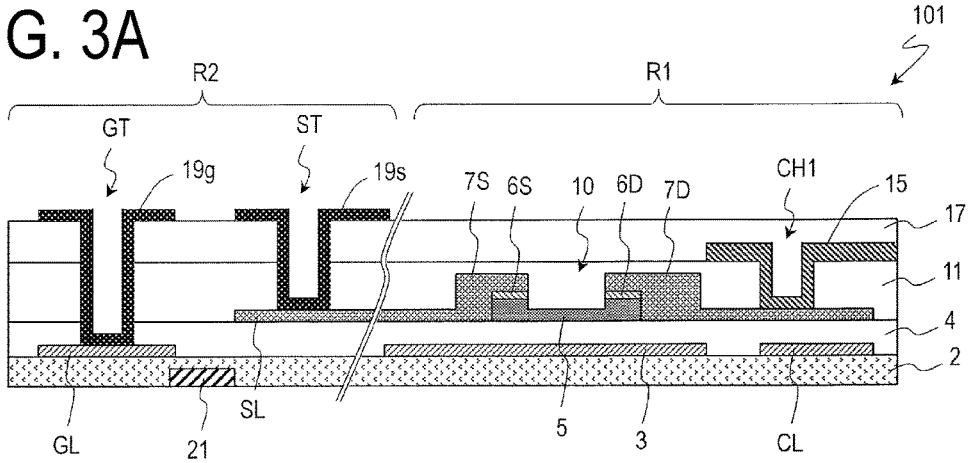
FIG. 3A and FIG. 3B are a cross-sectional view and a plane view schematically, illustrating an antenna unit region U of the TFT substrate 101, respectively.
Figure 3B:
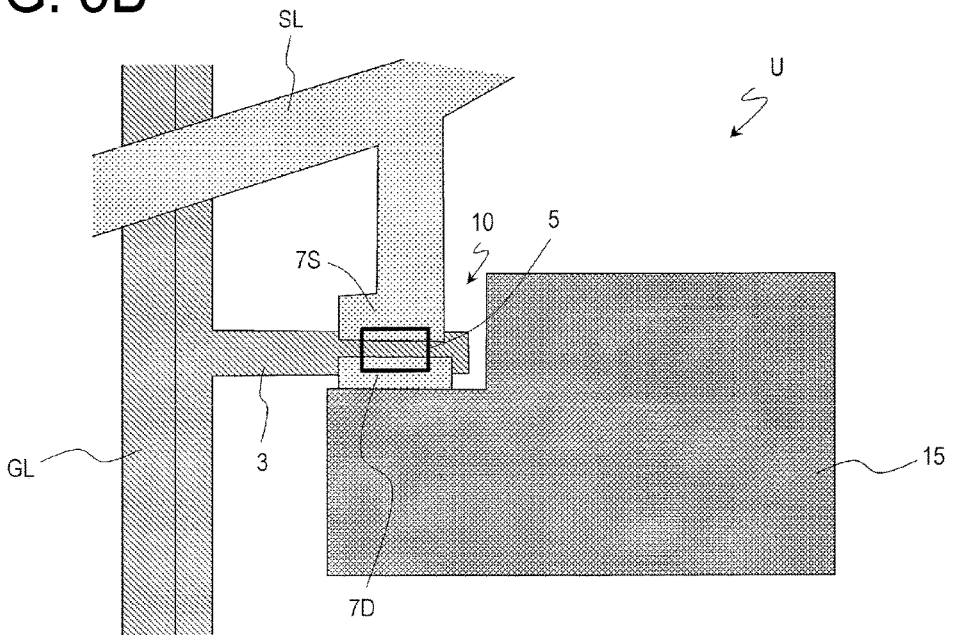

FIG. 3A and FIG. 3B are a cross-sectional view and a plane view schematically illustrating the antenna unit region U of the TFT substrate 101, respectively.

Each of the antenna unit regions U includes a dielectric substrate (not illustrated), the TFT 10 supported by the dielectric substrate, a first insulating layer 11 covering the TFT 10, the patch electrode 15 formed on the first insulating layer 11 and electrically connected to the TFT 10, and a second insulating layer 17 covering the patch electrode 15. The TFT 10 is disposed, for example, at or near an intersection of the gate bus line GL and the source bus line SL.

The TFT 10 includes a gate electrode 3, a semiconductor layer 5 having an island shape, a gate insulating layer 4 disposed between the gate electrode 3 and the semiconductor layer 5, a source electrode 7S, and a drain electrode 7D. A structure of the TFT 10 is not particularly limited. In this example, the TFT 10 is a channel etch-type TFT including a bottom gate structure.

The gate electrode 3 is electrically connected to the gate bus line GL, and a scanning signal is supplied from the gate bus line GL. The source electrode 7S is electrically connected to the source bus line SL, and a data signal is supplied from the source bus line SL. The gate electrode 3 and the gate bus line GL may be formed of the same conductive film (gate conductive film). The source electrode 7S, the drain electrode 7D, and the source bus line SL may be formed of the same conductive film (source conductive film). The gate conductive film and the source conductive film are, for example, metal films. Herein, a layer formed by using the gate conductive film may be referred to as a "gate metal layer," and a layer formed by using the source conductive film may be referred to as a "source metal layer."

The semiconductor layer 5 is disposed overlapping with the gate electrode 3 via the gate insulating layer 4. In the example illustrated in the drawings, a source contact layer 6S and a drain contact layer 6D are formed on the semiconductor layer 5. The source contact layer 6S and the drain contact layer 6D are disposed on both sides of a region where a channel is formed in the semiconductor layer 5 (channel region), respectively. The semiconductor layer 5 may be an intrinsic amorphous silicon (i-a-Si) layer, and the source contact layer 6S and the drain contact layer 6D may be $n^+$ type amorphous silicon ($n^+$a-Si) layers.

The source electrode 7S is provided to come into contact with the source contact layer 6S and is connected to the semiconductor layer 5 via the source contact layer 6S. The drain electrode 7D is provided to come into contact with the drain contact layer 6D and is connected to the semiconductor layer 5 via the drain contact layer GD.

The first insulating layer 11 includes a contact hole CH1 reaching the drain electrode 7D of the TFT 10.

The patch electrode 15 is provided on the first insulating layer 11 and within the contact hole CH1 and is in contact with the drain electrode 7D within the contact hole CH1. The patch electrode 15 includes a metal layer. The patch electrode 15 may be a metal electrode formed of a metal layer alone. A material of the patch electrode 15 may be the same as the materials of the source electrode 7S and the drain electrode 7D. However, the thickness of the metal layer in the patch electrode 15 (the thickness of the patch electrode 15 when the patch electrode 15 is a metal electrode) is set to be greater than the thickness of each of the source electrode 7S and the drain electrode 7D. The thickness of the metal layer in the patch electrode 15 is set to be, for example, greater than or equal to 0.5 μm when the metal layer is formed of an Al layer.

A CS bus line CL may be provided by using the same conductive film as a conductive film of the gate bus line GL. The CS bus line CL may be disposed overlapping via the gate insulating layer 4 with the drain electrode (or an extending portion of the drain electrode) 7D and may constitute auxiliary capacitance CS including the gate insulating layer 4 as a dielectric layer.

An alignment mark (for example, a metal layer) 21 and a base insulating film 2 covering the alignment mark 21 may be formed at a position closer to the dielectric substrate than a position of the gate bus line GL. When the number of photomasks is n in the case of preparing, for example, m TFT substrates from one glass substrate (where n<m), it is necessary to perform each exposure step multiple times. Thus, when the number (n) of the photomasks is less than the number (m) of the TFT substrates 101 prepared from one glass substrate 1, the alignment mark 21 is used for alignment of the photomasks. The alignment mark 21 may be omitted.

In the present embodiment, the patch electrode 15 is formed within a layer different from the source metal layer. As a result, the following advantages can be obtained.

Since the source metal layer is typically formed by using a metal film, it is conceivable to form the patch electrode in the source metal layer (as in the TFT substrate of the reference example). However, the patch electrode preferably has low resistance to the extent that oscillation of electrons is not hindered, and for example, the patch electrode is formed of an Al layer having a thickness relatively large of 0.5 μm or greater. For this reason, in the TFT substrate of the reference example, the source bus line SL and the like are also formed of such a thick metal film, and there is a problem in controllability of patterning that reduces when wiring lines are formed. In contrast, in the present embodiment, since the patch electrode 15 is formed separately from the source metal layer, the thickness of the source metal layer and the thickness of the patch electrode 15 can be controlled independently. Accordingly, controllability can be secured when the source metal layer is formed, and the patch electrode 15 having a desired thickness can be formed.

In the present embodiment, the thickness of the patch electrode 15 can be set at a high degree of freedom separately from the thickness of the source metal layer. Note that since it is not necessary to control the size of the patch electrode 15 as strictly as the source bus line SL or the like, there is no problem in a line width shift (deviation from a design value) increased by increasing the thickness of the patch electrode 15. Note that the case Where the thickness of the patch electrode 15 and the thickness of the source metal layer are equal is not excluded.

The patch electrode 15 may include a Cu layer or an Al layer as a main layer. Performance of the scanning antenna is correlated with electric resistance of the patch electrode 15, and the thickness of the main layer is set to obtain desired resistance. From the viewpoint of electric resistance, there is a possibility that the thickness of the patch electrode 15 can be reduced by using the Cu layer rather than the Al layer.

Figure 4A:
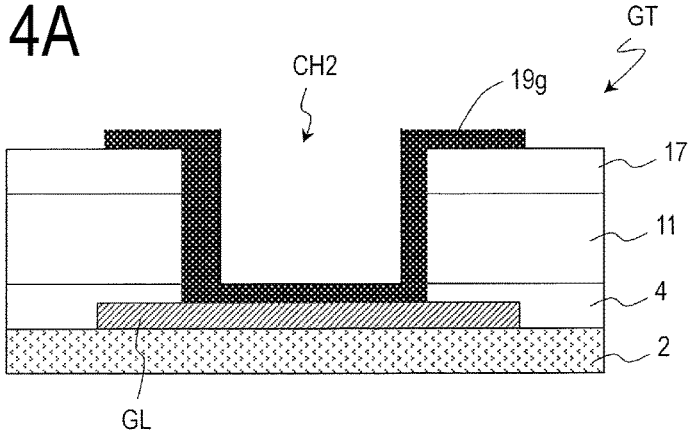
FIG. 4A to FIG. 4C are cross-sectional views schematically illustrating a gate terminal section GT, a source terminal section ST, and a transfer terminal section PT of the TFT substrate 101, respectively.
Figure 4B:
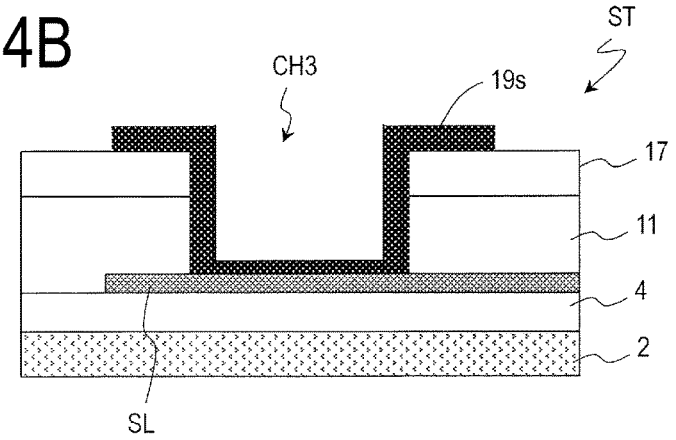
Figure 4C:
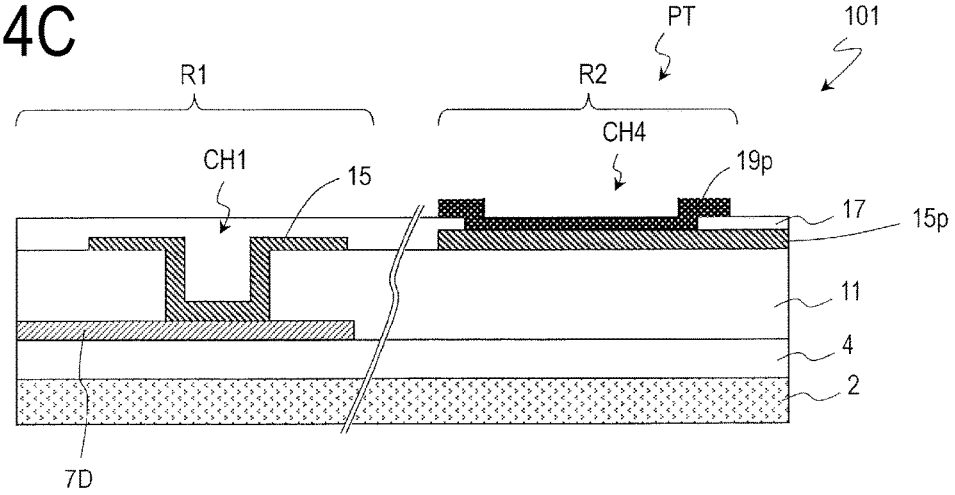

Gate Terminal Section GT, Source Terminal Section ST, and Transfer Terminal Section PT FIG. 4A to FIG. 4C are cross-sectional views schematically illustrating the gate terminal section GT, the source terminal section ST, and the transfer terminal section PT, respectively.

The gate terminal section GT includes the gate bus line GL formed on the dielectric substrate, an insulating layer covering the gate bus line GL, and a gate terminal upper connection section 19*g*. The gate terminal upper connection section 19*g* is in contact with the gate bus line GL within a contact hole CH2 formed in the insulating layer. In this example, the insulating layer covering the gate bus line GL includes the gate insulating layer 4, the first insulating layer 11 and the second insulating layer 17 in this order from the dielectric substrate side. The gate terminal upper connection section 19*g* is, for example, a transparent electrode formed of a transparent conductive film provided on the second insulating layer 17.

The source terminal section ST includes the source bus line SL formed on the dielectric substrate (here, on the gate insulating layer 4), an insulating layer covering the source bus line SL, and a source terminal upper connection section 19*s*. The source terminal upper connection section 19*s* is in contact with the source bus line SL within contact hole CH3 formed in the insulating layer. In this example, the insulating layer covering the source bus line SL includes the first insulating layer 11 and the second insulating layer 17. The source terminal upper connection section 19*s* is, for example, a transparent electrode formed of a transparent conductive film provided on the second insulating layer 17.

The transfer terminal section PT includes a patch connecting section 15*p* formed on the first insulating layer 11, the second insulating layer 17 covering the patch connecting section 15*p*, and a transfer terminal upper connection section 19*p*. The transfer terminal upper connection section 19*p* is in contact with the patch connecting section 15*p* within a contact hole CH4 formed in the second insulating layer 17. The patch connecting section 15*p* is formed of the same conductive film as a conductive film of the patch electrode 15. The transfer terminal upper connection section (also referred to as an upper transparent electrode) 19*p* is, for example, a transparent electrode formed of a transparent conductive film provided on the second insulating layer 17. In the present embodiment, the upper connection sections 19*g*, 19*s*, and 19*p* of the respective terminal sections are formed of the same transparent conductive film.

In the present embodiment, there is such an advantage that the contact holes CH2, CH3, and CH4 of the respective terminal sections can be formed simultaneously at an etching step after formation of the second insulating layer 17. A production process will be described below in detail.

Production Method of TFT Substrate 101

Figure 5:
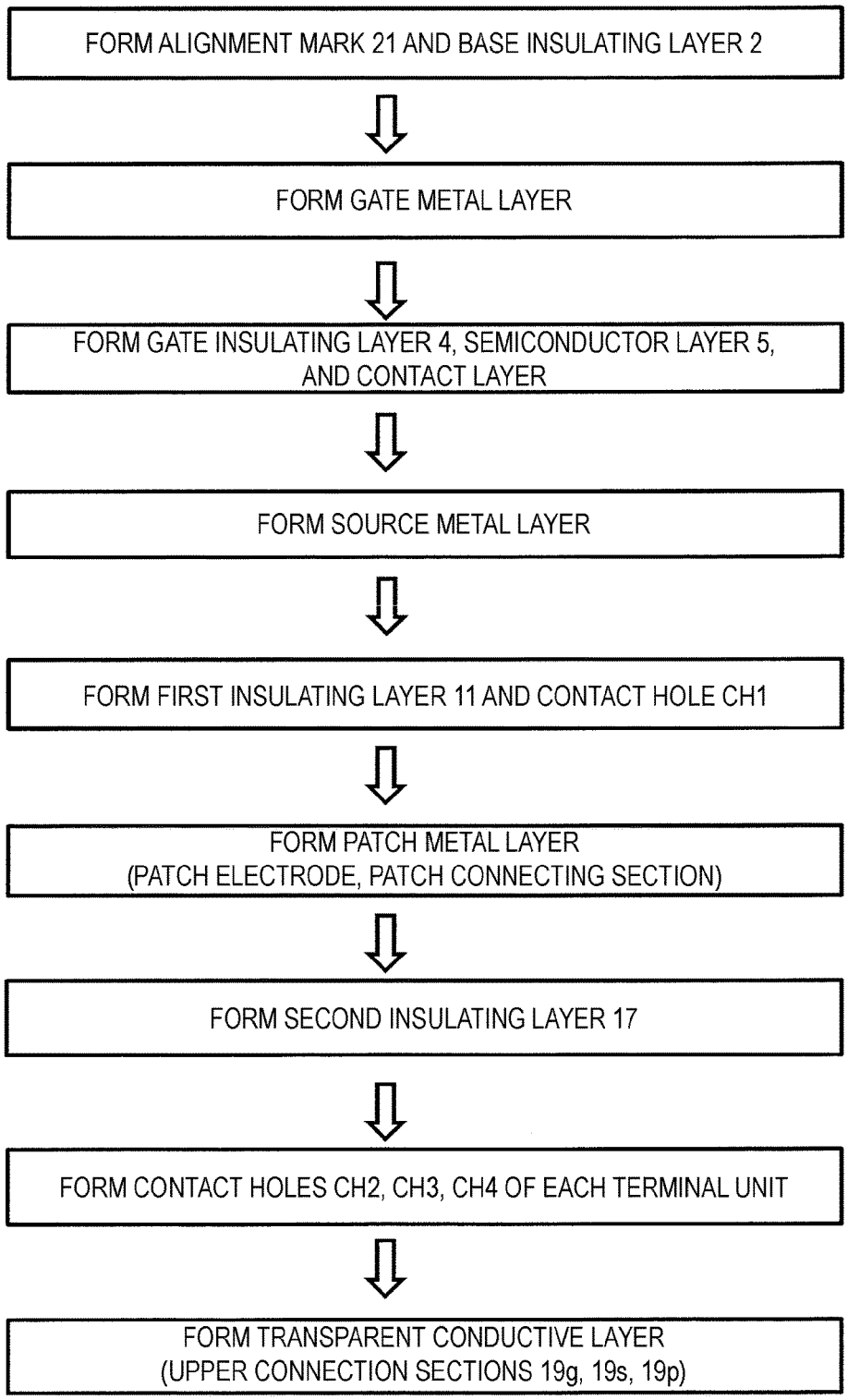
FIG. 5 is a diagram illustrating an example of production steps of the TFT substrate 101.

The TFT substrate 101 can be produced by the following method, for example. FIG. 5 is a view exemplifying production steps of the TFT substrate 101.

First, a metal film (for example, a Ti film) is formed on a dielectric substrate and patterned to form the alignment mark 21. A glass substrate, a plastic substrate (resin substrate) having heat resistance, or the like can be used as the dielectric substrate, for example. Then, the base insulating film 2 is formed to cover the alignment mark 21. For example, an $SiO_2$ film is used as the base insulating film 2.

Subsequently, a gate metal layer including the gate electrode 3 and the gate bus line GL is formed on the base insulating film 2.

The gate electrode 3 can be formed integrally with the gate bus line GL. Here, a gate conductive film (not illustrated) (with a thickness of greater than or equal to 50 nm and less than or equal to 500 nm) is formed on the dielectric substrate by sputtering or the like. Then, the gate conductive film is patterned to obtain the gate electrode 3 and the gate bus line GL. A material of the gate conductive film is not particularly limited. A film containing a metal such as aluminum (Al), tungsten (W), molybdenum (Mo), tantalum. (Ta), chromium (Cr), titanium (Ti) and copper (Cu), or an alloy thereof or a metal nitride thereof can be used appropriately as the gate conductive film. Here, a layered film including MoN (having a thickness of 50 nm, for example), Al (having a thickness of 200 nm, for example), and MoN (having a thickness of 50 nm, for example) layered one on another in this order is formed as the gate conductive film.

Then, the gate insulating layer 4 is formed to cover the gate metal layer. The gate insulating layer 4 can be formed by CVD or the like. A silicon oxide ($SiO_2$) layer, a silicon nitride (SiNx) layer, a silicon oxynitride. (SiOxNy; x>y) layer, a silicon nitride oxide (SiNxOy; x>y) layer, or the like can be used appropriately as the gate insulating layer 4. The gate insulating layer 4 may include a layered structure. Here, an SiNx layer (having a thickness of 410 nm, for example) is formed as the gate insulating layer 4.

Then, the semiconductor layer 5 and a contact layer are formed on the gate insulating layer 4. Here, an intrinsic amorphous silicon film (with a thickness of 125 nm, for example) and an $n^+$ type amorphous silicon film (with a thickness of 65 nm, for example) are formed in this order and patterned to obtain the semiconductor layer 5 having an island shape and the contact layer. The semiconductor film used for the semiconductor layer 5 is not limited to an amorphous silicon film. For example, an oxide semiconductor layer may be formed as the semiconductor layer 5. In this case, it is not necessary to provide the contact layer between the semiconductor layer 5 and source/drain electrodes.

Then, a source conductive film (having a thickness of greater than or equal to 50 nm and less than or equal to 500 nm, for example) is formed on the gate insulating layer 4 and on the contact layer, and patterned to form a source metal layer including the source electrode 7S, the drain electrode 7D, and the source bus line SL. At this time, the contact layer is also etched, and the source contact layer 6S and the drain contact layer 6D separated from each other are formed.

A material of the source conductive film is not particularly limited. A film containing a metal such as aluminum (Al), tungsten (W), molybdenum (Mo), tantalum (Ta), chromium (Cr), titanium (Ti) and copper (Cu), or an alloy thereof or a metal nitride thereof can be used appropriately as the source conductive film. Here, a layered film including MoN (having a thickness of 30 nm, for example), Al (having a thickness of 200 nm, for example), and MoN (having a thickness of 50 nm, for example) layered one on another in this order is formed as the source conductive film. Note that, alternatively, a layered film including Ti (having a thickness of 30 nm, for example), MoN (having a thickness of 30 nm, for example), Al (having a thickness of 200 nm, for example), and MoN (having a thickness of 50 nm, for example) layered one on another in this order may be formed as the source conductive film.

Here, for example, the source conductive film is formed by sputtering and the source conductive film is patterned by wet etching (source/drain separation). Thereafter, a portion of the contact layer located on a region serving as the channel region of the semiconductor layer 5 is removed by, for example, dry etching to form a gap portion, and the source contact layer 6S and the drain contact layer 6D are separated. At this time, in the gap portion, a portion at or near a surface of the semiconductor layer 5 is also etched (overetching).

Note that, for example, when a layered filth including a Ti film and an Al film layered one on another in this order is used as the source conductive film, an aqueous solution of phosphoric acid, acetic acid, and nitric acid or the like may be used to pattern the Al film by wet etching, and thereafter, the Ti film and the contact layer ($n^+$ type amorphous silicon layer) 6 may be patterned simultaneously by dry etching. Alternatively, it is also possible to collectively etch the source conductive film and the contact layer. However, in the case of simultaneously etching the source conductive film, or a lower layer of the source conductive film, and the contact layer 6, it may be difficult to control distribution of an etching amount of the semiconductor layer 5 (an amount of excavation of the gap portion) of the entire substrate. In contrast, as described above, when the etching step is performed separately from the source/drain separation and the gap portion formation, the etching amount of the gap portion can be controlled more easily.

Next, the first insulating layer 11 is formed to cover the TFT 10. In this example, the first insulating layer 11 is disposed to come into contact with the channel region of the semiconductor layer 5. Furthermore, the contact hole CH1 reaching the drain electrode 7D is formed in the first insulating layer 11 by a known photolithographic method.

The first insulating layer 11 may be, for example, an inorganic insulating layer such as a silicon oxide ($SiO_2$) film, a silicon nitride (SiNx) film, a silicon oxynitride (SiOxNy; x>y) film, or a silicon nitride oxide (SiNxOy; x>y) film. Here, an SiNx layer having a thickness of, for example, 330 nm is formed by CVD or the like as the first insulating layer 11.

Then, the patch conductive film is formed on the first insulating layer 11 and within the contact hole CH1 and is patterned. As a result, the patch electrode 15 is formed in the transmission and/or reception region R1, and the patch connecting section 15*p* is formed in the non-transmission and/or reception region R2. The patch electrode 15 is in contact with the drain electrode 7D within the contact hole CH1. Note that the layer formed of the patch conductive film and including the patch electrode 15 and the patch connecting section 15*p* may be referred to as a "patch metal layer" herein.

The same material as the material of the gate conductive film or the source conductive film can be used as the material of the patch conductive film. However, the patch conductive film is set to have a thickness greater than the thickness of each of the gate conductive film and the source conductive film. As a result, a loss resulting from a change of oscillation of free electrons in the patch electrode to heat can be reduced by keeping a low transmittance of electromagnetic waves and reducing sheet resistance of the patch electrode. A suitable thickness of the patch conductive film is, for example, greater than or equal to 1 μm and less than or equal to 30 μm. In a case where the patch conductive film has a thickness less than the thickness described above, there is a possibility of occurrence of such a problem that a transmittance of electromagnetic waves becomes roughly 30%, the sheet resistance becomes greater than or equal to 0.03 Ω/sq, and the loss increases. In a case where the patch conductive film has a thickness greater than the thickness described above, there is a possibility of occurrence of such a problem that patterning characteristics of the slots deteriorate.

Here, a layered film (MoN/Al/MoN) including MoN (having a thickness of 50 nm, for example), Al (having a thickness of 1000 nm, for example), and MoN (having a thickness of 50 nm, for example) layered one on another in this order is formed as the patch conductive film. Note that, alternatively, a layered film (MoN/Al/MoN/Ti) including Ti (having a thickness of 50 nm, for example), MoN (having a thickness of 50 nm, for example), Al (having a thickness of 2000 nm, for example), and MoN (having a thickness of 50 nm, for example) layered one on another in this order may be formed as the patch conductive film. Alternatively, a layered film (Ti/Cu/Ti) including a Ti film, a Cu film, and a Ti film layered one on another in this order, or a layered film (Cu/Ti) including a Ti film and a Cu film layered one on another in this order may be used as the patch conductive film.

Then, the second insulating layer (having a thickness of greater than or equal to 100 nm and less than or equal to 300 nm) 17 is formed on the patch electrode 15 and the first insulating layer 11. The second insulating layer 17 is not particularly limited, and, for example, a silicon oxide ($SiO_2$) film, a silicon nitride (SiNx) film, a silicon oxynitride (SiOxNy; x>y) film, a silicon nitride oxide (SiNxOy; x>y) film, or the like can be used appropriately as the second insulating layer 17. Here, for example, an SiNx layer having a thickness of 200 nm is formed as the second insulating layer 17.

Thereafter, the inorganic insulating films (the second insulating layer 17, the first insulating layer 11, and the gate insulating layer 4) are etched collectively by dry etching using a fluorine-based gas, for example. During the etching, the patch electrode 15, the source bus line SL, and the gate bus line GL each function as an etch stop. As a result, the contact hole CH2 reaching the gate bus line GL is formed in the second insulating layer 17, the first insulating layer 11, and the gate insulating layer 4, and the contact hole CH3 reaching the source bus line SL is formed in the second insulating layer 17 and the first insulating layer 11. Furthermore, the contact hole CH4 reaching the patch connecting section 15*p* is formed in the second insulating layer 17.

In this example, since the inorganic insulating films are etched collectively, side surfaces of the second insulating layer 17, the first insulating layer 11, and the gate insulating layer 4 are aligned on a side wall of the obtained contact hole CH2, and side walls of the second insulating layer 17 and the first insulating layer 11 are aligned on a side wall of the contact hole CH3. Note that herein the expression that the "side surfaces" of different two or more layers "are aligned" within the contact hole does not only include the case where the side surfaces exposed in the contact hole in these layers are flush in the orthogonal direction, but also includes the case where inclined surfaces such as continuous tapered shapes are formed. Such a configuration can be obtained, for example, by etching these layers by using the same mask, or by using one of these layers as a mask to etch the other layers.

Next, a transparent conductive film (having a thickness of greater than or equal to 50 nm and less than or equal to 200 nm) is formed on the second insulating layer 17 and within the contact holes CH2, CH3, and CH4 by sputtering, for example. An indium tin oxide (ITO) film, an IZO film, a zinc oxide (ZnO) film or the like can be used as the transparent conductive film. Here, an ITO film having a thickness of, for example, 100 nm is used as the transparent conductive film.

Next, the transparent conductive film is patterned to form the gate terminal upper connection section 19*g*, the source terminal upper connection section 19*s*, and the transfer terminal upper connection section 19*p*. The gate terminal upper connection section 19*g*, the source terminal upper connection section 19*s*, and the transfer terminal upper connection section 19*p* are used for protecting the electrodes or wiring lines exposed at each terminal section. Thus, the gate terminal section GT, the source terminal section ST, and the transfer terminal section PT are obtained.

Structure of Slot Substrate 201

Then, a structure of the slot substrate 201 will be described more specifically.

Figure 6:
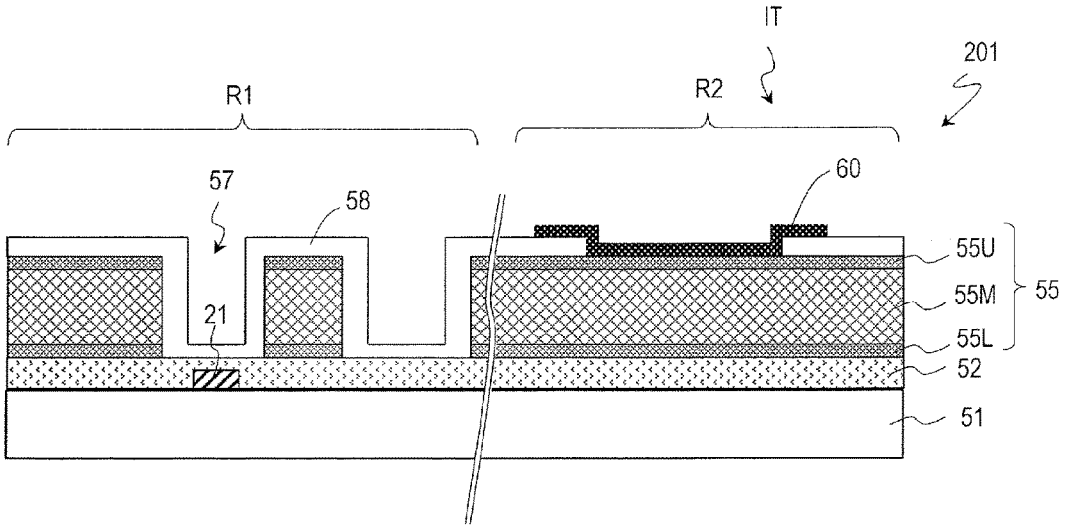
FIG. 6 is a cross-sectional view schematically illustrating the antenna unit region U and a terminal section IT the slot substrate 201.

FIG. 6 is a cross-sectional view schematically illustrating the antenna unit region U and the terminal section IT in the slot substrate 201.

The slot substrate 201 includes the dielectric substrate 51 including a surface and a rear surface, a third insulating layer 52 formed on the surface of the dielectric substrate 51, the slot electrode 55 formed on the third insulating layer 52, and a fourth insulating layer 58 covering the slot electrode 55. The reflective conductive plate 65 is disposed opposing the rear surface of the dielectric substrate 51 via the dielectric layer (air layer) 54. The slot electrode 55 and the reflective conductive plate 65 function as walls of the waveguide 301.

In the transmission and/or reception region R1, the plurality of slots 57 are formed in the slot electrode 55. Each slot 57 is an opening penetrating the slot electrode 55. In this example, the one slot 57 is disposed in each antenna unit region U.

The fourth insulating layer 58 is formed on the slot electrode 55 and within the slot 57. A material of the fourth insulating layer 58 may be the same as a material of the third insulating layer 52. The slot electrode 55 is covered with the fourth insulating layer 58. As a result, since the slot electrode 55 and the liquid crystal layer LC do not come into direct contact with each other, reliability can be enhanced. In a case where the slot electrode 55 is formed of a Cu layer, Cu may elute into the liquid crystal layer LC. Furthermore, in a case where the slot electrode 55 is formed of an Al layer by using a thin film deposition technique, the Al layer may include a void. The fourth insulating layer 58 can prevent the liquid crystal material from entering the void of the Al layer. Note that in a case where the slot electrode 55 is prepared by bonding aluminum foil on the dielectric substrate 51 with an adhesive material and patterning the aluminum foil, the problem of the void can be avoided.

The slot electrode 55 includes a main layer 55M such as a Cu layer and an Al layer. The slot electrode 55 may include a layered structure including the main layer 55M, and an upper layer 55U and a lower layer 55L disposed sandwiching the main layer 55M. The thickness of the main layer 55M may be set in consideration of a skin effect according to a material, and may be, for example, greater than or equal to 2 μm and less than or equal to 30 μm. The thickness of the main layer 55M is typically greater than the thickness of each of the upper layer 55U and the lower layer 55L.

In the example illustrated in the drawings, the main layer 55M is a Cu layer, and the upper layer 55U and the lower layer 55L are Ti layers. Adhesion between the slot electrode 55 and the third insulating layer 52 can be improved by disposing the lower layer 55L between the main layer 55M and the third insulating layer 52. Furthermore, corrosion of the main layer 55M (for example, a Cu layer) can be suppressed by providing the upper layer 55U.

Since the reflective conductive plate 65 constitutes the wall of the waveguide 301, the reflective conductive plate 65 preferably has a thickness three times or greater than the skin depth, and preferably live times or greater than the skin depth. For example, an aluminum plate, a copper plate, or the like having a thickness of several millimeters prepared by cutting out can be used as the reflective conductive plate 65.

The terminal section IT is provided in the non-transmission and/or reception region R2. The terminal section IT includes the slot electrode 55, the fourth insulating layer 58 covering the slot electrode 55, and an upper connection section 60. The fourth insulating layer 58 includes an opening reaching the slot electrode 55. The upper connection section 60 is in contact with the slot electrode 55 within the opening. In the present embodiment, the terminal section IT is disposed in the seal region Rs and is connected to the transfer terminal section on the TFT substrate (transfer section) by a sealing resin containing conductive particles.

Transfer Unit

Figure 7:
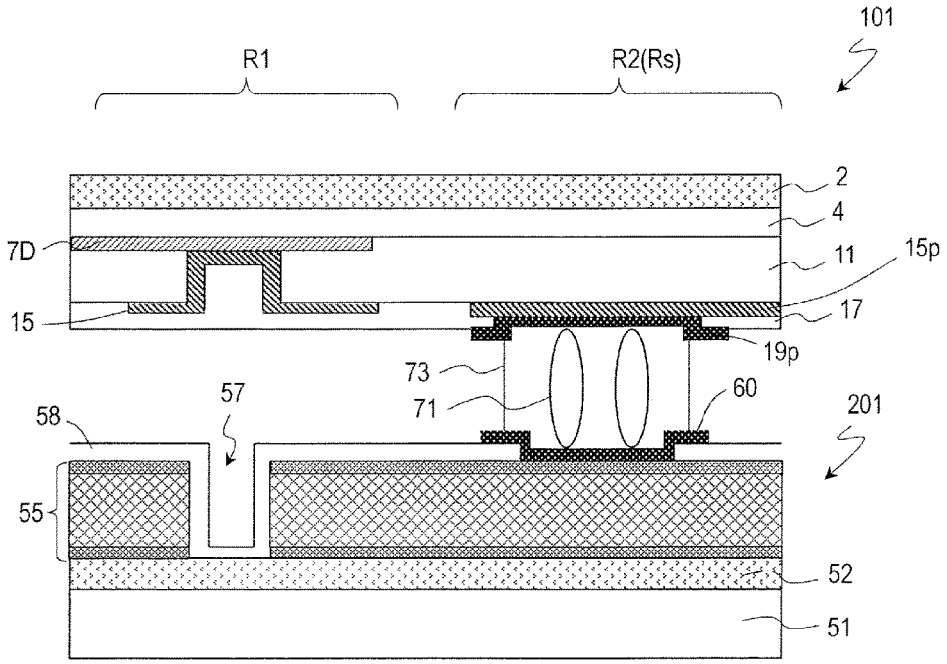
FIG. 7 is a schematic cross-sectional view for explaining a transfer section in the TFT substrate 101 and the slot substrate 201.

FIG. 7 is a schematic cross-sectional view for explaining the transfer section connecting the transfer terminal section PT of the TFT substrate 101 and the terminal section IT of the slot substrate 201. In FIG. 7, the same constituent elements as the constituent elements in FIG. 1 to FIG. 4C are denoted with the same reference signs.

In the transfer section, the upper connection section 60 of the terminal section IT is electrically connected to the transfer terminal upper connection section 19*p* of the transfer terminal section PT in the TFT substrate 101. In the present embodiment, the upper connection section 60 and the transfer terminal upper connection section 19*p* are connected via a resin (sealing resin) 73 (also referred to as a "sealing portion 73") including conductive beads 71.

Each of the upper connection sections 60 and 19*p* is a transparent conductive layer such as an ITO film and an IZO film, and an oxide film may be formed on a surface of the transparent conductive layer. When the oxide film is formed, electrical connection between the transparent conductive layers cannot be ensured, and there is a possibility that contact resistance increase. In contrast, in the present embodiment, since these transparent conductive layers are caused to adhere to each other via a resin including the conductive beads (for example, Au beads) 71, even in a case where the surface oxide film is formed, the conductive beads pierce (penetrate) the surface oxide film, and as a result, it is possible to suppress an increase in contact resistance. The conductive beads 71 may penetrate not only the surface oxide film but also penetrate the upper connection sections 60 and 19*p* which are the transparent conductive layers, and the conductive beads 71 may be in direct contact with the patch connecting section 15*p* and the slot electrode 55.

The transfer section may be disposed at each of a central portion and a peripheral portion (that is, inside and outside of the transmission and/or reception region R1 having a donut shape, as viewed in the normal direction of the scanning antenna 1000) of the scanning antenna 1000, or may be disposed at only one of the central portion and the peripheral portion. The transfer section may be disposed in the seal region Rs in which the liquid crystals are enclosed, or may be disposed outside the seal region Rs (side opposite to the liquid crystal layer).

Production Method of Slot Substrate 201

The slot substrate 201 can be produced by the following method, for example.

First, the third insulating layer (having a thickness of 200 nm, for example) 52 is formed on the dielectric substrate. A substrate such as a glass substrate or a resin substrate having a high transmittance with respect to electromagnetic waves (the dielectric constant εM and the dielectric loss tan $\delta_M$ are small) can be used as the dielectric substrate. The dielectric substrate is preferably thin in order to suppress attenuation of electromagnetic waves. For example, after the constituent elements such as the slot electrode 55 are formed on a surface of the glass substrate by a process described below, the glass substrate may be thinned from the rear surface side. As a result, the thickness of the glass substrate can be reduced to 500 μm or less, for example.

When a resin substrate is used as the dielectric substrate, the constituent elements such as the TFTs may be formed directly on the resin substrate, or may be formed on the resin substrate by a transfer method. In a case of the transfer method, for example, a resin film (for example, a polymide film) is formed on a glass substrate, and after the constituent elements are formed on the resin film by a process described below, the resin film on which the constituent elements are formed is separated from the glass substrate. Generally, a resin has the dielectric constant εM and the dielectric loss tan $\delta_M$ smaller than the dielectric constant εM and the dielectric loss tan $\delta_M$ of glass. The thickness of the resin substrate ranges, for example, from 3 μm to 300 μm. Besides polyimide, for example, a liquid crystal polymer can also be used as the resin material.

The third insulating layer 52 is not particularly limited, but, for example, a silicon oxide ($SiO_2$) film, a silicon nitride (SiNx) film, a silicon oxynitride (SiOxNy; x>y) film, a silicon nitride oxide (SiNxOy; x>y) film, or the like can be used appropriately.

Then, a metal film is formed on the third insulating layer 52 and is patterned to obtain the slot electrode 55 including the plurality of slots 57. A Cu film (or an Al film) having a thickness of 2 μm to 5 μm may be used as the metal film. Here, a layered film including a Ti film, a Cu film, and a Ti film layered one on another in this order is used as the metal film. Note that, alternatively, a layered film including Ti (having a thickness of 50 nm, for example) and Cu (having a thickness of 5000 nm, for example) layered one on another in this order may be formed as the metal film.

Thereafter, the fourth insulating layer (having a thickness of 100 nm or 200 nm, for example) 58 is formed on the slot electrode 55 and within the slot 57. A material of the fourth insulating layer 58 may be the same as the material of the third insulating layer. Thereafter, in the non-transmission and/or reception region R2, an opening reaching the slot electrode 55 is formed in the fourth insulating layer 58.

Next, a transparent conductive film is formed on the fourth insulating layer 58 and within the opening of the fourth insulating layer 58 and is patterned to form the upper connection section 60 being in contact with the slot electrode 55 within the opening. As a result, the terminal section IT is obtained.

Material and Structure of TFT 10

In the present embodiment, the TFT including the semiconductor layer 5 as an active layer is used as a switching element disposed in each pixel. The semiconductor layer 5 is not limited to an amorphous silicon layer and may be a polysilicon layer or an oxide semiconductor layer.

In a case where an oxide semiconductor layer is used, an oxide semiconductor included in the oxide semiconductor layer may be an amorphous oxide semiconductor or a crystalline oxide semiconductor including a crystalline portion. Examples of the crystalline oxide semiconductor include a polycrystalline oxide semiconductor, a microcrystalline oxide semiconductor, and a crystalline oxide semiconductor having a c-axis oriented substantially orthogonal to a layer surface.

The oxide semiconductor layer may include a layered structure of two or more layers. In a case where the oxide semiconductor layer includes a layered structure, the oxide semiconductor layer may include an amorphous oxide semiconductor layer and a crystalline oxide semiconductor layer. Alternatively, the oxide semiconductor layer may include a plurality of crystalline oxide semiconductor layers including different crystal structures. Furthermore, the oxide semiconductor layer may include a plurality of amorphous oxide semiconductor layers. In a case where the oxide semiconductor layer includes a two-layer structure including an upper layer and a lower layer, an energy gap of an oxide semiconductor contained in the upper layer is preferably greater than an energy gap of an oxide semiconductor contained in the lower layer. However, when a difference in the energy gap between these layers is relatively small, the energy gap of the oxide semiconductor in the lower layer may be greater than the energy gap of the oxide semiconductor in the upper layer.

For example, JP 2014-007399 A describes materials, structures and film formation methods of the amorphous oxide semiconductor and each of the crystalline oxide semiconductors described above, and a configuration of the oxide semiconductor layer including a layered structure. The contents disclosed in JP 2014-007399 A is incorporated herein by reference as its entirety.

The oxide semiconductor layer may include, for example, at least one metal element selected from In, Ga, and Zn. In the present embodiment, the oxide semiconductor layer includes, for example, an In—Ga—Zn—O-based semiconductor (for example, indium gallium zinc oxide). Here, the In—Ga—Zn—O-based semiconductor is a ternary oxide of In (indium), Ga (gallium), and Zn (zinc), and a ratio (composition ratio) of In, Ga, and Zn is not particularly limited. For example, the ratio includes In:Ga:Zn=2:2:1, In:Ga:Zn=1:1:1, or In:Ga:Zn=1:1:2. Such an oxide semiconductor layer can be formed of an oxide semiconductor film including an In—Ga—Zn—O-based semiconductor. Note that a channel etch type TFT including an active layer including an oxide semiconductor such as an In—Ga—Zn—O-based semiconductor may be referred to as a "CE-OS-TFT."

The In—Ga—Zn—O-based semiconductor may be an amorphous semiconductor or a crystalline semiconductor. A crystalline In—Ga—Zn—O-based semiconductor having a c-axis oriented substantially orthogonal to a layer surface is preferably used as the crystalline In—Ga—Zn—O-based semiconductor.

Note that a crystal structure of the crystalline In—Ga—Zn—O-based semiconductor is disclosed in, for example, JP 2014-007399 A, JP 2012-134475 A, and JP 2014-209727 A described above. The contents disclosed in JP 2012-134475 A and JP 2014-209727 A are incorporated herein by reference as their entirety. Since a TFT including an In—Ga—Zn—O-based semiconductor layer has high mobility (more than 20 times in comparison with an a-Si TFT) and low leakage current (less than 1/100th in comparison with an a-Si TFT), such a TFT is suitably used as a driving TFT (for example, a TFT incorporated in a drive circuit provided in the non-transmission and/or reception region) and a TFT provided in each antenna unit region.

In place of the In—Ga—Zn—O-based semiconductor, the oxide semiconductor layer may include any other oxide semiconductor. For example, the oxide semiconductor layer may include an In—Sn—Zn—O-based semiconductor (for example, $In_2O_3$—$SnO_2$—ZnO; InSnZnO). The In—Sn—Zn—O-based semiconductor is a ternary oxide of In (indium), Sn (tin), and Zn (zinc). Alternatively, the oxide semiconductor layer may include an In—Al—Zn—O-based semiconductor, an In—Al—Sn—Zn—O-based semiconductor, a Zn—O-based semiconductor, an In—Zn—O-based semiconductor, a Zn—Ti—O-based semiconductor, a Cd—Ge—O-based semiconductor, a Cd—Pb—O-based semiconductor, CdO (cadmium oxide), an Mg—Zn—O-based semiconductor, an In—Ga—Sn—O-based semiconductor, an In—Ga—O-based semiconductor, a Zr—In—Zn—O-based semiconductor, an Hf—In—Zn—O-based semiconductor, an Al—Ga—Zn—O-based semiconductor, a Ga—Zn—O-based semiconductor, or the like.

In the example illustrated in FIGS. 3A and 3B, the TFT 10 is a channel etch type TFT including a bottom gate structure. In the "channel etch type TFT," no etch stop layer is formed on a channel region, and a lower face of an end portion located on the channel side of each of source and drain electrodes is disposed to come into contact with an upper face of a semiconductor layer. The channel etch type TFT is formed by, for example, forming a conductive film for source/drain electrodes on the semiconductor layer and performing source/drain separation. At the source/drain separation step, a surface portion of the channel region may be etched.

Note that the TFT 10 may be an etch stop type TFT in which an etch stop layer is formed on a channel region. In the etch stop type TFT, a lower face of an end portion located on the channel side of each of source and drain electrodes is located, for example, on the etch stop layer. The etch stop type TFT is formed by, for example, forming the etch stop layer covering a portion serving as the channel region in a semiconductor layer, and thereafter forming a conductive film for source/drain electrodes on the semiconductor layer and the etch stop layer to perform source/drain separation.

Furthermore, although the ITT 10 includes a top contact structure in which the source and drain electrodes are in contact with the upper face of the semiconductor layer, the source and drain electrodes may be disposed to come into contact with the lower face of the semiconductor layer (a bottom contact structure). Furthermore, the TFT 10 may include a bottom gate structure including a gate electrode on the dielectric substrate side of the semiconductor layer, or a top gate structure including a gate electrode above the semiconductor layer.

Second Embodiment

A scanning antenna of a second embodiment will be described with reference to the drawings. A TFT substrate of the scanning antenna of the present embodiment differs from the TFT substrate 101 illustrated in FIGS. 2A and 2B in that a transparent conductive layer serving as an upper connection section of each terminal section is provided between a first insulating layer and a second insulating layer of the TFT substrate.

Figure 8A:
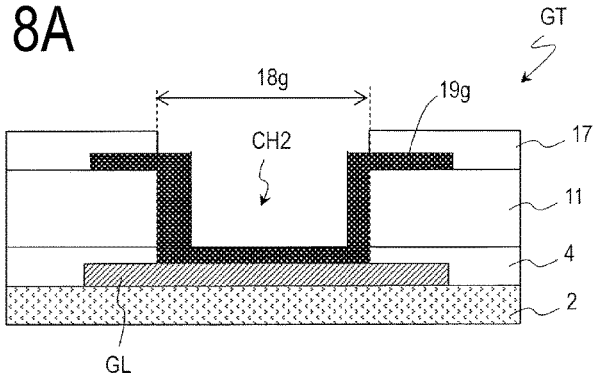
FIG. 8A to FIG. 8C are cross-sectional views illustrating a gate terminal section GT, a source terminal section ST, and a transfer terminal section PT, respectively, of a TFT substrate 102 in a second embodiment.
Figure 8B:
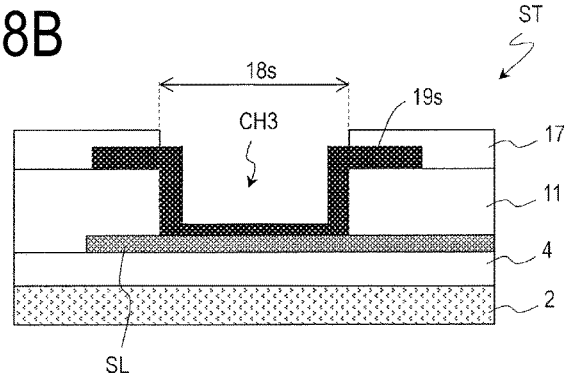
Figure 8C:
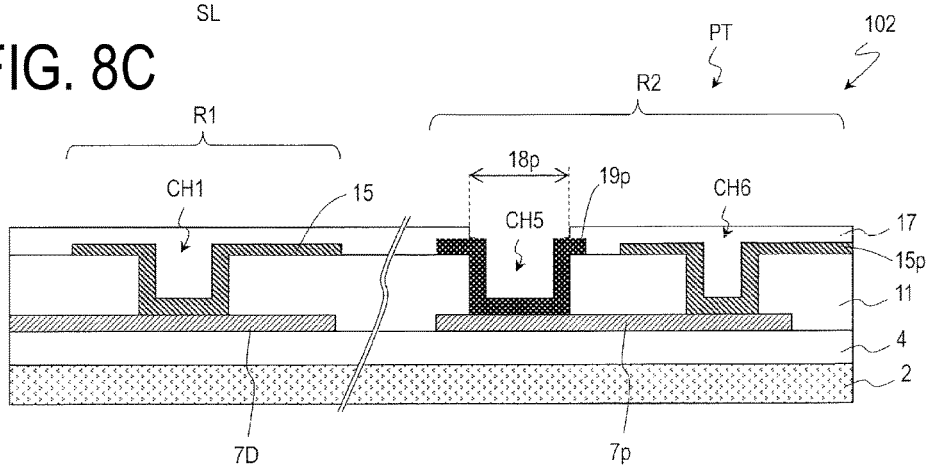

FIG. 8A to FIG. 8C are cross-sectional views illustrating a gate terminal section GT, a source terminal section ST, and a transfer terminal section PT, respectively, of a TFT substrate 102 in the present embodiment. Constituent elements similar to the constituent elements in FIG. 4A to FIG. 4C will be denoted with the same reference signs, and description thereof will be omitted. Note that since a cross-sectional structure of an antenna unit region U is similar to the cross-sectional structure of the antenna unit region U in the above-described embodiment (FIG. 3A and FIG. 3B), illustration in the drawings and description thereof will be omitted.

The gate terminal section GT in the present embodiment includes a gate bus line GL formed on a dielectric substrate, an insulating layer covering the gate bus line GL, and a gate terminal upper connection section 19*g*. The gate terminal upper connection section 19*g* is in contact with the gate bus line GL within a contact hole CH2 formed in the insulating layer. In this example, the insulating layer covering the gate bus line GL includes a gate insulating layer 4 and a first insulating layer 11. A second insulating layer 17 is formed on the gate terminal upper connection section 19*g* and the first insulating layer 11. The second insulating layer 17 includes an opening 18*g* exposing a portion of the gate terminal upper connection section 19*g*, in this example, the opening 18*g* of the second insulating layer 17 may be disposed to entirely expose the contact hole CH2, The source terminal section ST includes a source bus line SL formed on the dielectric substrate (here, on the gate insulating layer 4), an insulating layer covering the source bus line SL, and a source terminal upper connection section 19*s*. The source terminal upper connection section 19*s* is in contact with the source bus line SL within contact hole CH3 formed in the insulating layer. In this example, the insulating layer covering the source bus line SL includes only the first insulating layer 11. The second insulating layer 17 extends on the source terminal upper connection section 19*s* and the first insulating layer 11. The second insulating layer 17 includes an opening 18*s* exposing a portion of the source terminal upper connection section 19*s*. The opening 18*s* of the second insulating layer 17 may be disposed to entirely expose the contact hole CH3.

The transfer terminal section PT includes a source connection wiring line 7*p* formed of the same conductive film (source conductive film) as a conductive film of the source bus line SL, the first insulating layer 11 extending on the source connection wiring line 7*p*, a transfer terminal upper connection section 19*p* formed on the first insulating layer 11, and a patch connecting section 15*p* formed on the first insulating layer 11.

Contact holes CH5 and CH6 exposing the source connection wiring line 7*p* are provided in the first insulating layer 11. The transfer terminal upper connection section 19*p* is disposed on the first insulating layer 11 and within the contact hole CH5 and is in contact with the source connection wiring line 7*p* within the contact hole CH5. The patch connecting section 15*p* is disposed on the first insulating layer 11 and within the contact hole CH6 and is in contact with the source connection wiring line 7*p* within the contact hole CH6. The transfer terminal upper connection section 19*p* is a transparent electrode formed of a transparent conductive film. The patch connecting section 15*p* is formed of the same conductive film as a conductive film of a patch electrode 15. Note that the upper connection sections 19*g*, 19*s*, and 19*p* of the respective terminal sections may be formed of the same transparent conductive film.

The second insulating layer 17 extends on the transfer terminal upper connection section 19*p*, the patch connecting section 15*p*, and the first insulating layer 11. The second insulating layer 17 includes an opening 18*p* exposing a portion of the transfer terminal upper connection section 19*p*. In this example, the opening 18*p* of the second insulating layer 17 is disposed to entirely expose the contact hole CH5. On the other hand, the patch connecting section 15*p* is covered with the second insulating layer 17.

Thus, in the present embodiment, the source connection wiring line 7*p* formed in the source metal layer electrically connects the transfer terminal upper connection section 19*p* of the transfer terminal section PT and the patch connecting section 15*p*. Although not illustrated in the drawings, as with the above-described embodiment, the transfer terminal upper connection section 19*p* is connected to a slot electrode of a slot substrate 201 by a sealing resin containing conductive particles.

In the above-described embodiment, the contact holes CH1 to CH4 having different depths are collectively formed after the formation of the second insulating layer 17. For example, while the insulating layers each having a thickness relatively great (the gate insulating layer 4, the first insulating layer 11 and the second insulating layer 17) are etched on the gate terminal section GT, only the second insulating layer 17 is etched in the transfer terminal section PT. For this reason, there is a possibility that the conductive film (for example, the patch electrode conductive film) serving as a base of the contact hole having a small depth receive a considerable damage during etching.

In contrast, in the present embodiment, the contact holes CH1 to CH3, CH5, and CH6 are formed prior to formation of the second insulating layer 17. Since these contact holes are formed only in the first insulating layer 11 or in a layered film of the first insulating layer 11 and the gate insulating layer 4, a difference in the depth among the contact holes collectively formed can be reduced more than in the above-described embodiment. Accordingly, a damage to the conductive film serving as a base of the contact hole can be reduced. Particularly, in a case where an Al film is used for the patch electrode conductive film, since a favorable contact cannot be obtained in a case where an ITO film and an Al film are brought into direct contact with each other, a cap layer such as an MoN layer may be formed on an upper layer of the Al film. Since it is not necessary to increase the thickness of the cap layer in consideration of the damage during etching, such a case is advantageous.

Production Method of TFT Substrate 102

Figure 9:
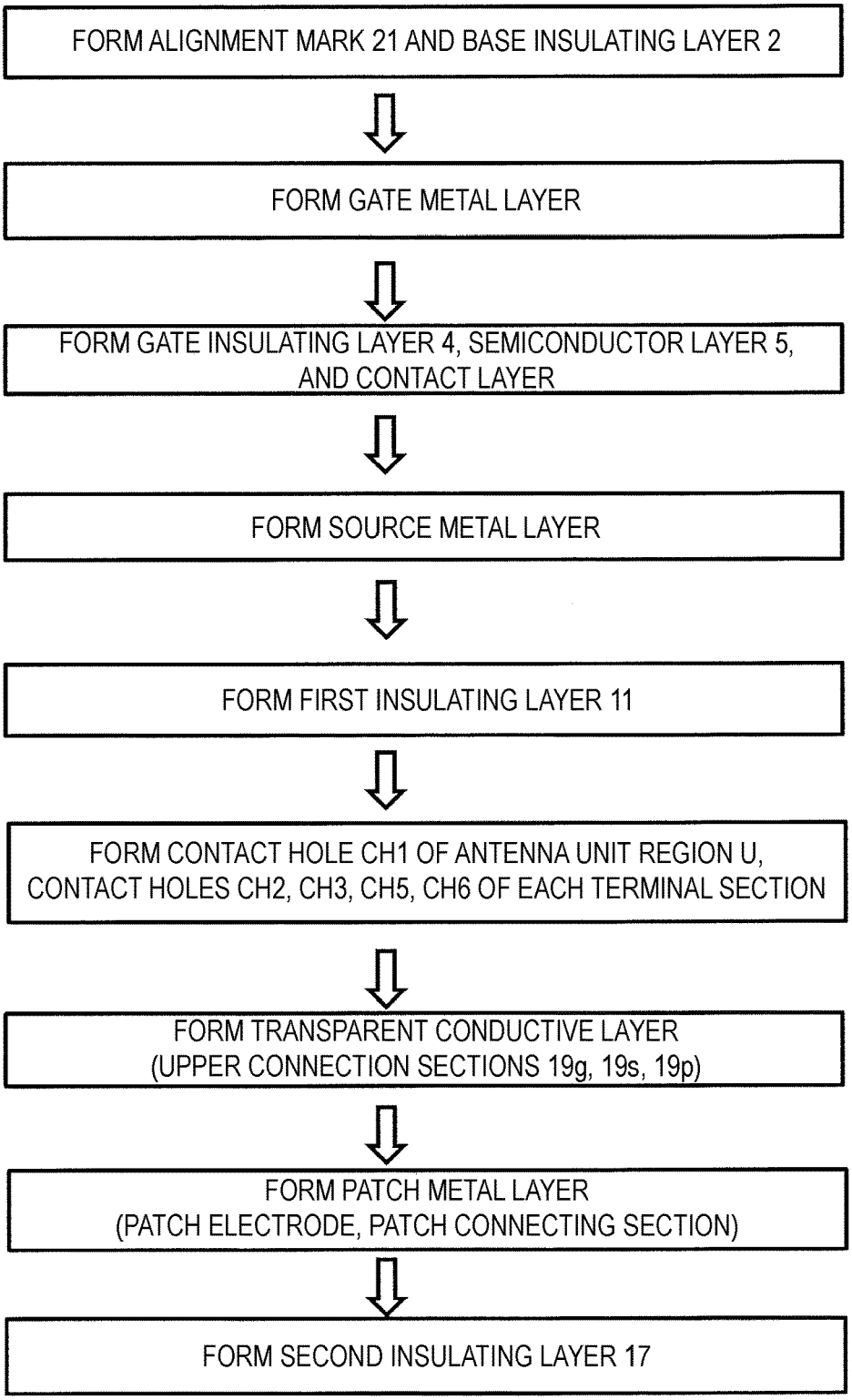
FIG. 9 is a view illustrating an example of production steps of the TFT substrate 102.

The TFT substrate 102 is produced by the following method, for example, FIG. 9 is a view exemplifying production steps of the TFT substrate 102. Note that hereinafter, in a case where a material, the thickness, a formation method and the like of each layer are the same as in the case of the TFT substrate 101 described above, description thereof will be omitted.

First, an alignment mark, a base insulating layer, a gate metal layer, a gate insulating layer, a semiconductor layer, a contact layer, and a source metal layer are formed on a dielectric substrate by the same method as in the case of the TFT substrate 101 to obtain a TFT. In a step of forming the source metal layer, in addition to source and drain electrodes and the source bus line, the source connection wiring line 7*p* is also formed of the source conductive film.

Next, the first insulating layer 11 is formed to cover the source metal layer. Thereafter, the first insulating layer 11 and the gate insulating layer 4 are collectively etched to form the contact holes CH1 to CH3, CH5, and CH6. During the etching, each of the source bus line SL and the gate bus line CL functions as an etch stop. As a result, in a transmission and/or reception region R1, the contact hole CH1 reaching the drain electrode of the TFT is formed in the first insulating layer 11. Furthermore, in a non-transmission and/or reception region R2, the contact hole CH2 reaching the gate bus line GL is formed in the first insulating layer 11 and the gate insulating layer 4, and the contact hole CH3 reaching the source bus line SL and the contact holes CH5 and CH6 reaching the source connection wiring line 7*p* are formed in the first insulating layer 11. The contact hole CH5 may be disposed in a seal region Rs and the contact hole CH6 may be disposed outside the seal region Rs. Alternatively, both the contact hole CH5 and the contact hole CH6 may be disposed outside the seal region Rs.

Then, a transparent conductive film is formed on the first insulating layer 11 and within the contact holes CH1 to CH3, CH5, and CH6, and is patterned. As a result, the gate terminal upper connection section 19*g* being in contact with the gate bus line GL within the contact hole CH2, the source terminal upper connection section 19*s* being in contact with the source bus line SL within the contact hole CH3, and the transfer terminal upper connection section 19*p* being in contact with the source connection wiring line 7*p* within the contact hole CH5 are formed.

Next, a patch electrode conductive film is formed on the first insulating layer 11, the gate terminal upper connection section 19*g*, the source terminal upper connection section 19*s*, and the transfer terminal upper connection section 19*p*, and within the contact holes CH1 and CH6 and is patterned. As a result, the patch electrode 15 being in contact with a drain electrode 7D within the contact hole CH1 is formed in the transmission and/or reception region R1, and the patch connecting section 15*p* being in contact with the source connection wiring line 7*p* within the contact hole CH6 is formed in the non-transmission and/or reception region R2. The patterning of the patch electrode conductive film may be performed by wet etching. Here, an etchant capable of increasing an etching selection ratio between the transparent conductive film (ITO or the like) and the patch electrode conductive film (for example, an Al film) is used. As a result, during the patterning of the patch electrode conductive film, the transparent conductive film can function as an etch stop. Since the portions exposed by the contact holes CH2, CH3, and CH5 in the source bus line SL, the gate bus line GL, and the source connection wiring line 7*p* are covered with the etch stop (transparent conductive film), these portions are not etched.

Subsequently, the second insulating layer 17 is formed. Thereafter, the second insulating layer 17 is patterned by, for example, dry etching using a fluorine-based gas. As a result, the opening 18*g* exposing the gate terminal upper connection section 19*g*, the opening 18*s* exposing the source terminal upper connection section 19*s*, and the opening 18*p* exposing the transfer terminal upper connection section 19*p* are provided in the second insulating layer 17. Thus, the TFT substrate 102 is obtained.

Third Embodiment

A scanning antenna of a third embodiment will be described with reference to the drawings. A TFT substrate in the scanning antenna of the present embodiment differs from the TFT substrate 102 illustrated in FIGS. 8A to 8C in that an upper connection section including a transparent conductive film is not provided in a transfer terminal section.

Figure 10A:
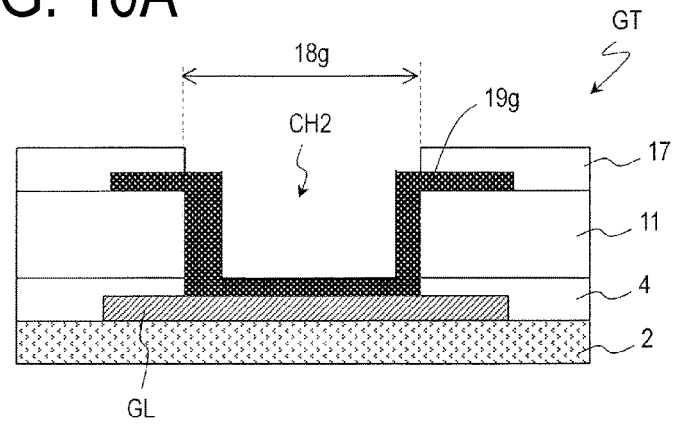
FIG. 10A to FIG. 10C are cross-sectional views illustrating a gate terminal section GT, a source terminal section ST, and a transfer terminal section PT, respectively, of a TFT substrate 103 in a third embodiment.
Figure 10B:
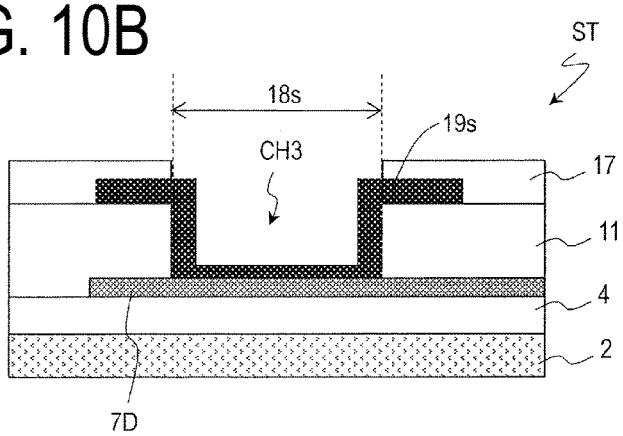
Figure 10C:
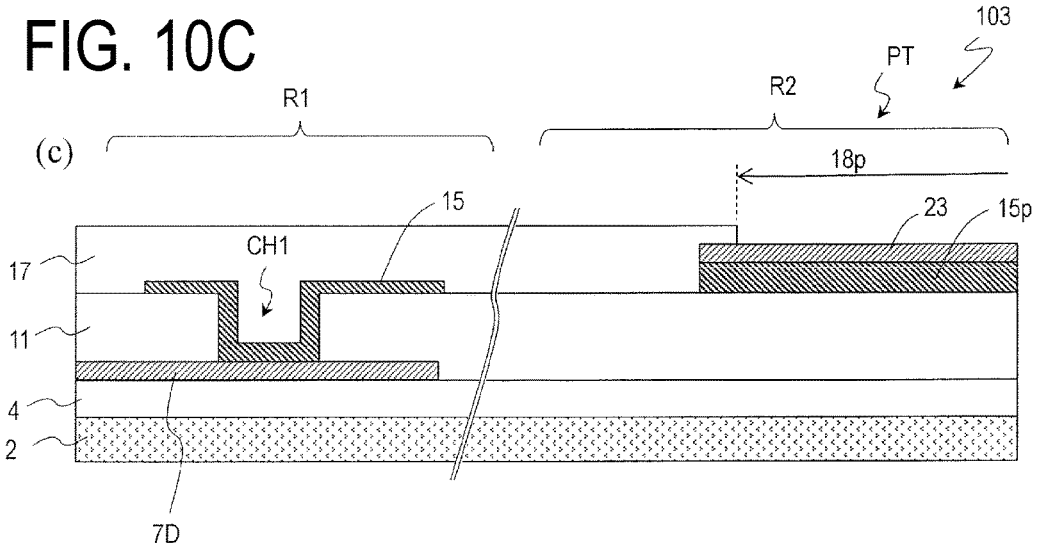

FIG. 10A to FIG. 10C are cross-sectional views illustrating a gate terminal section GT, a source terminal section ST, and a transfer terminal section PT, respectively, of a TFT substrate 103 in the present embodiment. Constituent elements similar to the constituent elements in FIG. 8A to FIG. 8C will be denoted with the same reference signs. Note that since a structure of an antenna unit region U is similar to in the above-described embodiment (FIG. 3A and FIG. 3B), illustration in the drawings and description thereof will be omitted.

Structures of the gate terminal section GT and the source terminal section ST are similar to the structures of the gate terminal section and the source terminal section of the TFT substrate 102 illustrated in FIG. 8A and FIG. 8B.

The transfer terminal section PT includes a patch connecting section 15*p* formed on a first insulating layer 11 and a protective conductive layer 23 layered on the patch connecting section 15*p*. A second insulating layer 17 extends on the protective conductive layer 23 and includes an opening 18*p* exposing a portion of the protective conductive layer 23. On the other hand, a patch electrode 15 is covered with the second insulating layer 17.

Production Method of TFT Substrate 103

Figure 11:
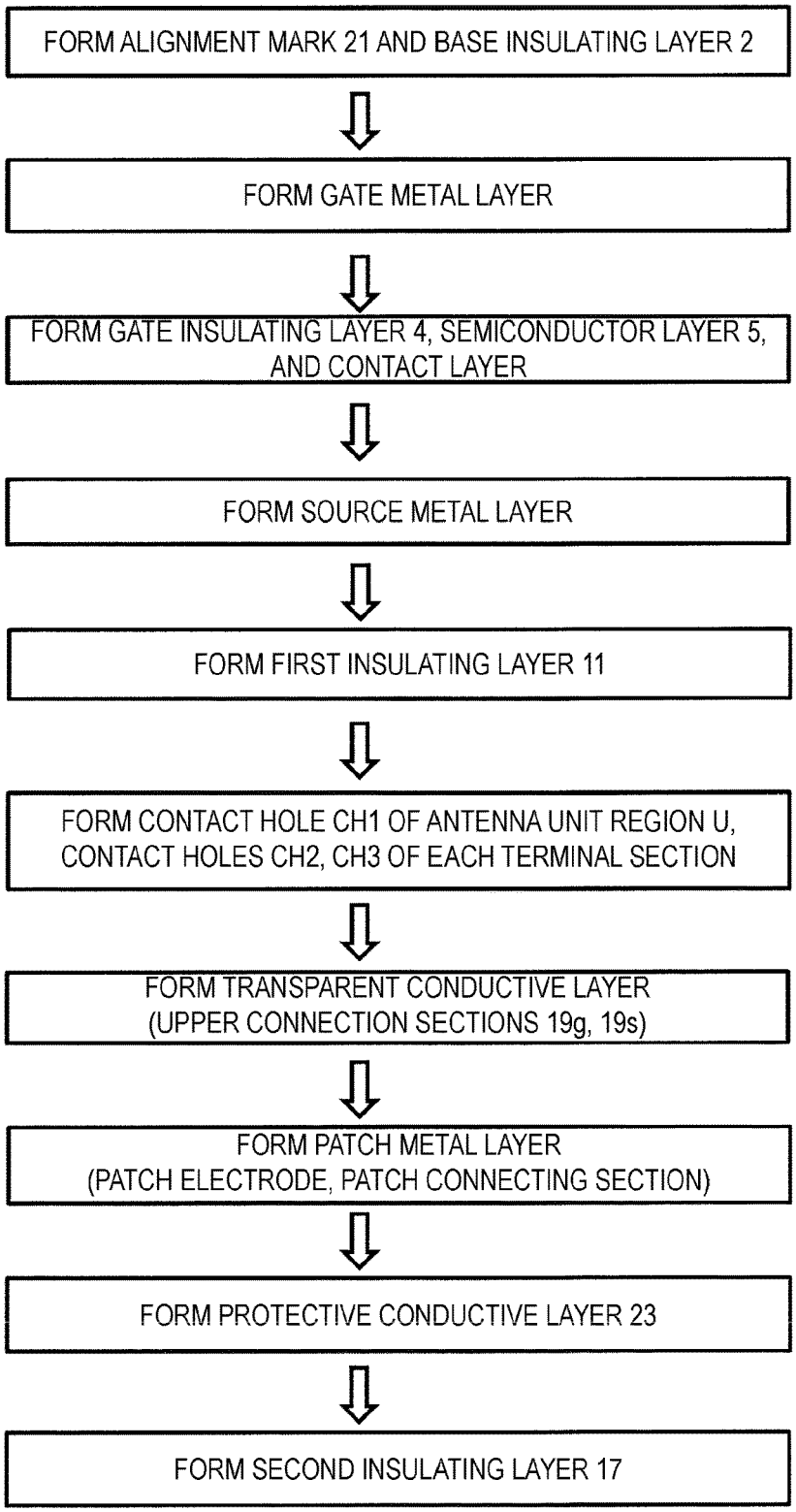
FIG. 11 is a diagram illustrating an example of production steps of the TFT substrate 103.

The TFT substrate 103 is produced by the following method, for example. FIG. 11 is a view exemplifying production steps of the TFT substrate 103. Note that hereinafter, in a case where a material, the thickness, a formation method and the like of each layer are the same as in the case of the TFT substrate 101 described above, description thereof will be omitted.

First, an alignment mark, a base insulating layer, a gate metal layer, a gate insulating layer, a semiconductor layer, a contact layer and a source metal layer are formed on a dielectric substrate by the same method as in the case of the TFT substrate 101 to obtain a TFT.

Next, the first insulating layer 11 is formed to cover the source metal layer. Thereafter, the first insulating layer 11 and a gate insulating layer 4 are collectively etched to form contact holes CH1 to CH3. During the etching, each of a source bus line SL and a gate bus line GL functions as an etch stop. As a result, the contact hole CH1 reaching a drain electrode of the TFT is formed in the first insulating layer 11, the contact hole CH2 reaching the gate bus line GL is formed in the first insulating layer 11 and the gate insulating layer 4, and the contact hole CH3 reaching the source bus line SL is formed in the first insulating layer 11. No contact hole is formed in a region where the transfer terminal section is formed.

Then, a transparent conductive film is formed on the first insulating layer 11 and within the contact holes CH1, CH2, and CH3, and is patterned. As a result, a gate terminal upper connection section 19*g* being in contact with the gate bus line GL within the contact hole CH2 and a source terminal upper connection section 19*s* being in contact with the source bus line SL within the contact hole CH3 are formed. In a region where the transfer terminal section is formed, the transparent conductive film is removed.

Next, a patch electrode conductive film is formed on the first insulating layer 11, the gate terminal upper connection section 19*g* and the source terminal upper connection section 19*s*, and within the contact hole CH1, and is patterned. As a result, the patch electrode 15 being in contact with a drain electrode 7D within the contact hole CH1 is formed in a transmission and/or reception region R1, and the patch connecting section 15*p* is formed in a non-transmission and/or reception region R2. As with the above-described embodiment, an etchant capable of ensuring an etching selection ratio between the transparent conductive film (ITO or the like) and the patch electrode conductive film is used for patterning the patch electrode conductive film, Subsequently, a protective conductive layer 23 is formed on the patch connecting section 15*p*. A Ti layer, an ITO layer, and an indium zinc oxide (IZO) layer (having a thickness of greater than or equal to 50 nm and less than or equal to 100 nm, for example), or the like can be used as the protective conductive layer 23. Here, a Ti layer (having a thickness of 50 nm, for example) is used as the protective conductive layer 23. Note that the protective conductive layer may be formed on the patch electrode 15.

Then, the second insulating layer 17 is formed. Thereafter, the second insulating layer 17 is patterned by, for example, dry etching using a fluorine-based gas. As a result, an opening 18*g* exposing the gate terminal upper connection section 19*g*, an opening 18*s* exposing the source terminal upper connection section 19*s*, and an opening 18*p* exposing the protective conductive layer 23 are provided in the second insulating layer 17. Thus, the TFT substrate 103 is obtained.

Structure of Slot Substrate 203

Figure 12:
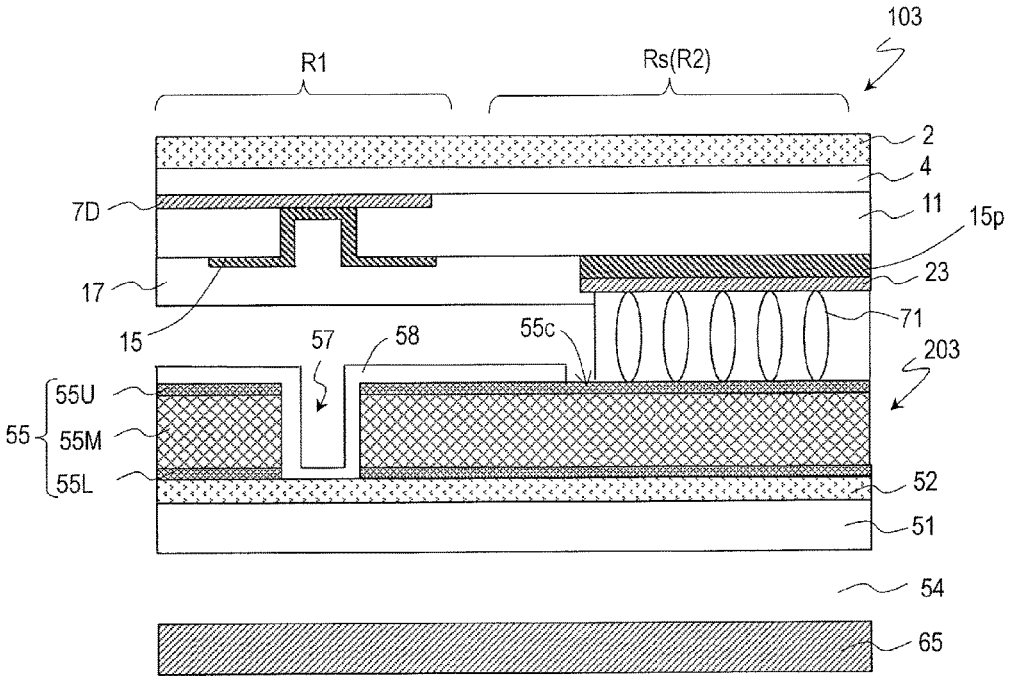
FIG. 12 is a cross-sectional view for explaining a transfer section in the TFT substrate 103 and a slot substrate 203.

FIG. 12 is a cross-sectional view for explaining a transfer section connecting the transfer terminal section PT of the TFT substrate 103 and a terminal section IT of a slot substrate 203 in the present embodiment. In FIG. 12, the same constituent elements as the constituent elements in the embodiments described above are denoted with the same reference signs.

First, the slot substrate 203 in the present embodiment will be described. The slot substrate 203 includes a dielectric substrate 51, a third insulating layer 52 formed on a surface of the dielectric substrate 51, a slot electrode 55 formed on the third insulating layer 52, and a fourth insulating layer 58 covering the slot electrode 55. A reflective conductive plate 65 is disposed opposing a rear surface of the dielectric substrate 51 via a dielectric layer (air layer) 54. The slot electrode 55 and the reflective conductive plate 65 function as walls of a waveguide 301.

The slot electrode 55 includes a layered structure including a Cu layer or an Al layer as a main layer 55M. In the transmission and/or reception region R1, a plurality of slots 57 are formed in the slot electrode 55. A structure of the slot electrode 55 in the transmission and/or reception region R1 is the same as the structure of the slot substrate 201 described above with reference to FIG. 6.

The terminal section IT is provided in the non-transmission and/or reception region R2. The terminal section IT includes an opening exposing a surface of the slot electrode 55 and provided in the fourth insulating layer 58. The exposed region of the slot electrode 55 serves as a contact surface 55*c*. Thus, in the present embodiment, the contact surface 55*c* of the slot electrode 55 is not covered with the fourth insulating layer 58.

In the transfer section, the protective conductive layer 23 covering the patch connecting section 15*p* of the TFT substrate 103 and the contact surface 55*c* of the slot electrode 55 of the slot substrate 203 are connected via a resin (sealing resin) including conductive beads 71.

As with the above-described embodiments, the transfer section in the present embodiment may be disposed in each of a central portion and a peripheral portion of the scanning antenna or may be disposed in only one of the central portion and the peripheral portion. Furthermore, the transfer section may be disposed within a seal region Rs or may be disposed outside the seal region Rs (side opposite to a liquid crystal layer).

In the present embodiment, no transparent conductive film is provided on the transfer terminal section PT and the contact surface of the terminal section IT. For this reason, the protective conductive layer 23 and the slot electrode 55 of the slot substrate 203 can be connected via a sealing resin containing conductive particles.

Furthermore, in the present embodiment, since a difference in the depth among the contact holes collectively formed is small in comparison with the first embodiment (FIG. 3A to FIG. 4C), a damage to a conductive film serving as a base of the contact hole can be reduced.

Production Method of Slot Substrate 203

The slot substrate 203 is produced as follows. Since a material, the thickness, and a formation method of each layer are the same as in the case of the slot substrate 201, description thereof will be omitted.

First, the third insulating layer 52 and the slot electrode 55 are formed on the dielectric substrate by the same method as in the case of the slot substrate 201, and the plurality of slots 57 are formed in the slot electrode 55. Then, the fourth insulating layer 58 is formed on the slot electrode 55 and within the slots. Thereafter, the opening 18*p* is provided in the fourth insulating layer 58 to expose a region serving as the contact surface of the slot electrode 55. Thus, the slot substrate 203 is produced.

External Heater Structure

As described above, a liquid crystal material used for an antenna unit of an antenna preferably has a large dielectric anisotropy $\Delta_{\varepsilon M}$. However, there is a problem in the liquid crystal material (nematic liquid crystal) having a large dielectric anisotropy $\Delta_{\varepsilon M}$ that has a high viscosity and a decreased response speed. Particularly, as temperature decreases, the viscosity increases. An environmental temperature of a scanning antenna mouthed on a moving body (for example, a ship, an aircraft, or an automobile) fluctuates. Accordingly, preferably, a temperature of the liquid crystal material can be adjusted to a certain extent or higher, for example 30° C. or higher, or 45° C. or higher. A set temperature is preferably set such that viscosity of a nematic liquid crystal material is about 10 cP (centipoise) or less.

In addition to the above-described structure, the scanning antenna according to an embodiment of the present invention preferably includes an external heater structure. Although various known heaters can be used as the external heater, a resistance heating type heater utilizing Joule heat is preferable as the external heater. A portion configured to generate heat in the heater is referred to as a heater part. Hereinafter, an example where a resistive film is used as the heater part will be described.

Figure 13A:
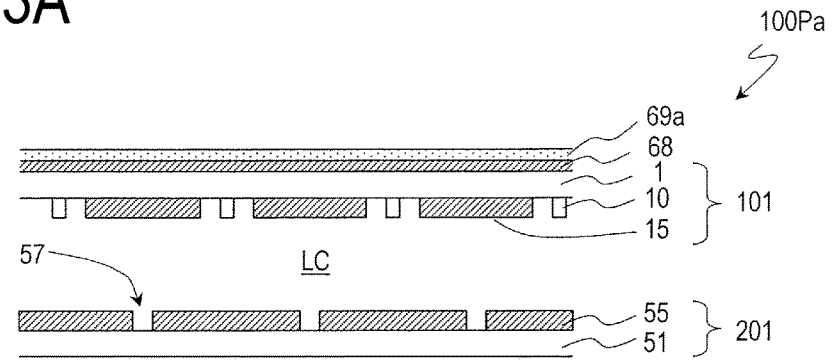
FIG. 13A is a schematic cross-sectional view of a liquid crystal panel 100Pa including a heater resistive film 68.
Figure 13B:
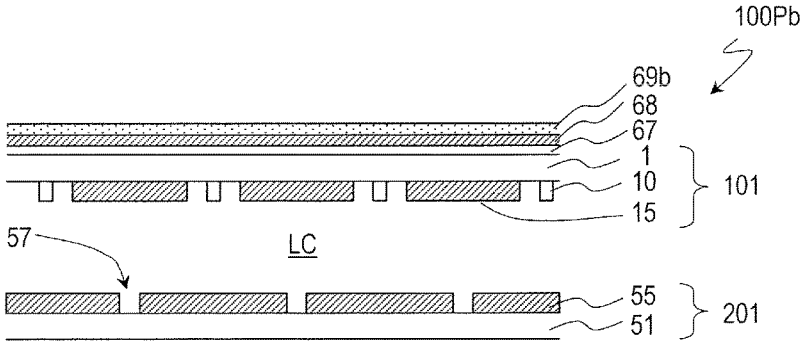
FIG. 13B is a schematic cross-sectional view of a liquid crystal panel 100Pb including the heater resistive film 68.

For example, a heater resistive film 68 is preferably disposed like a liquid crystal panel 100Pa or 100Pb illustrated in FIGS. 13A and 13B. Here, the liquid crystal panels 100Pa and 100Pb each include the TFT substrate 101 and the slot substrate 201 of the scanning antenna. 1000 illustrated in FIG. 1, and the liquid crystal layer LC provided between the TFT substrate 101 and the slot substrate 201, and further each include a resistance heating structure including the resistive film 68 on the outside of the TFT substrate 101. The resistive film 68 may be formed on the liquid crystal layer LC side of the dielectric substrate 1 of the TFT substrate 101. However, since this complicates a production process of the TFT substrate 101, the resistive film 68 is preferably disposed on the outside of the TFT substrate 101 (side opposite to the liquid crystal layer LC).

The liquid crystal panel 100Pa illustrated in FIG. 13A includes the heater resistive film 68 formed on a surface on the outside of the dielectric substrate 1 of the TFT substrate 101 and a protective layer 69*a* covering the heater resistive film 68. The protective layer 69*a* may be omitted. Since the scanning antenna is stored in, for example, a casing made from plastic, a user is prevented from directly touching the resistive film 68.

The resistive film 68 can be formed on the surface on the outside of the dielectric substrate 1 by using, for example, a known thin film deposition technique (for example, sputtering or CVD), an application method, or a printing method. The resistive film 68 is subjected to patterning as necessary. For example, the patterning is performed by a photolithographic process.

A material of the heater resistive film 68 is not particular limited, but a conductive material having relatively high resistance such as ITO and IZO can be used, for example. Furthermore, to adjust a resistance value, the resistive film 68 may be formed of a thin line or mesh of metal (for example, nichrome, titanium, chromium, platinum, nickel, aluminum, and copper). A thin line or mesh of ITO, IZO or the like can also be used. The resistance value may be set according to a required calorific value.

For example, to set a heat generation temperature of the resistive film 68 to 30° C. in the area (roughly 90000 $mm^2$) of a circle having a diameter of 340 mm with a 100 V AC (60 Hz), a resistance value of the resistive film 68 may be set to 139Ω, a current may be set to 0.7 A, and a power density may be set to 800 $W/m_2$. To set a heat generation temperature of the resistive film 68 to 45° C. in the same area with a 100 V AC (60 Hz), a resistance value of the resistive film 68 may be set to 82Ω, a current may be set to 1.2 A, and a power density may be set to 1350 $W/m^2$.

The protective layer 69*a* is formed of an insulating material and formed to cover the resistive film 68. The protective layer 69*a* may not be formed in a portion where the resistive film 68 is patterned and where the dielectric substrate 1 is exposed. The resistive film 68, as described below, is patterned to prevent a decrease in performance of the antenna. When the presence of a material forming the protective layer 69*a* causes a decrease in performance of the antenna, it is preferable to use the protective layer 69*a* subjected to patterning, as with the resistive film 68.

The protective layer 69*a* may be formed by any of a wet process and a dry process. For example, the protective layer 69*a* is formed by applying a liquid curable resin (or a precursor of a resin) or a solution of a curable resin to a surface of the dielectric substrate 1 on which the resistive film 68 is formed, and thereafter by curing the curable resin. The liquid resin or the resin solution is applied to the surface of the dielectric substrate 1 by various application methods (for example, by using a slot coater, a spin coater, or spray) or various printing methods to achieve a predetermined thickness. Thereafter, the protective layer 69*a* is formed of an insulating resin film by performing room temperature curing, heating curing, or light curing in accordance with a type of a resin. For example, the insulating resin film can be patterned by a photolithographic process.

A curable resin material can be used suitably as a material of which the protective layer 69*a* is formed. The curable resin material includes a heat curable type resin material and a light curable type resin material. Furthermore, the heat curable type resin material includes a thermal crosslinking type resin material and a thermal polymerization type resin material.

Examples of the thermal crosslinking type resin material include a combination of an epoxy-containing compound (for example, an epoxy resin) and an amine-containing compound, a combination of an epoxy-containing compound and a hydrazide-containing compound, a combination of an epoxy-containing compound and an alcohol-containing compound (for example, including a phenol resin), a combination of an epoxy-containing compound and a carboxylic-acid-containing compound (for example, including acid anhydride), a combination of an isocyanate-containing compound and an amine-containing compound, a combination of an isocyanate-containing compound and a hydrazide-containing compound, a combination of an isocyanate-containing compound and an alcohol-containing compound (for example, including a urethane resin), and a combination of an isocyanate-containing compound and a carboxylic-acid-containing compound. Furthermore, an example of a cationic polymerization type adhesive material includes a combination of an epoxy-containing compound and a cationic polymerization initiator (a typical cationic polymerization initiator: an aromatic sulfonium salt). An example of a radical polymerization type resin material includes a combination of a radical polymerization initiator and a monomer and/or oligomer including a vinyl group such as various types of acrylic resins, methacrylic resins, and urethane denatured acrylic (methacrylic) resins (a typical radical polymerization initiator: an azo-containing compound (for example, AIBN (azobisisobutyronitrile)). Examples of a ring-opening polymerization type resin material include an ethylene-oxide-containing compound, an ethylenimine-containing compound, and a siloxane-containing compound. In addition, a maleimide resin, a combination of a maleimide resin and amine, a combination of maleimide and a methacrylic compound, a bismaleimide-triazine resin, and a polyphenylene ether resin can be used. Furthermore, polyimide can be used suitably. Note that the term "polyimide" includes a polyamic acid that is a precursor of the polyimide. The polyimide is used by, for example, combining an epoxy-containing compound and an isocyanate-containing compound.

From the viewpoint of heat resistance, chemical stability, and mechanical properties, it is preferable to use the heat curable type resin material. Particularly, it is preferable to use a resin material including an epoxy resin or a polyimide resin, and from the viewpoint of mechanical properties (particularly, mechanical strength) and hygroscopic properties, it is preferable to use a resin material including a polyimide resin. A mixture of a polyimide resin and an epoxy resin can also be used. Furthermore, a thermoplastic resin and/or an elastomer may be mixed with a polyimide resin and/or an epoxy resin. Further, a rubber denatured material may be mixed as a polyimide resin and/or an epoxy resin. Flexibility or toughness (toughness) can be improved by mixing a thermoplastic resin and/or an elastomer. The same effect can also be obtained by using a rubber denatured material.

The light curable type resin material undergoes crosslinking reaction and/or polymerization reaction by ultraviolet light or visible light and cures. Examples of the light curable type resin material includes a radical polymerization type resin material and a cationic polymerization type resin material. A typical example of the radical polymerization type resin material includes a combination of an acrylic resin (an epoxy denatured acrylic resin, a urethane denatured acrylic resin, and a silicone denatured acrylic resin) and a light polymerization initiator. Examples of an ultraviolet light radical polymerization initiator include an acetophenone type initiator and a benzophenone type initiator. Examples of a visible light radical polymerization initiator can include a benzyl type initiator and a thioxanthone type initiator. A typical example of the cationic polymerization type resin material includes a combination of an epoxy-containing compound and a light cationic polymerization initiator. An example of the light cationic polymerization initiator can include a iodonium-salt-containing compound. Note that a resin material having both light curing properties and heat curing properties can also be used.

The liquid crystal panel 100Pb illustrated in FIG. 13B is different from the liquid crystal panel 100Pa in that the liquid crystal panel 100Pb includes an adhesive layer 67 between the resistive film 68 and the dielectric substrate 1. Furthermore, the liquid crystal panel 100Pb is different from the liquid crystal panel 100Pa in that a protective layer 69*b* is formed by using a high polymer film or a glass plate prepared in advance.

For example, the liquid crystal panel 100Pb including the protective layer 69*b* formed of the high polymer film is produced as described below.

First, a high polymer film having an insulation property and serving as the protective layer 69*b* is provided. For example, a polyester film such as polyethlene terephthalate and polyethylene naphthalate and a film made from super-engineering plastic such as polyphenylsulfone, polyimide, and polyamide are used as the high polymer film. The thickness of the high polymer film (that is, the thickness of the protective layer 69*b*) is, for example, greater than or equal to 5 μm and less than or equal to 200 μm.

The resistive film 68 is formed on one of surfaces of the high polymer film. The resistive film 68 can be formed by the above-described method. The resistive film 68 may be patterned, and the high polymer film may be patterned as necessary.

The high polymer film on which the resistive film 68 is formed (that is, a member including the protective layer 69*b* formed integrally with the resistive film 68) is bonded to the dielectric substrate 1 with an adhesive material. A curable resin similar to the curable resin used for forming the above-described protective layer 69*a* can be used as the adhesive material. Further, a hot melt type resin material (adhesive material) can also be used. The hot melt type resin material includes a thermoplastic resin as a main component, melts by heating and solidifies by cooling, Examples of the hot melt type resin material include polyolefin based (for example, polyethylene, polypropylene), polyamide based, ethylene-vinyl acetate based resin materials. Furthermore, a urethane based hot melt resin material (adhesive material) having reactivity is also commercially available. From the viewpoint of adhesiveness and durability, a urethane based material having reactivity is preferably used.

Furthermore, as with the resistive film 68 and the protective layer (high polymer film) 69*b*, the adhesive layer 67 may be patterned. However, since the adhesive layer 67 only needs to be able to fix the resistive film 68 and the protective layer 69*b* on the dielectric substrate 1, the adhesive layer 67 may be smaller in size than the resistive film 68 and the protective layer 69*b*.

In place of the high polymer film, the protective layer 69*b* can also be formed by using a glass plate. A production process may be similar to in a case where the high polymer film is used. The thickness of the glass plate is preferably less than or equal to 1 mm, and more preferably less than or equal to 0.7 mm. A lower limit of the thickness of the glass plate is not particularly limited, but from the viewpoint of handleability, the thickness of the glass plate is preferably greater than or equal to 0.3 mm.

In the liquid crystal panel 100Pb illustrated in FIG. 13B, the resistive film 68 formed on the protective layer (the high polymer film or the glass plate) 69*h* is fixed on the dielectric substrate 1 via the adhesive layer 67, but the resistive film 68 only needs to be disposed to come into contact with the dielectric substrate 1, and the resistive film 68 and the protective layer 69*h* are not necessarily fixed (caused to adhere) to the dielectric substrate 1, That is, the adhesive layer 67 may be omitted. For example, the high polymer film on which the resistive film 68 is formed (that is, a member including the protective layer 69*b* formed integrally with the resistive film 68) may be disposed to bring the resistive film 68 into contact with the dielectric substrate 1, and the resistive film 68 may be pressed against the dielectric substrate 1 with a casing for storing the scanning antenna. For example, since simple placement of the high polymer film on which the resistive film 68 is formed may lead to an increase in contact heat resistance, it is preferable to press the resistive film 68 against the dielectric substrate 1 to decrease the contact heat resistance. When such a configuration is adopted, the member including the resistive film 68 formed integrally with the protective layer (the high polymer film or the glass plate) 69*b* can be detachable.

Note that when the resistive film 68 (and the protective layer 69*b*) is patterned as described below, the resistive film 68 (and the protective layer 69*b*) is preferably fixed to prevent a decrease in performance of the antenna and fixed to the extent that a position of the resistive film 68 (and the protective layer 69*b*) with respect to the TFT substrate does not shift.

The heater resistive film 68 may be provided in any location as long as the location does not affect actions of the scanning antenna. However, to efficiently heat the liquid crystal material, it is preferable to provide the resistive film 68 near the liquid crystal layer. Accordingly, as illustrated in FIGS. 13A and 13B, it is preferable to provide the resistive film 68 on the outside of the TFT substrate 101. Furthermore, the case as illustrated in FIG. 13A where the resistive film 68 is directly provided on the outside of the dielectric substrate 1 of the TFT substrate 101 provides higher energy efficiency and higher temperature controllability than the case as illustrated in FIG. 13B where the resistive film 68 is provided on the outside of the dielectric substrate 1 via the adhesive layer 67. For this reason, it is preferable to directly provide the resistive film 68 on the outside of the dielectric substrate 1 of the TFT substrate 101.

Figure 14A:
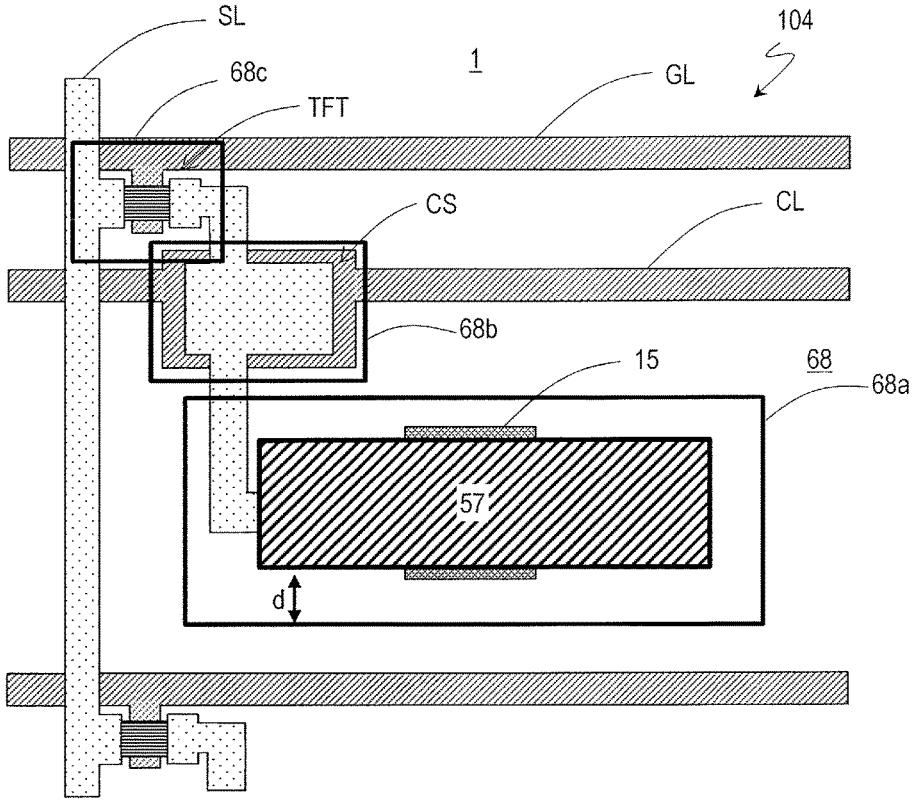
FIG. 14A is a schematic plan view illustrating a disposition relationship between the heater resistive film 68 and a TFT substrate 104.

For example, the resistive film 68 may be provided almost entirely on the surface of the dielectric substrate 1 with respect to the TFT substrate 104 illustrated in FIG. 14A. FIG. 14A is a schematic plan view illustrating a disposition relationship between the heater resistive film 68 and the TFT substrate 104.

The resistive film 68 preferably includes openings 68*a*, 68*b*, and 68*c*. When the TFT substrate 104 and the slot substrate are bonded to each other, the slots 57 are positioned to oppose the patch electrodes 15. At this time, the opening 68*a* is disposed to prevent the resistive film 68 from being present in a periphery at a distance d from an edge of the slot 57. The distance d is 0.5 mm, for example. Furthermore, it is preferable to dispose the opening 68*b* also under the auxiliary capacitance CS and to dispose the opening 68*c* also under the TFT.

Figure 14B:
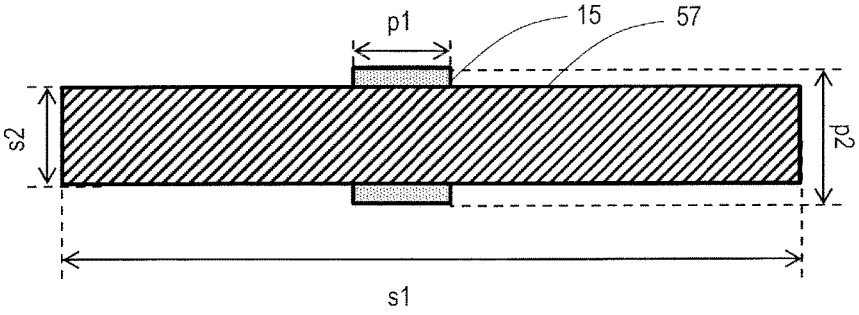
FIG. 14B is a schematic plan view for explaining sizes of a slot 57 and of a patch electrode 15.

Note that a size of the antenna unit U is, for example, 4 mm×4 mm. Furthermore, as illustrated in FIG. 14B, a width s2 of the slot 57 is 0.5 mm, a length s1 of the slot 57 is 3.3 mm, a width p2 of the patch electrode 15 in the width direction of the slot 57 is 0.7 mm, and a width p1 of the patch electrode 15 in the length direction of the slot 57 is 0.5 mm. Noted that the sizes, the shapes, the disposition relationship and the like of the antenna unit U, the slot 57, and the patch electrode 15 are not limited to the examples illustrated in FIGS. 14A and 14B.

The protective layers 69*a* and 69*b* may be formed entirely on the surface to cover the resistive film 68. As described above, when the protective layer 69*a* or 68*b* adversely affects antenna characteristics, openings corresponding to the openings 68*a*, 69*b*, and 68*c* of the resistive film 68 may be provided. In this case, the opening of the protective layer 69*a* or 69*b* is formed on the insides of the openings 68*a*, 68*b*, and 68*c* of the resistive film 68.

To further reduce influence of an electrical field from the heater resistive film 68, a shield conductive layer may be formed. The shield conductive layer, for example, is formed on the dielectric substrate 1 side of the resistive film 68 via an insulating film. The shield conductive layer is formed almost entirely on the surface of the dielectric substrate 1. Although the shield conductive layer need not be provided with the openings 68*a* and 68*b* as in the resistive film 68, the shield conductive layer is preferably provided with the opening 68*c*. The shield conductive layer is formed of, for example, an aluminum layer, and is set to ground potential.

Furthermore, the resistive film preferably has distribution of the resistance value such that the liquid crystal layer can be heated uniformly. Temperature distribution of the liquid crystal layer preferably has a difference between the maximum temperature and the minimum temperature (temperature fluctuation) of, for example, less than or equal to 15° C. When the temperature fluctuation exceeds 15° C., there may be a problem in phase difference modulation that varies within a plane to hinder favorable beam formation. Furthermore, when a temperature of the liquid crystal layer approaches a Tni point (for example, 125° C.), the $\Delta_{\varepsilon M}$ becomes small, and for this reason, such a temperature is not preferable.

With reference to FIGS. 15A and 15B, and FIGS. 16A to 16C, the distribution of the resistance value in the resistive film will be described. FIGS. 15A and 15B, and FIGS. 16A to 16C illustrate schematic structures and current distribution of resistance heating structures 80*a* to 80*e*. A resistance heating structure includes a resistive film and a heater terminal. The heater terminal is formed of, for example, nickel, chromium, titanium, aluminum, or copper. The heater terminal prepared in advance, for example, may be soldered to the resistive film. Alternatively, the heater terminal may be formed by forming the above-described metal film on the resistive film by vapor deposition or the like, and patterning the metal film.

Figure 15A:
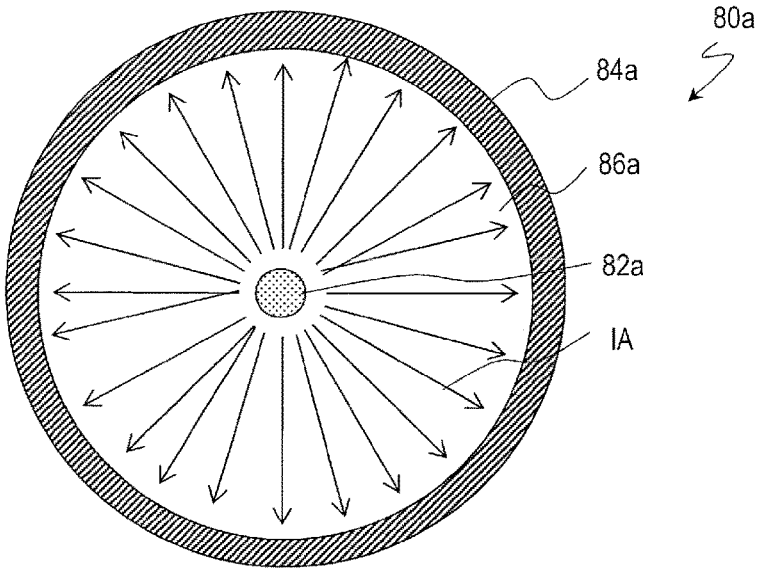
FIGS. 15A and 15B are diagrams illustrating schematic structures and current distribution of resistance heating structures 80*a* and 80*b*.

The resistance heating structure 80*a* illustrated in FIG. 15A includes a first terminal 82*a*, a second terminal 84*a*, and a resistive film 86*a* connected to the first terminal 82*a* and the second terminal 84*a*. The first terminal 82*a* is disposed at the center of a circle, and the second terminal 84*a* is disposed entirely along a circumference. Here, the circle corresponds to the transmission and/or reception region R1. When a DC voltage is supplied between the first terminal 82*a* and the second terminal 84*a*, a current IA flows radially from the first terminal 82*a* to the second terminal 84*a*, for example. Accordingly, even though the resistive film 86*a* has a constant in-plane resistance value, the resistive film

86*a* can uniformly generate heat. Of course, the direction or the current flow may be a direction from the second terminal 84*a* to the first terminal 82*a*.

In the resistive film 86*a*, current flows in the radial direction, and for this reason, when the transmission and/or reception region R1 having a circular shape is divided into four portions, the transmission and/or reception region R1 may be divided along lines extending in the radial direction, and there is such an advantage that it is not necessary to change a pattern of the resistive film 86*a*.

Figure 15B:
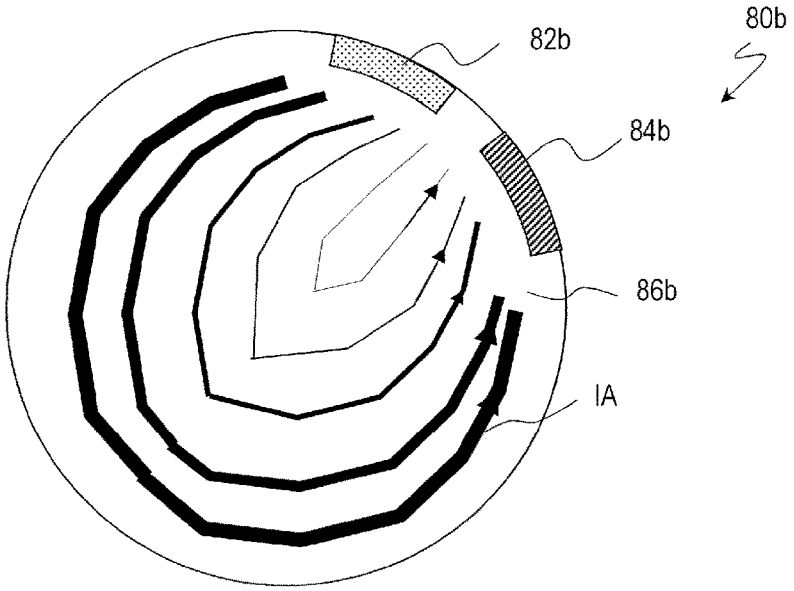

In FIG. 15B, the resistance heating structure 80*b* includes a first terminal 82*b*, a second terminal 84*b*, and a resistive film 86*b* connected to the first terminal 82*b* and the second terminal 84*b*. The first terminal 82*b* and the second terminal 84*b* are disposed adjacent to each other along a circumference. A resistance value of the resistive film 86*b* has an in-plane distribution such that a calorific value per unit area generated by the current IA flowing between the first terminal 82*b* and the second terminal 84*b* in the resistive film 86*b* becomes constant. In a case where the resistive film 86*b* is formed of, for example, a thin line, the in-plane distribution of the resistance value of the resistive film 86*b* may be adjusted by the thickness or density of the thin line.

Figure 16A:
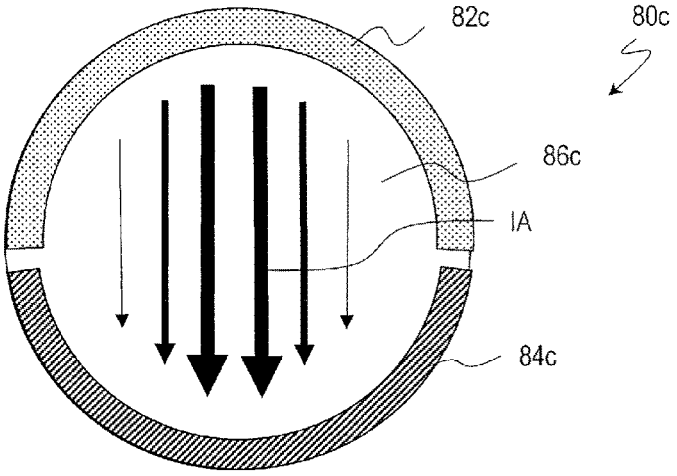
FIGS. 16A to 16C are diagrams illustrating schematic structures and current distribution of resistance heating structures 80*c* to 80*e*.

The resistance heating structure 80*c* illustrated in FIG. 16A includes a first terminal 82*c*, a second terminal 84*c*, and a resistive film 86*c* connected to the first terminal 82*c* and the second terminal 84*c*. The first terminal 82*c* is disposed along a circumference of an upper half of a circle, and the second terminal 84*c* is disposed along a circumference of a lower half of the circle. When the resistive film 86*c* is formed of, for example, a thin line extending vertically between the first terminal 82*c* and the second terminal 84*c*, for example the thickness and density of the thin line near the center are adjusted to increase such that a calorific value per unit area generated by the current IA becomes constant.

Figure 16B:
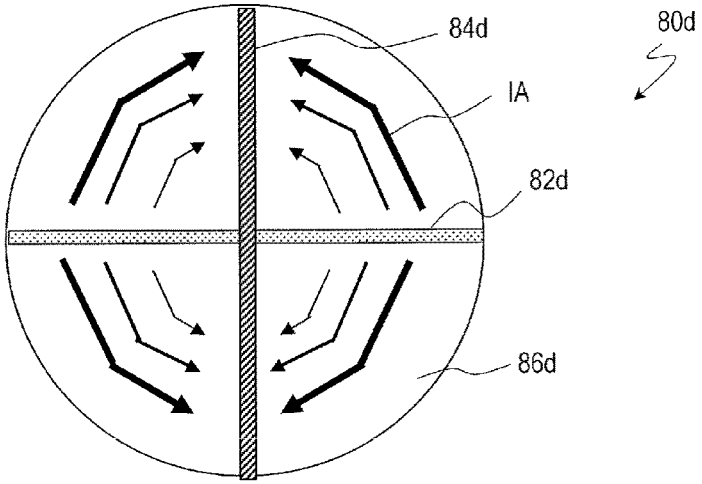

The resistance heating structure 80*d* illustrated in FIG. 16B includes a first terminal 82*d*, a second terminal 84*d*, and a resistive film 86*d* connected to the first terminal 82*d* and the second terminal 84*d*. The first terminal 82*d* and the second terminal 84*d* are provided to extend in the vertical direction and the horizontal direction, respectively, along a diameter of a circle. Although simplified in FIG. 16B, the first terminal 82*d* and the second terminal 84*d* are electrically insulated from each other.

Figure 16C:
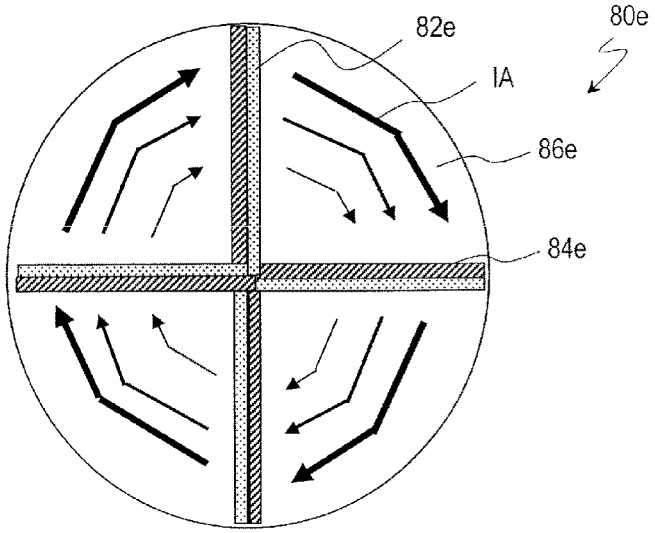

Furthermore, the resistance heating structure 80*e* illustrated in FIG. 16C includes a first terminal 82*e*, a second terminal 84*e*, and a resistive film 86*e* connected to the first terminal 82*e* and the second terminal 84*c*. The resistance heating structure 80*e* is different from the resistance heating, structure 80*d* in that each of the first terminal 82*e* and the second terminal 84*e* includes four portions extending from the center of the circle in four directions of upward, downward, left, and right directions. The portion of the first terminal 82*e* and the portion of the second terminal 84*e* forming a 90 degree angle with each other are disposed such that the current IA flows clockwise.

In any of the resistance heating structure 80*d* and the resistance heating structure 80*e*, for example the thickness and density of the thin line closer to the circumference are adjusted to increase such that the current IA increases as the current IA is closer to the circumference and as a result a calorific value per unit area becomes uniform in a plane.

Since the resistive film only needs to heat the liquid crystal layer LC in the transmission and/or reception region R1, the resistive film only needs to be provided in a region corresponding to the transmission and/or reception region R1 as exemplified, but a region where the resistive film is disposed is not limited to this region. For example, as illustrated in FIGS. 2A and 2B, when the TFT substrate 101 has an external shape that enables defining a rectangular region including the transmission and/or reception region R1, the resistive film may be provided in a region corresponding to the rectangular region including the transmission and/or reception region R1. Of course, the external shape of the resistive film is not limited to a rectangle but may be any shape including the transmission and/or reception region R1.

In the example described above, the resistive film is disposed on the outside of the TFT substrate 101, but the resistive film may be disposed on the outside of the slot substrate 201 (side opposite to the liquid crystal layer LC). In this case, as with the liquid crystal panel 100Pa in FIG. 13A, the resistive film may be formed directly on the dielectric substrate 51, or as with the liquid crystal panel 100Pb in FIG. 13B, the resistive film formed on the protective layer (the high polymer film or the glass plate) may be fixed to the dielectric substrate 51 via the adhesive layer. Alternatively, the protective layer on which the resistive film is formed (that is, a member including the protective layer formed integrally with the resistive film) may be disposed to bring the resistive film into contact with the dielectric substrate 51. For example, since simple placement of the high polymer film on which the resistive film 68 is formed may lead to an increase in contact heat resistance, it, is preferable to press the resistive film against the dielectric substrate 51 to decrease the contact heat resistance. When such a configuration is adopted, the member including the resistive film formed integrally with the protective layer (the high polymer film or the glass plate) can be detachable. Note that when the resistive film (and the protective layer) is patterned, the resistive film (and the protective layer) is preferably fixed to prevent a decrease in performance of the antenna and fixed to the extent that a position of the resistive film (and the protective layer) with respect to the slot substrate does not shift.

When the resistive film is disposed on the outside of the slot substrate 201, it is preferable to provide an opening at a position corresponding to the slot 57 of the resistive film. Furthermore, the resistive film preferably has a thickness that enables microwaves to sufficiently transmit the resistive film.

The example in which the resistive film is used as the heater part is described here, but besides this, fir example, nichrome wire (for example, winding wire), an infrared heater part, and the like can be used as the heater part. In this case, similarly, it is preferable to dispose the heater part to prevent a decrease in performance of the antenna.

Such an external heater structure may, for example, detect a temperature of the scanning antenna to automatically act when the temperature of the scanning antenna falls below a preset temperature. Of course, the external heater structure may act in response to an operation of a user.

For example, various known thermostats can be used as a temperature control device configured to cause the external heater structure to automatically act. For example, a thermostat using bimetal may be connected between one of two terminals connected to the resistive film and a power source. Of course, a temperature control device using a temperature detector and configured to supply a current from a power source to the external heater structure to prevent a temperature from falling below a preset temperature may be used.

Driving Method

Since the antenna unit, array of the scanning antenna according to an embodiment of the present invention includes a structure similar to a structure of an LCD panel, line sequential driving is performed in the same manner as an LCD panel. However, in a case where an existing driving method of an LCD panel is applied, the following problems may occur. The problems that can occur in the scanning antenna will be described with reference to an equivalent circuit diagram of one antenna unit of the scanning antenna illustrated in FIG. 17.

First, as described above, since a liquid crystal material having large dielectric anisotropy $\Delta_{\varepsilon M}$ (birefringence Δn with respect to visible light) in a microwave range has low specific resistance, in a case where the driving method of an LCD panel is applied as is, a voltage applied to a liquid crystal layer cannot be maintained sufficiently. Then, an effective voltage applied to the liquid crystal layer decreases, and an electrostatic capacitance value of liquid crystal capacitance does not reach a target value.

Thus, when the voltage applied to the liquid crystal layer deviates from a predetermined value, the direction in which the antenna obtains the maximum gain deviates from a desired direction. Then, for example, a communication satellite cannot be tracked accurately. To prevent this, the auxiliary capacitance CS is provided electrically in parallel to the liquid crystal capacitance Clc to sufficiently increase a capacitance value C-Ccs of the auxiliary capacitance CS. The capacitance value C-Ccs of the auxiliary capacitance CS is preferably set appropriately such that a voltage retention rate of the liquid crystal capacitance Clc becomes 90% or greater.

Furthermore, when a liquid crystal material having low specific resistance is used, a voltage decreases owing to interface polarization and/or orientation polarization. To prevent a voltage from decreasing owing to the polarization, it is conceivable to apply a voltage sufficiently high in consideration of an amount of the voltage drop. However, when a high voltage is applied to a liquid crystal layer having low specific resistance, a dynamic scattering effect (DS effect) may occur. The DS effect is caused by convection of ionic impurities in the liquid crystal layer, and the dielectric constant it of the liquid crystal layer approaches an average value ((εM//+2εM)/3). Furthermore, to control the dielectric constant εM of the liquid crystal layer in multiple stages (multiple gray scales), it is not always possible to apply a voltage sufficiently high.

To suppress the above-described DS effect and/or the voltage drop due to the polarization, a polarity inversion period of the voltage applied to the liquid crystal layer may be shortened sufficiently. As is well known, in a case where the polarity inversion period of the applied voltage is shortened, a threshold voltage at which the DS effect occurs increases. Accordingly, a polarity inversion frequency may be determined such that the maximum value of the voltage (absolute value) applied to the liquid crystal layer becomes less than the threshold voltage at which the DS effect occurs. When the polarity inversion frequency is 300 Hz or greater, even in a case where, for example, a voltage having an absolute value of 10 V is applied to a liquid crystal layer having specific resistance of $1\times10^{10}$ Ω·cm and the dielectric anisotropy Δε (@ 1 kHz) of about −0.6, a favorable action can be ensured. Furthermore, when the polarity inversion frequency (typically equal to twice the frame frequency) is 300 Hz or greater, the above-described voltage drop due to the polarization is also suppressed. From the viewpoint of power consumption and the like, an upper limit of the polarity inversion period is preferably about less than or equal to 5 KHz.

As described above, since viscosity of a liquid crystal material depends on temperature, it is preferable to appropriately control a temperature of the liquid crystal layer. Physical properties and driving conditions of the liquid crystal material described here correspond to values in an operating temperature of the liquid crystal layer. In other words, a temperature of the liquid crystal layer is preferably controlled to enable driving under the above-described conditions.

An example of a waveform of a signal used for driving the scanning antenna will be described with reference to FIGS. 18A to 18G. Note that FIG. 18D illustrates a waveform of a display signal Vs (LCD) supplied to a source bus line of an LCD panel for comparison.

Figures 18A, 18B, 18C, 18D, 18E, 18F, 18G:
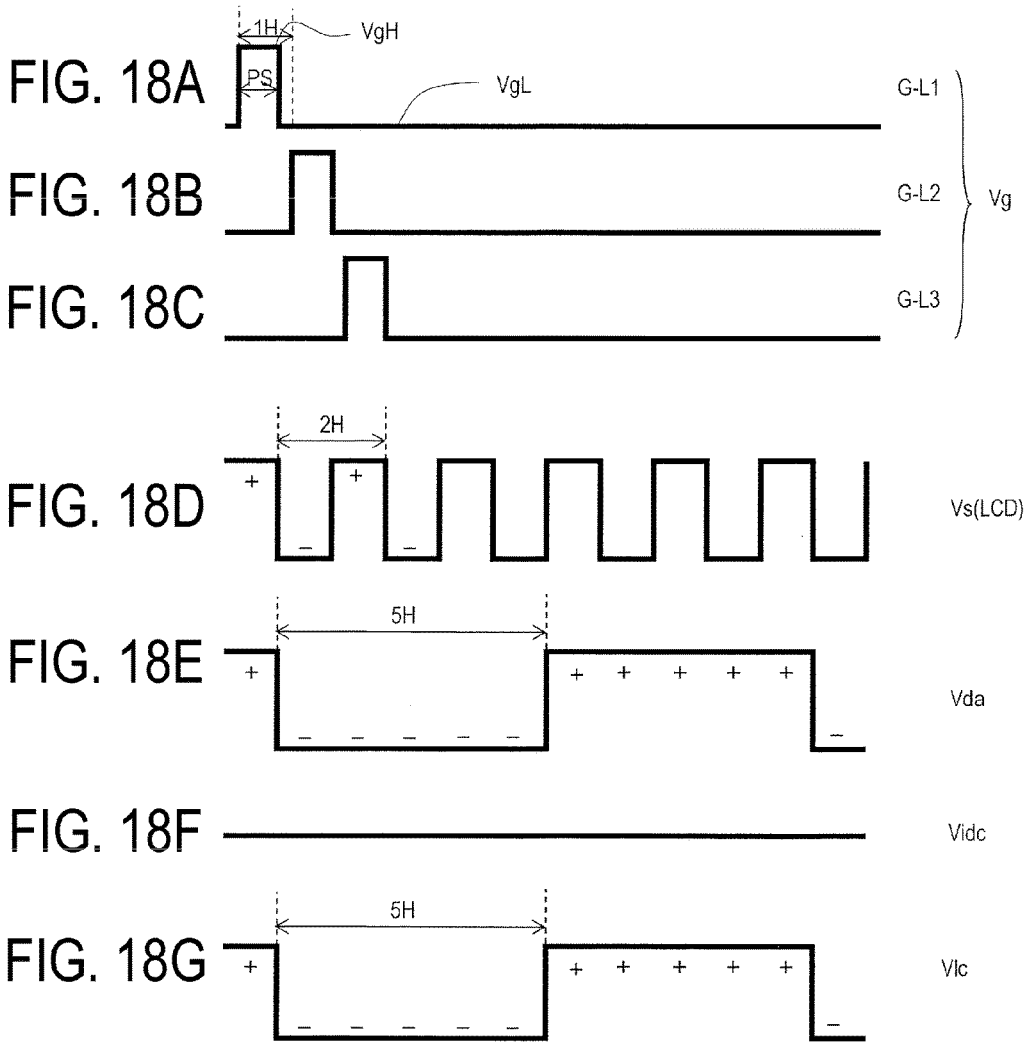
FIGS. 18A to 18C, and FIGS. 18E to 18G are diagrams illustrating examples of waveforms of respective signals used for driving the scanning antenna according to an embodiment.
FIG. 18D is a diagram illustrating a waveform of a display signal of an LCD panel performing dot inversion driving.

FIG. 18A illustrates a waveform of a scanning signal Vg supplied to a gate bus line G-L1, FIG. 18B illustrates a waveform of the scanning signal Vg supplied to a gate bus line G-L2, FIG. 18C illustrates a waveform of the scanning signal Vg supplied to a gate bus line G-L3, FIG. 18E illustrates a waveform of a data signal Vda supplied to a source bus line, FIG. 18F illustrates a waveform of a slot voltage Vide supplied to a slot electrode (slot electrode) of a slot substrate, and FIG. 18G illustrates a waveform of a voltage applied to a liquid crystal layer of each antenna unit.

As illustrates in FIGS. 18A to 18C, a voltage of the scanning signal Vg supplied to the gate bus line sequentially changes from a low level (VgL) to a high level (VgH). The VgL and the VgH can be set appropriately according to characteristics of a TFT. For example, VgL= from −5 V to 0 V, and VgH=+20 V. Furthermore, VgL=−20 V and VgH=+20 V. A period from time when a voltage of the scanning signal Vg of a certain gate bus line changes from the low level (VgL) to the high level (VgH) until time when a voltage of the next gate bus line changes from the VgL to the VgH will be referred to as one horizontal scanning period (1H). Furthermore, a period during which a voltage of each gate bus line is at the high level (VgH) will be referred to as a selection period PS. During this selection period PS, the TFT connected to each gate bus line is turned on, and a voltage at that time of the data signal Vda supplied to the source bus line is supplied to a corresponding patch electrode. The data signal Vda has, for example, −15 V to +15 V (an absolute value is 15 V), and, for example, data signals Vda having different absolute values corresponding to 12 gray scales, or preferably corresponding to 16 gray scales are used.

The case where an intermediate voltage is applied to all antenna units is exemplified here. That is, it is assumed that a voltage of the data signal Vda is constant with respect to all antenna units (assumed to be connected to in gate bus lines). This corresponds to the case where certain gray levels are displayed entirely on a surface of the LCD panel. At this time, dot inversion driving is performed in the LCD panel. That is, in each frame, a display signal voltage is supplied such that polarities of pixels (dots) adjacent to each other are reversed to each other.

FIG. 18D illustrates a waveform of a display signal of the LCD panel in which dot inversion driving is performed. As illustrated in FIG. 18D, a polarity of the Vs (LCD) is inverted every 1H. The polarity of the Vs (LCD) supplied to the source bus line adjacent to the source bus line supplied with the Vs (LCD) having this waveform is reversed to the polarity of the Vs (LCD) illustrated in FIG. 18D. Furthermore, a polarity of the display signal supplied to all the pixels is inverted for each frame. In the LCD panel, it is difficult to completely match a positive polarity and a negative polarity in a magnitude of the effective voltage applied to the liquid crystal layer, and a difference in the effective voltage leads to a difference in luminance that is observed as flicker. To make this flicker difficult to observe, pixels (dots) to which voltage differing in polarity is applied are spatially dispersed in each frame. Typically, pixels (dots) having different polarities are arranged in a checkered pattern by performing dot inversion driving.

In contrast, in the scanning antenna, the flicker itself is not problematic. That is, as long as the electrostatic capacitance value of the liquid crystal capacitance is a desired value, the spatial distribution of the polarity in each frame is not problematic. Accordingly, from the perspective of low power consumption or the like, it is preferable to reduce the number of times of polarity inversion of the data signal Vda supplied from the source bus line. That is, it is preferable to increase the polarity inversion period. For example, as illustrated in FIG. 18E, the polarity inversion period may be set to 10 H (polarity inversion occurs every (5 H). Of course, in a case where the number of antenna units connected to each source bus line (typically equal to the number of gate bus lines) is m, the polarity inversion period of the data signal Vda may be 2 m·H (polarity inversion occurs every m·H). The polarity inversion period of the data signal Vda may be equal to 2 frames (polarity inversion occurs for each frame).

Furthermore, the polarity of the data signal Vda supplied from each source bus line may be the same. Accordingly, for example, in a certain frame, the data signal Vda having a positive polarity may be supplied from each source bus line, and in the next frame, the data signal Vda having a negative polarity may be supplied from each source bus line.

Alternatively, the polarities of the data signals Vda supplied from the source bus lines adjacent to each other may be reversed to each other. For example, in a certain frame, the data signal Vda having a positive polarity is supplied from each source bus line in odd-numbered columns, and the data signal Vda having a negative polarity is supplied from each source bus line in even-numbered columns. Then, in the next frame, the data signal Vda having a negative polarity is supplied from each source bus line in odd-numbered columns, and the data signal Vda having a positive polarity is supplied from each source bus line in even-numbered columns. In the LCD panel, such a driving method is referred to as source line reversal driving, in a case where the polarities of the data signals Vda supplied from the source bus lines adjacent to each other are reversed to each other, an electric charge stored in the liquid crystal capacitance can be canceled between columns adjacent to each other by connecting (short-circuiting) the source bus lines adjacent to each other, and thereafter by inverting the polarities of the data signals Vda supplied between the frames. Accordingly, it is possible to obtain such an advantage that an amount of the electric charge supplied from the source bus line in each frame can be reduced.

As illustrated in FIG. 18F, the voltage Vide of the slot electrode is, for example, a DC voltage, and is typically ground potential. Since a capacitance value of the capacitance (liquid crystal capacitance and auxiliary capacitance) of the antenna unit is greater than a capacitance value of the pixel capacitance of the LCD panel (for example, about 30 times in comparison with a 20-inch LCD panel), there is no influence from a pull-in voltage due to parasitic capacitance of the TFT, and even in a case where the voltage Vide of the slot electrode is ground potential and the data signal Vda has a positive or negative symmetrical voltage on the basis of ground potential, a voltage supplied to the patch electrode is a positive and negative symmetrical voltage. In the LCD panel, although the positive and negative symmetrical voltage is applied to the pixel electrode by adjusting a voltage of the counter electrode (common voltage) in consideration of the pull-in voltage of the TFT, this is not necessary for the slot voltage of the scanning antenna, and ground potential may be used. Furthermore, although not illustrated in FIGS. 18A to 18G, the same voltage as the slot voltage Vide is supplied to the CS bus line.

Since the voltage applied to the liquid crystal capacitance of the antenna unit is the voltage of the patch electrode (that is, the voltage of the data signal Vda illustrated in FIG. 18E) with respect to the voltage Vide (FIG. 18F) of the slot electrode, when the slot voltage Vide is ground potential, a waveform of the voltage applied to the liquid crystal capacitance of the antenna unit matches the waveform of the data signal Vda illustrated in FIG. 18E, as illustrated in FIG. 18G.

The waveform of the signal used fir driving the scanning antenna is not limited to the above-described example. For example, as described below with reference to FIGS. 19 and 20, a voltage Viac having an oscillation waveform may be used as the voltage of the slot electrode.

For example, signals as exemplified in FIGS. 19A to 19E can be used. In FIGS. 19A to 19E, although the waveform of the scanning signal Vg supplied to the gate bus line is omitted, the scanning signal Vg described with reference to FIGS. 18A to 18C is also used here.

Figure 19A:
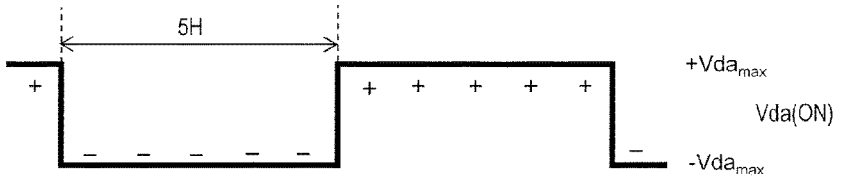
FIGS. 19A to 19E are diagrams illustrating other examples of waveforms of signals used for driving the scanning antenna according to an embodiment.

As illustrated in FIG. 19A, as with in FIG. 18E, a case where the waveform of the data signal Vda is inverted in polarity at a 10 H period (every 5 H) will be exemplified. Here, a case where amplitude has a maximum value $|Vda_{max}|$ is described as the data signal Vda. As described above, the waveform of the data signal Vda may be inverted in polarity at a two frame period (for each frame).

Figure 19B:
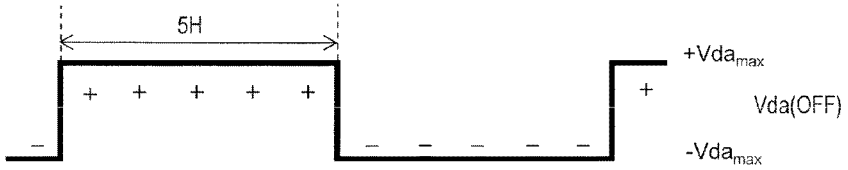
Figure 19C:
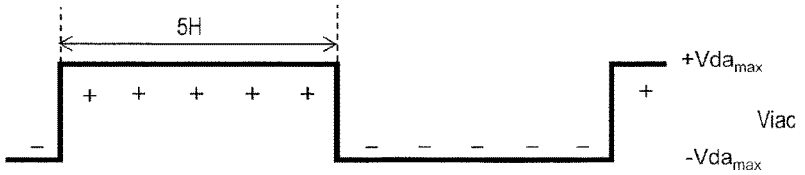

Here, as illustrated in FIG. 19C, the voltage Viac of the slot electrode is set to be an oscillating voltage having a polarity reversed to a polarity of a data signal Vda (ON) and the same oscillation period as an oscillation period of the data signal Vda (ON). Amplitude of the voltage Viac of the slot electrode is equal to the maximum value $|Vda_{max}|$ of the amplitude of the data signal Vda. That is, the slot voltage Viac is set to be a voltage having the same polarity inversion period as a polarity inversion period of the data signal Vda (ON) and a polarity reversed to the polarity of the data signal Vda (ON) (the phase differs by 180°) and oscillating between $-Vda_{max}$ and $+Vda_{max}$.

Figure 19D:
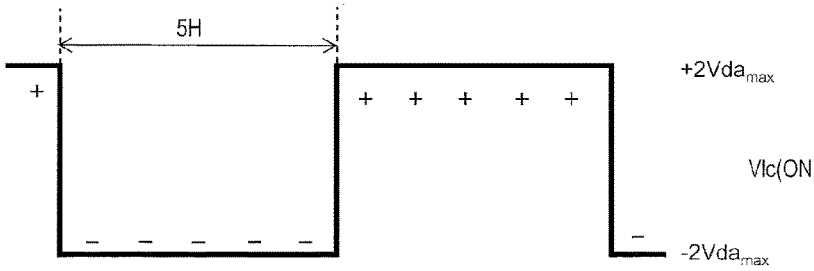

Since a voltage Vlc applied to the liquid crystal capacitance of the antenna unit is the voltage of the patch electrode with respect to the voltage Viac (FIG. 19C) of the slot electrode (that is, the voltage of the data signal Vda (ON) illustrated in FIG. 19A), when the amplitude of the data signal Vda oscillates at $\pm Vda_{max}$, the voltage applied to the liquid crystal capacitance has a waveform that oscillates at amplitude twice $Vda_{max}$ as illustrated in FIG. 19D. Accordingly, the maximum amplitude of the data signal Vda necessary for setting the maximum amplitude of the voltage Vlc applied to the liquid crystal capacitance to $\pm Vda_{max}$ is $\pm Vda_{max}/2$.

Since the maximum amplitude of the data signal Vda can be halved by using such a slot voltage Viac, there is such an advantage that, for example, a general-purpose driver IC having a breakdown voltage of 20 V or less can be used as a driver circuit configured to output the data signal Vda.

Figure 19E:
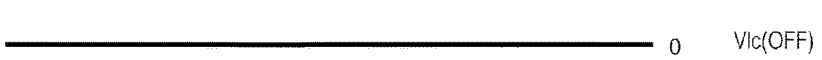

Note that, to set a voltage Vlc (OFF) applied to the liquid crystal capacitance of the antenna, unit to zero as illustrated in FIG. 19E, a data signal Vda (OFF) may be set to have the same waveform as the waveform of the slot voltage Viac as illustrated in FIG. 19B.

A case where the maximum amplitude of the voltage Vlc applied to the liquid crystal capacitance is +15 V will be described as an example. When the Vidc illustrated in FIG. 18F is used as the slot voltage and Vidc=0 V, the maximum amplitude of the Vda illustrated in FIG. 18E becomes ±15 V. In contrast, when the Viac illustrated in FIG. 19C is used as the slot voltage and the maximum amplitude or the Viac is ±7.5 V, the maximum amplitude of the Vda (ON) illustrated in FIG. 19A becomes ±7.5 V.

When the voltage Vie applied to the liquid crystal capacitance is 0 V, the Vda illustrated in FIG. 18E may be set to 0 V, and the maximum amplitude of the Vda (OFF) illustrated in FIG. 19B may be set to ±7.5 V.

In the case that the Viac illustrated in FIG. 19C is used, since amplitude of the voltage Vlc applied to the liquid crystal capacitance is different from the amplitude of the Vda, appropriate conversion is necessary.

Figure 20A:
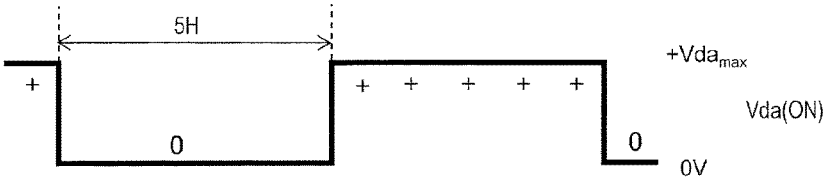
FIGS. 20A to 20E are diagrams illustrating further other examples of waveforms of signals used for driving the scanning antenna according to an embodiment.
Figure 20B:
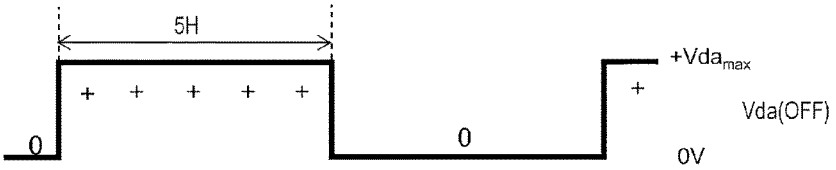
Figure 20C:
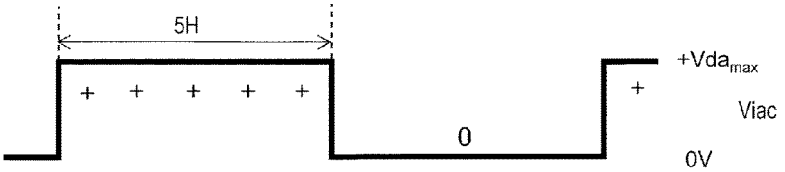

Signals as illustrated in FIGS. 20A to 20E can also be used. As with the signals illustrated in FIGS. 19A to 19E, the signals illustrated in FIGS. 20A to 20E are each set to have an oscillating voltage of the voltage Viac of the slot electrode having an oscillation phase shifted by 180 degrees from the voltage of the data signal Vda (ON), as illustrated in FIG. 20C. However, as illustrated in each of FIGS. 20A to 20C, any of the data signal Vda (ON), the data signal Vda (OFF) and the slot voltage Viac is set to have a voltage oscillating between 0 V and a positive voltage. Amplitude of the voltage Viac of the slot electrode is equal to the maximum value $|Vda_{max}|$ of the amplitude of the data signal Vda.

Figure 20D:
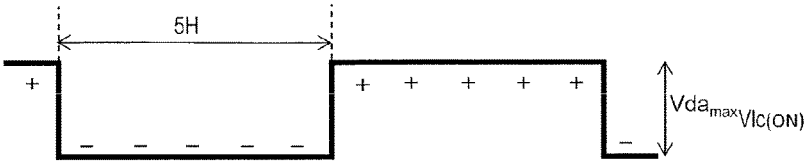

When such a signal is used, a drive circuit may output only a positive voltage, and the use of such a signal contributes to cost reduction. Even when the voltage oscillating between 0 V and a positive voltage is used, a polarity of a voltage Vlc (ON) applied to the liquid crystal capacitance is inverted as illustrated in FIG. 20D. In the voltage waveform illustrated in FIG. 20D, + (positive) indicates that the voltage of the patch electrode is higher than the slot voltage, and − (negative) indicates that the voltage of the patch electrode is lower than the slot voltage. That is, the direction (polarity) of an electrical field applied to the liquid crystal layer is inverted as with in the other examples. Amplitude of the voltage Vlc (ON) applied to the liquid crystal capacitance is $Vda_{max}$.

Figure 20E:
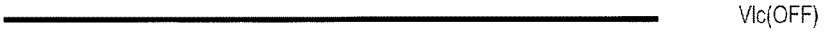

Noted that to set the voltage Vlc (OFF) applied to the liquid crystal capacitance of the antenna unit to zero as illustrated in FIG. 20E, the data signal Vda (OFF) may be set to have the same waveform as the waveform of the slot voltage Viac as illustrated in FIG. 20B.

The driving method including oscillating (inverting) the voltage Viac of the slot electrodes as described with reference to FIGS. 19 and 20 corresponds to a driving method including inverting a counter voltage (may be referred to as "common reversal driving") in terms of a driving method of an LCD panel. In the LCD panel, since flicker cannot be suppressed sufficiently, the common reversal driving is not adopted. In contrast, in the scanning antenna, since flicker is not problematic, the slot voltage can be inversed. Oscillation (inversion) may be performed for each frame, for example (5H in FIGS. 19 and 20 is set to 1 V (vertical scanning period or frame)).

Although the example in which one voltage is applied to the voltage Viac of the slot electrode, that is, the example in which the slot electrode common to all the patch electrodes is provided is described above, the slot electrode may be divided corresponding to one row or two or more rows of the patch electrodes. Here, a row refers to a set of the patch electrodes connected to one gate bus line via the TFT. When the slot electrode is divided into a plurality of row portions in this way, polarities of voltage of the respective portions of the slot electrode can be made independent of one another. For example, in any frame, among the polarities of voltage applied to the patch electrodes, polarities of voltage applied to the patch electrodes connected to the gate bus lines adjacent to each other can be reversed to each other. Thus, it is possible to perform not only row inversion (1H inversion) in which the polarity is inverted for each row of the patch electrodes, but also in row inversion (mil inversion) in which the polarity is inverted every two or more rows. Of course, row inversion and frame inversion can be combined.

From the viewpoint of simplicity of driving, it is preferable to perform the driving in which all the polarities of voltage applied to the patch electrodes are set to be the same in any frame and the polarities are inverted for each frame.

Example of Connection of Antenna Unit Array, Gate Bus Line, and Source Bus Line

In the scanning antenna according to an embodiment of the present invention, the antenna units are arranged concentrically, for example.

For example, in a case where the antenna units are arranged in m concentric circles, for example one gate bus line is provided for each circle, and a total of m gate bus lines is provided. For example, assuming that an outer diameter of the transmission and/or reception region R1 is 800 mm, m is 200, for example. Assuming that the innermost gate bus line is the first one, n (30, for example) antenna units are connected to the first gate bus line and nx (620, for example) antenna units are connected to the mth gate bus line.

In such arrangement, the number of the antenna units connected to each gate bus line is different. Furthermore, although the m antenna units are connected to the nx source bus lines connected to the nx antenna units constituting the outermost circle, the number of the antenna units connected to the source bus lines connected to the antenna units constituting the inner circle becomes less than m.

Thus, the arrangement of the antenna units in the scanning antenna is different from the arrangement of the pixels (dots) in the LCD panel, and the number of the antenna units connected differs depending on the gate bus lines and/or the source bus lines. Accordingly, in a case Where the capacitance (liquid crystal capacitance+auxiliary capacitance) of all the antenna units is set to be the same, electrical loads connected to the gate bus lines and/or the source bus lines differ depending on the gate bus lines and/or the source bus lines. In such a case, there is a problem of variation occurring in writing of voltage to the antenna units.

Therefore, to prevent such variation, electrical loads connected to the respective gate bus lines and the respective source bus lines are preferably set to be substantially the same by, for example, adjusting a capacitance value of the auxiliary capacitance, or by adjusting the number of the antenna units connected to the gate bus lines and/or the source bus lines.

The scanning antenna according to an embodiment of the present invention is housed in, for example, a housing made from plastic, as necessary. A material having a small dielectric constant εM and not affecting microwave transmission and reception is preferably used for the housing. Furthermore, a through-hole may be provided in a portion corresponding to the transmission and/or reception region R1 of the housing. Further, a light blocking structure may be provided to prevent the liquid crystal material from being exposed to light. The light blocking structure is, for example, provided to block light propagating the dielectric substrate 1 and/or 51 from a side surface of the dielectric substrate 1 of the TFT substrate 101 and/or a side surface of the dielectric substrate 51 of the slot substrate 201 and being incident upon the liquid crystal layer. A liquid crystal material having a large dielectric anisotropy $\Delta_{\varepsilon M}$ may be prone to photodegradation, and it is preferable to block not only ultraviolet rays but also short-wavelength blue light of visible light. The light blocking structure can be formed easily in a necessary location by using, for example, a light blocking tape such as a black adhesive tape.

INDUSTRIAL APPLICABILITY

An embodiment according to the present invention is used in a scanning antenna for satellite communication or satellite broadcasting mounted on a mobile body (a ship, an aircraft, and an automobile, for example).

REFERENCE SIGNS LIST

1 Dielectric substrate
2 Base insulating film
3 Gate electrode
4 Gate insulating layer
5 Semiconductor layer
6D Drain contact layer
6S Source contact layer
7D Drain electrode
7S Source electrode
7*p* Source connection wiring line
11 First insulating layer
15 Patch electrode
15*p* Patch connecting section
17 Second insulating layer
18*g*, 18*s*, 18*p* Opening
19*g* Gate terminal upper connection section
19*p* Transfer terminal upper connection section
19*s* Source terminal upper connection section
21 Alignment mark
23 Protective conductive layer
51 Dielectric substrate
52 Third insulating layer
54 Dielectric layer (air Layer)
55 Slot electrode
55L Lower layer
55M Main layer
55U Upper layer
55*c* Contact surface
57 Slot
58 Fourth insulating layer
60 Upper connection section
65 Reflective conductive plate
67 Adhesive layer
68 Heater resistive film
69 Protective layer
70 Power supply device
71 Conductive beads
72 Power supply pin
73 Sealing portion
80*a*, 80*b*, 80*c*, 80*d*, 80*e* Resistance heating structure
82*a*, 82*b*, 82*c*, 82*d*, 82*e* First terminal
84*a*, 84*b*, 84*c*, 84*d*, 84*e* Second terminal
86, 86*a*, 86*b*, 86*c*, 86*d*, 86*e* Heater resistive film
101, 102, 103 TFT substrate
201, 203 Slot substrate
1000 Scanning antenna
CH1, CH2, CH3, CH4, CH5, CH6 Contact hole
GD Gate driver
GL Gate bus line
GT Gate terminal section
SD Source driver
SL Source bus line
ST Source terminal section
PT Transfer terminal section
IT Terminal section
LC Liquid crystal layer
R1 Transmission and/or reception region
R2 Non-transmission and/or reception region
Rs Seal region
U Antenna unit, Antenna unit region

The invention claimed is:

1. A scanning antenna in which a plurality of antenna units are arranged, the scanning antenna comprising:
- a TFT substrate including:
  - a first dielectric substrate,
  - a plurality of TFTs supported by the first dielectric substrate,
  - a plurality of gate bus lines,
  - a plurality of source bus lines, and
  - a plurality of patch electrodes;
- a slot substrate including:
  - a second dielectric substrate, and
  - a slot electrode formed on a first main surface of the second dielectric substrate;
- a liquid crystal layer provided between the TFT substrate and the slot substrate; and
- a reflective conductive plate disposed opposing via a dielectric layer a second main surface opposite to the first main surface of the second dielectric substrate,
- wherein the slot electrode includes a plurality of slots disposed corresponding to the plurality of patch electrodes, and
- a heater part is further disposed on an outside of the first dielectric substrate or on an outside of the second dielectric substrate.

2. The scanning antenna according to claim 1,
wherein the heater part includes a heater resistive film.

3. The scanning antenna according to claim 2, further comprising a protective layer configured to cover the heater resistive film.

4. The scanning antenna according to claim 3,
wherein the protective layer is formed of a curable resin layer, a high polymer film, or a glass plate.

5. The scanning antenna according to claim 2,
wherein the heater resistive film is directly formed on the first dielectric substrate.

6. The scanning antenna according to claim 2, further comprising an adhesive layer between the first dielectric substrate and the heater resistive film.

7. The scanning antenna according to claim 2,
wherein the heater resistive film includes a plurality of openings, and
the plurality of openings include a plurality of openings corresponding to the plurality of slots and being greater in size than the plurality of slots.

8. The scanning antenna according to claim 1, further comprising:
- a power source connected to the heater part; and
- a temperature control device configured to control a current supplied from the power source to the heater part.

* * * * *